US010590639B2

(12) United States Patent
Nogoshi et al.

(10) Patent No.: US 10,590,639 B2
(45) Date of Patent: Mar. 17, 2020

(54) TOILET SEAT DEVICE AND TOILET DEVICE

(71) Applicant: TOTO LTD., Kitakyushu-shi, Fukuoka (JP)

(72) Inventors: Yusuke Nogoshi, Kitakyushu (JP); Satoshi Matsunaka, Kitakyushu (JP); Ryo Suzuki, Kitakyushu (JP); Yuki Moriizumi, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 16/184,093

(22) Filed: Nov. 8, 2018

(65) Prior Publication Data

US 2019/0194927 A1 Jun. 27, 2019

(30) Foreign Application Priority Data

Dec. 22, 2017 (JP) ..... 2017-246684
Aug. 30, 2018 (JP) ..... 2018-161693

(51) Int. Cl.
*E03D 9/08* (2006.01)
*E03D 9/00* (2006.01)
(Continued)

(52) U.S. Cl.
CPC ..... *E03D 9/08* (2013.01); *A47K 13/00* (2013.01); *E03D 9/00* (2013.01); *E03D 9/002* (2013.01); *E03D 9/005* (2013.01); *E03D 9/05* (2013.01)

(58) Field of Classification Search
CPC ..... E03D 9/005
(Continued)

(56) References Cited

U.S. PATENT DOCUMENTS 6,226,228 B1 * 5/2001 Hossack ..... G01N 29/2456 367/11
2010/0041572 A1 * 2/2010 Sano ..... C10M 101/02 508/382
(Continued)

FOREIGN PATENT DOCUMENTS

JP 2007-138605 A 6/2007
JP 2008-163716 A 7/2008
(Continued)

OTHER PUBLICATIONS

English translation of Japanese Patent No. 6226228 B2, issued Nov. 8, 2017 in the name of Panasonic Corp.

*Primary Examiner* — Lori L Baker
(74) *Attorney, Agent, or Firm* — Pearne & Gordon LLP

(57) ABSTRACT

According to one embodiment, a toilet seat device includes a toilet seat, a sterilizer, a sprayer, a blower, and a controller. The sterilizer generates sterilizing water. The sprayer sprays a mist of the sterilizing water. The blower generates a rising air stream. The controller controls the sprayer to execute first and second processes and cause a total amount of the mist sprayed in the first process to be less than that in the second process. The first process and the second process are executed at different timing. The first process includes controlling the blower to generate a first rising air stream capable of lifting the mist toward the toilet seat. The second process includes the blower not generating the first rising air stream and not lifting the mist toward the toilet seat.

14 Claims, 24 Drawing Sheets

(51) Int. Cl.
*A47K 13/00* (2006.01)
*E03D 9/05* (2006.01)

(58) Field of Classification Search
USPC ..... 4/420.4, 444
See application file for complete search history.

(56) References Cited

U.S. PATENT DOCUMENTS

| | | | | |
|---|---|---|---|---|
| 2013/0003469 | A1* | 1/2013 | Kulkarni | G11C 7/02 365/189.011 |
| 2014/0059757 | A1* | 3/2014 | Hamakita | E03D 9/00 4/420 |
| 2019/0194924 | A1* | 6/2019 | Nogoshi | E03D 9/005 |
| 2019/0194925 | A1* | 6/2019 | Nogoshi | E03D 9/005 |
| 2019/0194927 | A1* | 6/2019 | Nogoshi | E03D 9/08 |
| 2019/0301149 | A1* | 10/2019 | Nogoshi | E03D 9/002 |
| 2019/0301150 | A1* | 10/2019 | Nogoshi | E03D 9/08 |

FOREIGN PATENT DOCUMENTS

| | | | |
|---|---|---|---|
| JP | 2013-155595 | A | 8/2013 |
| JP | 2014-163162 | A | 9/2014 |
| JP | 2015-158103 | A | 9/2015 |
| KR | 10-2010-0041572 | A | 4/2010 |
| KR | 10-2013-0003469 | A | 1/2013 |

* cited by examiner

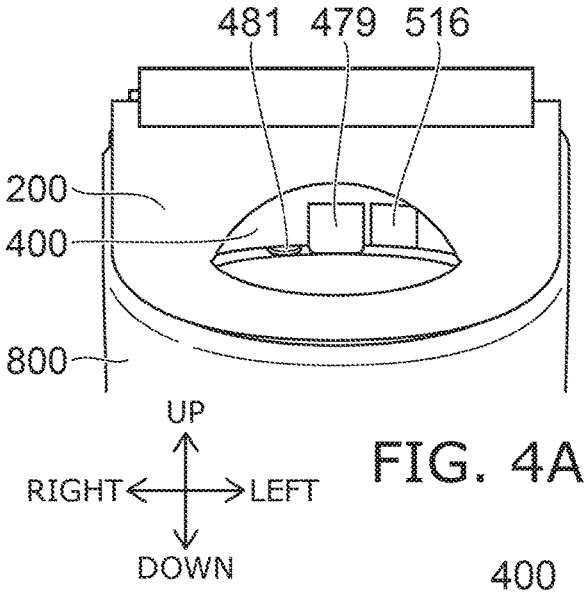
FIG. 4A
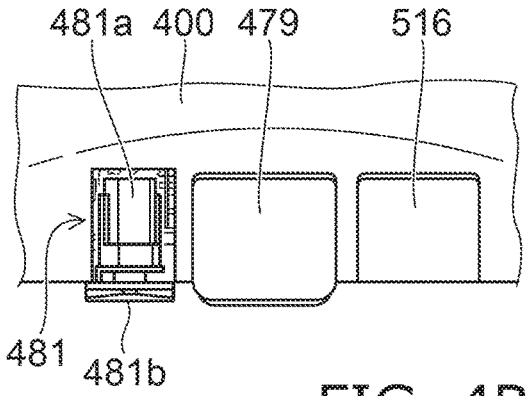
FIG. 4B
FIG. 4C
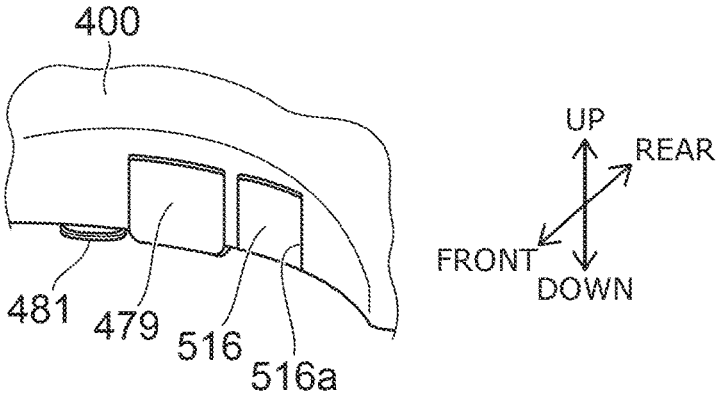
FIG. 4D
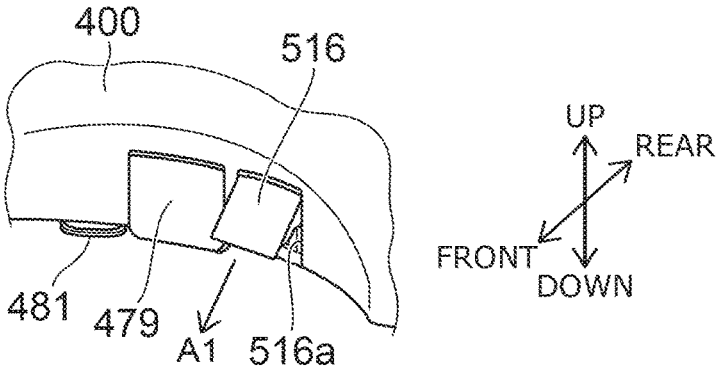
FIG. 4E
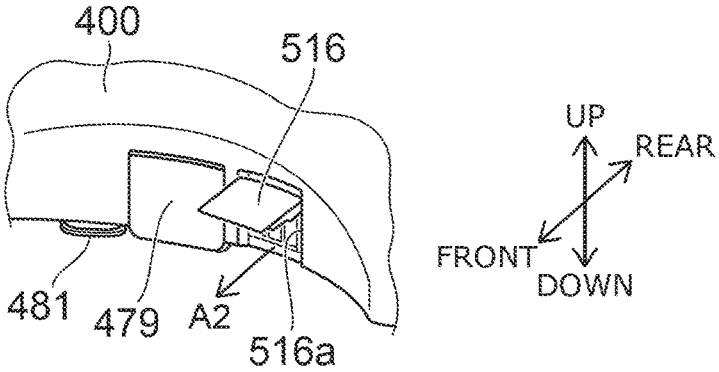

| | PRE-MIST (AUTOMATIC) | AFTER-MIST (AUTOMATIC) | MANUAL MIST (MANUAL) |
|---|---|---|---|
| WETTED SECTION P1 (TOILET SEAT PART FRONT SURFACE) | — | EXTREMELY SMALL | SMALL |
| WETTED SECTION P2 (TOILET SEAT PART BACK SURFACE/ RIM UPPER SURFACE) | — | SMALL | SMALL |
| WETTED SECTION P3 (RIM INNER WALL SURFACE) | MEDIUM | LARGE | LARGE |
| WETTED SECTION P4 (BOWL) | MEDIUM | LARGE | LARGE |

| | TOILET SEAT PART FRONT SURFACE | TOILET SEAT PART BACK SURFACE | RIM UPPER SURFACE | RIM INNER WALL SURFACE | BOWL |
|---|---|---|---|---|---|
| TIP REGION | EXTREMELY SMALL | LARGE | MEDIUM | LARGE | LARGE (DIRECT WETTING: MEDIUM) |
| SIDE REGION | EXTREMELY SMALL | SMALL | MEDIUM | LARGE | LARGE (DIRECT WETTING: MEDIUM) |

FIG. 21

TOILET SEAT DEVICE AND TOILET DEVICE

CROSS-REFERENCE TO RELATED APPLICATIONS

This application is based upon and claims the benefit of priority from Japanese Patent Application No. 2017-246684, filed on Dec. 22, 2017 and No. 2018-161693, filed on Aug. 30, 2018; the entire contents of which are incorporated herein by reference.

FIELD

Embodiments described herein relate generally to a toilet seat device and a toilet device.

BACKGROUND

In a toilet device according to Japanese Patent No. 5029930, hypochlorous acid water which has an oxidative decomposition effect and a bleaching effect is discharged onto the bowl of a flush toilet. Thereby, the occurrence of bacteria and/or dirt at the bowl can be suppressed.

A mist washing device that generates a mist of ozone water, electrolytic sterilizing water, or high-temperature water having a diameter of about 0.1 to 50 micrometers (μm) is provided in a toilet including the mist washing device according to JP 2007-138605 A (Kokai). In JP 2007-138605 A (Kokai), every nook and corner of a toilet, a toilet seat, a toilet lid, etc., can be washed by using an air stream to carry the mist generated by the mist washing device.

BRIEF DESCRIPTION OF THE DRAWINGS

FIG. 4A to FIG. 4E are plan views and perspective views illustrating the toilet device according to the embodiment;

FIG. 21 is a table illustrating the wetting amount of the mist in the after-mist mode;

DETAILED DESCRIPTION

Figure 1:
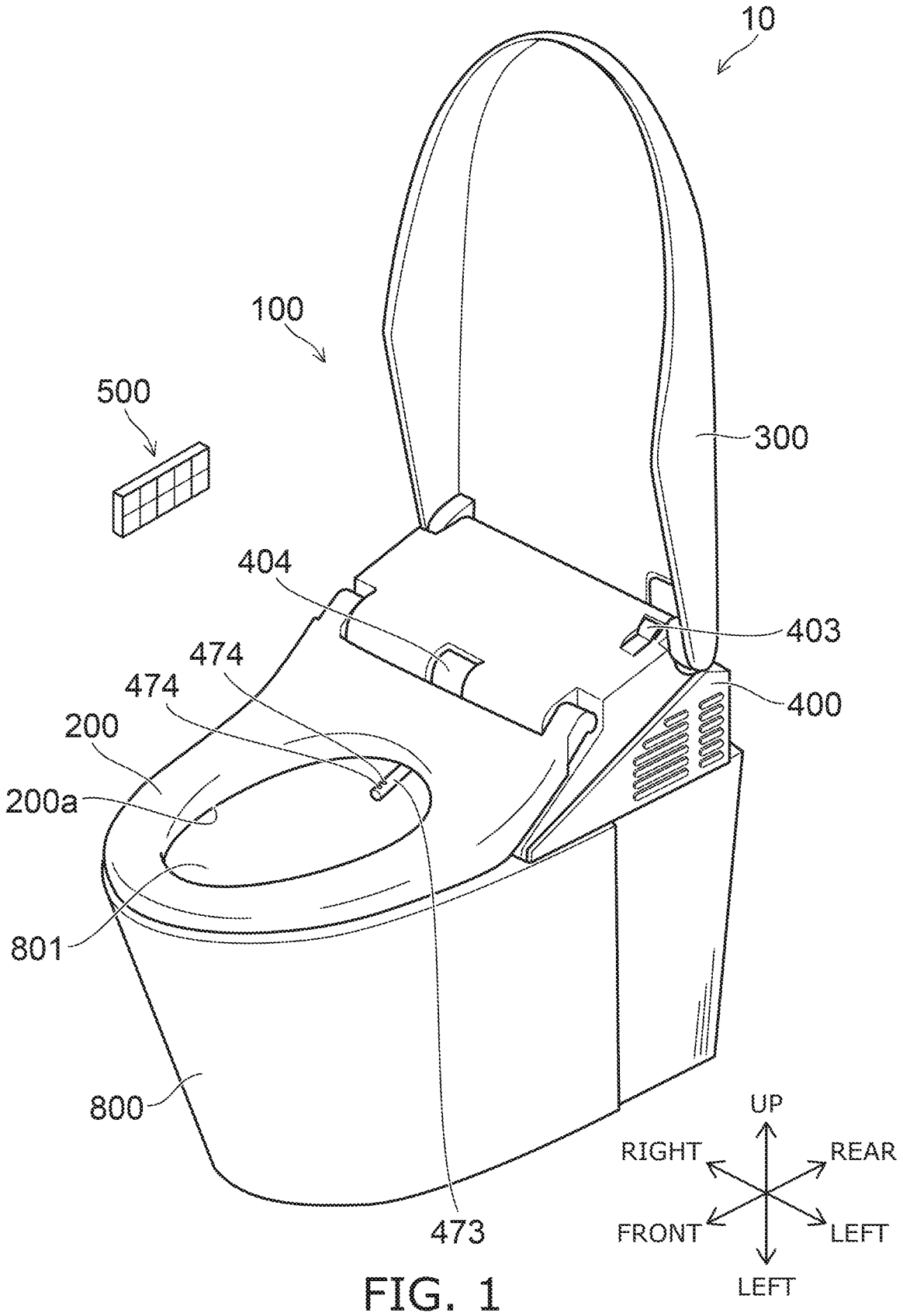
FIG. 1 is a perspective view illustrating a toilet device according to an embodiment.

According to a first aspect of the present invention, there is provided a toilet seat device mounted on a flush toilet, the toilet seat device including a toilet seat where a user is seated; a sterilizer generating sterilizing water; a sprayer disposed lower than the toilet seat in a state in which the toilet seat device is mounted on the flush toilet, the sprayer spraying a mist of the sterilizing water into the flush toilet; a blower generating a rising air stream by blowing air into the flush toilet; and a controller controlling the sterilizer, the sprayer, and the blower, the controller controlling the sprayer to execute a first process and a second process and cause a total amount of the mist of the sterilizing water sprayed in the first process to be less than a total amount of the mist of the sterilizing water sprayed in the second process, the first process and the second process being executed at different timing in a state in which the controller controls the sprayer to spray the mist of the sterilizing water into the flush toilet, the first process including controlling the blower to generate a first rising air stream capable of lifting the mist of the sterilizing water toward the toilet seat, the second process including the blower not generating the first rising air stream and not lifting the mist of the sterilizing water toward the toilet seat.

According to the toilet seat device, the mist of the sterilizing water sprayed lower than the toilet seat is lifted toward the toilet seat by the first rising air stream in the first process, and is not lifted toward the toilet seat by the first rising air stream in the second process. Thereby, a single sprayer can cause the mist of the sterilizing water to wet not only the bowl of the flush toilet but also the upper surface of the rim and/or the toilet seat. The bacteria and/or the dirt can be suppressed in a wide area including not only the bowl of the flush toilet but also the rim of the flush toilet, the toilet seat, etc.

The wetting amount of the sterilizing water at the bowl, the wetting amount of the sterilizing water at the upper surface of the rim, and the wetting amount of the sterilizing water at the toilet seat can be arbitrarily controlled by executing, at different timing, the first process including generating the first rising air stream capable of lifting the mist of the sterilizing water toward the toilet seat, and the second process including not generating the first rising air stream and not lifting the mist of the sterilizing water toward the toilet seat.

By causing the total amount of the mist of the sterilizing water sprayed in the first process to be less than the total amount of the mist of the sterilizing water sprayed in the second process, the amount of the sterilizing water wetting the toilet seat and the rim upper surface can be relatively small; and the amount of the sterilizing water wetting the bowl and the inner wall surface of the rim can be relatively large. The bowl and/or the inner wall surface of the rim are parts where excrement directly adheres easily and the dirt load is large. Also, because it is not very problematic for the bowl and/or the inner wall surface of the rim to become wet, these parts have a high tolerance for being wet. Therefore, the occurrence of bacteria and/or dirt can be suppressed by causing much of the mist of the sterilizing water to wet the bowl and the rim. On the other hand, compared to the bowl and/or the inner wall surface of the rim, the toilet seat and/or the upper surface of the rim are parts where excrement does not directly adhere easily and the dirt load is small. Therefore, the bacteria and/or the dirt can be suppressed by causing a relatively small amount of the sterilizing water to wet the toilet seat and/or the upper surface of the rim. In the case where the toilet seat and/or the upper surface of the rim become excessively wet, there is a possibility that the sterilizing water may contact the skin of the user or drip outside the flush toilet; therefore, the toilet seat and/or the upper surface of the rim are parts having a low tolerance for being wet. Conversely, the toilet seat and/or the upper surface of the rim can be dried in a short length of time by reducing the wetting amount of the sterilizing water at the toilet seat and/or the upper surface of the rim. Thereby, the sterilizing water can be prevented from contacting the skin of the user and dripping outside the flush toilet.

Thus, according to the toilet seat device, the sterilizing water that contacts the skin of the user and the sterilizing water that drips outside the flush toilet can be prevented while suppressing the bacteria and/or the dirt in a wide area including not only the bowl of the flush toilet but also the rim of the flush toilet, the toilet seat, etc.

In a second aspect of the present invention according to the first aspect, the controller stops the blower in the second process.

According to the toilet seat device, by stopping the blower, the mist of the sterilizing water can be prevented more reliably from being lifted toward the toilet seat in the second process.

In a third aspect of the present invention according to the first aspect, the controller controls the blower to generate a second rising air stream; and a flow velocity of the second rising air stream is lower than a flow velocity of the first rising air stream in the second process.

According to the toilet seat device, in the second process, the mist of the sterilizing water can be diffused downward or in the horizontal direction without being lifted toward the toilet seat by setting the second rising air stream to have a flow velocity lower than the flow velocity of the first rising air stream. Thereby, the sterilizing water can be caused to wet a wider area inside the flush toilet.

In a fourth aspect of the present invention according to any one of the first to third aspects, the sprayer sprays the mist of the sterilizing water in a radial configuration when viewed in the top view in the second process.

According to the toilet seat device, in the second process, the mist of the sterilizing water can be caused to wet a wide area inside the flush toilet including the bowl, the inner wall surface of the rim, etc., even though the mist of the sterilizing water does not float on the rising air stream.

In a fifth aspect of the present invention according to any one of the first to fourth aspects, the controller sets a time of the execution of the first process to be shorter than a time of the execution of the second process.

According to the toilet seat device, the amount of the sterilizing water wetting the toilet seat and the upper surface of the rim can be reduced more reliably by setting the time of the execution of the first process to be short. On the other hand, by setting the time of the execution of the second process to be long, the amount of the sterilizing water wetting the bowl and the inner wall surface of the rim can be increased.

In a sixth aspect of the present invention according to any one of the first to fifth aspects, the controller controls the sprayer to cause a particle size of the mist of the sterilizing water sprayed in the execution of the second process to be larger than a particle size of the mist of the sterilizing water sprayed in the execution of the first process.

According to the toilet seat device, the total amount of the sterilizing water sprayed in the first process can be reduced by causing the particle size of the mist of the sterilizing water sprayed in the execution of the first process to be small. Thereby, the amount of the sterilizing water wetting the toilet seat and/or the upper surface of the rim can be reduced more reliably. On the other hand, by causing the particle size of the mist of the sterilizing water sprayed in the execution of the second process to be large, the total amount of the sterilizing water sprayed in the second process can be increased. Thereby, the amount of the sterilizing water wetting the bowl and the inner wall surface of the rim can be increased.

In a seventh aspect of the present invention according to any one of the first to sixth aspects, the controller performs the execution of the second process after the execution of the first process.

According to the toilet seat device, the second process is executed after the first process which causes the mist of the sterilizing water to wet the toilet seat and/or the upper surface of the rim. Because the toilet seat and/or the upper surface of the rim can be dried when executing the second process, the time from the end of one time of performing the mist mode to the toilet seat and/or the upper surface of the rim being dried can be shortened.

According to an eighth aspect of the present invention, there is provided a toilet device including a flush toilet, a toilet seat, a sterilizer, a sprayer, a blower, and a controller; the flush toilet includes a bowl receiving excrement, and a rim; an upper edge part is formed of the rim; the toilet seat is mounted on the flush toilet and is where a user is seated; the sterilizer generates sterilizing water; the sprayer is disposed lower than the toilet seat in a state in which the toilet seat is mounted on the flush toilet; the sprayer sprays a mist of the sterilizing water into the flush toilet; the blower generates a rising air stream by blowing air into the flush toilet; the controller controls the sterilizer, the sprayer, and the blower; the controller controls the sprayer to execute a first process and a second process and cause a total amount of the mist of the sterilizing water sprayed in the first process to be less than a total amount of the mist of the sterilizing water sprayed in the second process; the first process and the second process are executed at different timing in a state in which the controller controls the sprayer to spray the mist of the sterilizing water into the flush toilet; the first process includes controlling the blower to generate a first rising air stream capable of lifting the mist of the sterilizing water toward the toilet seat; and the second process includes the blower not generating the first rising air stream and not lifting the mist of the sterilizing water toward the toilet seat.

According to the toilet device, the mist of the sterilizing water sprayed lower than the toilet seat is lifted toward the toilet seat by the first rising air stream in the first process and not lifted toward the toilet seat by the first rising air stream in the second process. Thereby, the single sprayer can cause the mist of the sterilizing water to wet not only the bowl of the flush toilet but also the upper surface of the rim and/or the toilet seat. The bacteria and/or the dirt can be suppressed in a wide area including not only the bowl of the flush toilet but also the rim of the flush toilet, the toilet seat, etc.

The wetting amount of the sterilizing water at the bowl, the wetting amount of the sterilizing water at the upper surface of the rim, and the wetting amount of the sterilizing water at the toilet seat can be arbitrarily controlled by executing, at different timing, the first process including generating the first rising air stream capable of lifting the mist of the sterilizing water toward the toilet seat, and the second process including not generating the first rising air stream and not lifting the mist of the sterilizing water toward the toilet seat.

By causing the total amount of the mist of the sterilizing water sprayed in the first process to be less than the total amount of the mist of the sterilizing water sprayed in the second process, the amount of the sterilizing water wetting the toilet seat and the rim upper surface can be relatively small; and the amount of the sterilizing water wetting the bowl and the inner wall surface of the rim can be relatively large. The bowl and/or the inner wall surface of the rim are parts where excrement directly adheres easily and the dirt load is large. Also, because it is not very problematic for the bowl and/or the inner wall surface of the rim to become wet, these parts have a high tolerance for being wet. Therefore, the occurrence of bacteria and/or dirt can be suppressed by causing much of the mist of the sterilizing water to wet the bowl and the rim. On the other hand, compared to the bowl and/or the inner wall surface of the rim, the toilet seat and/or the upper surface of the rim are parts where excrement does not directly adhere easily and the dirt load is small. Therefore, the bacteria and/or the dirt can be suppressed by causing a relatively small amount of the sterilizing water to wet the toilet seat and/or the upper surface of the rim. Also, in the case where the toilet seat and/or the upper surface of the rim become excessively wet, there is a possibility that the sterilizing water may contact the skin of the user or drip outside the flush toilet; therefore, the toilet seat and/or the upper surface of the rim are parts having a low tolerance for being wet. Conversely, the toilet seat and/or the upper surface of the rim can be dried in a short length of time by reducing the wetting amount of the sterilizing water at the toilet seat and/or the upper surface of the rim. Thereby, the sterilizing water can be prevented from contacting the skin of the user and dripping outside the flush toilet.

Thus, according to the toilet device, the sterilizing water that contacts the skin of the user and the sterilizing water that drips outside the flush toilet can be prevented while suppressing the bacteria and/or the dirt in a wide area including not only the bowl of the flush toilet but also the rim of the flush toilet, the toilet seat, etc.

In a ninth aspect of the present invention according to the eighth aspect, the controller stops the blower in the second process.

According to the toilet device, the mist of the sterilizing water can be prevented more reliably from being lifted toward the toilet seat in the second process by stopping the blower.

In a tenth aspect of the present invention according to the eighth aspect, the controller controls the blower to generate a second rising air stream; and a flow velocity of the second rising air stream is lower than a flow velocity of the first rising air stream in the second process.

According to the toilet device, in the second process, the mist of the sterilizing water can be diffused downward or in the horizontal direction without being lifted toward the toilet seat by the second rising air stream having a flow velocity lower than the flow velocity of the first rising air stream. Thereby, the sterilizing water can be caused to wet a wider area inside the flush toilet.

In an eleventh aspect of the present invention according to any one of the eighth to tenth aspects, the sprayer sprays the mist of the sterilizing water in a radial configuration when viewed in the top view in the second process.

According to the toilet device, in the second process, the mist of the sterilizing water can be caused to wet a wide area inside the flush toilet including the bowl, the inner wall surface of the rim, etc., even though the mist of the sterilizing water does not float on the rising air stream.

In a twelfth aspect of the present invention according to any one of the eighth to eleventh aspects, the controller sets a time of the execution of the first process to be shorter than a time of the execution of the second process.

According to the toilet device, the amount of the sterilizing water wetting the toilet seat and the upper surface of the rim can be reduced more reliably by setting the time of the execution of the first process to be short. On the other hand, by setting the time of the execution of the second process to be long, the amount of the sterilizing water wetting the bowl and the inner wall surface of the rim can be increased.

In a thirteenth aspect of the present invention according to any one of the eighth to twelfth aspects, the controller controls the sprayer to cause a particle size of the mist of the sterilizing water sprayed in the execution of the second process to be larger than a particle size of the mist of the sterilizing water sprayed in the execution of the first process.

According to the toilet device, the total amount of the sterilizing water sprayed in the first process can be reduced by reducing the particle size of the mist of the sterilizing water sprayed in the execution of the first process. Thereby, the amount of the sterilizing water wetting the toilet seat and/or the upper surface of the rim can be reduced more reliably. On the other hand, the total amount of the sterilizing water sprayed in the second process can be increased by increasing the particle size of the mist of the sterilizing water sprayed in the execution of the second process. Thereby, the amount of the sterilizing water wetting the bowl and the inner wall surface of the rim can be increased.

In a fourteenth aspect of the present invention according to any one of the eighth to thirteenth aspects, the controller performs the execution of the second process after the execution of the first process.

According to the toilet device, the second process is executed after the first process which causes the mist of the sterilizing water to wet the toilet seat and/or the upper surface of the rim. Because the toilet seat and/or the upper surface of the rim can be dried when executing the second process, the time from the end of one time of performing the mist mode to the toilet seat and/or the upper surface of the rim being dried can be shortened.

Embodiments of the invention will now be described with reference to the drawings. Similar components in the drawings are marked with the same reference numerals; and a detailed description is omitted as appropriate.

FIG. 1 is a perspective view illustrating a toilet device according to an embodiment.

Figure 2:
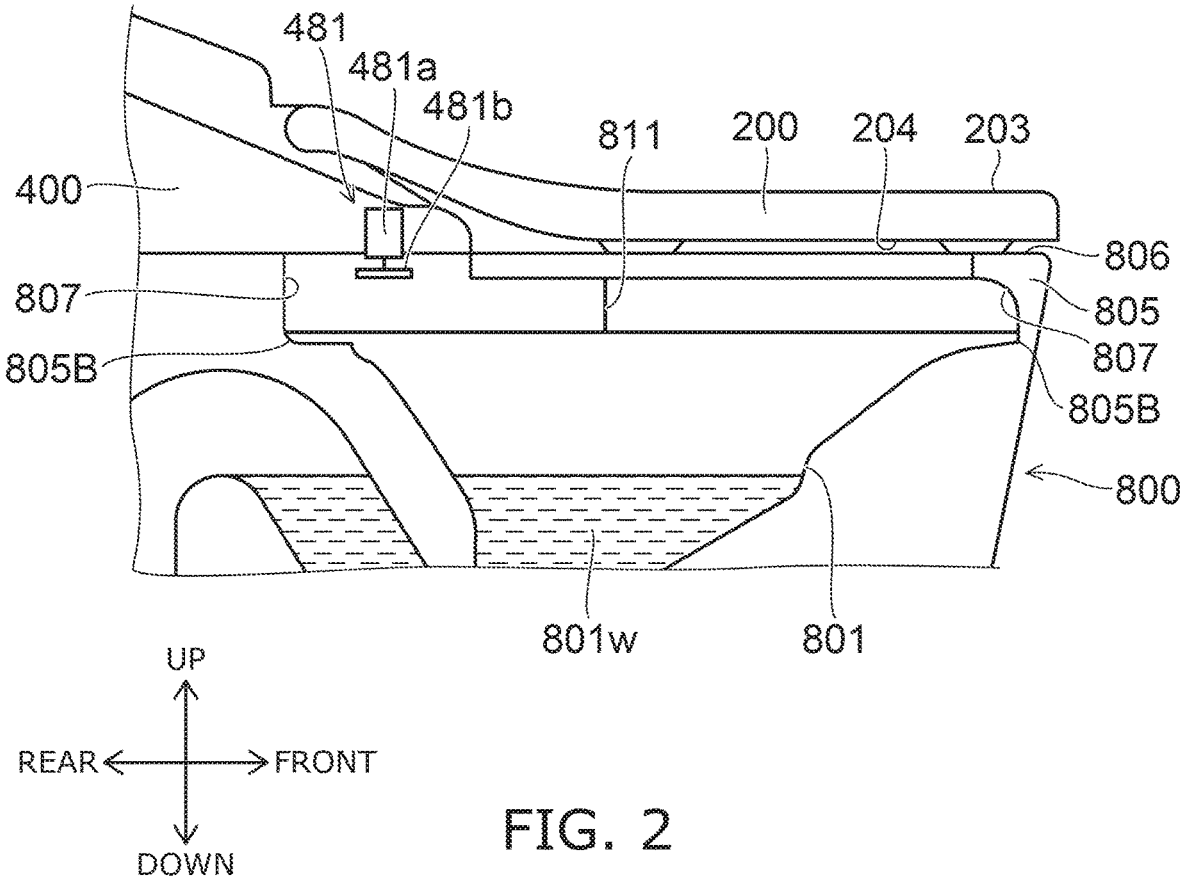
FIG. 2 is a cross-sectional view illustrating a part of the toilet device according to the embodiment.

FIG. 2 is a cross-sectional view illustrating a part of the toilet device according to the embodiment.

The toilet device 10 illustrated in FIG. 1 includes a western-style sit-down toilet (called simply the "flush toilet" for convenience of description hereinbelow) 800 and a toilet seat device 100. The flush toilet 800 includes a concave bowl 801 receiving excrement. The toilet seat device 100 is mounted on the flush toilet 800.

The toilet seat device 100 includes a casing 400, a toilet seat 200 where a user is seated, and a toilet lid 300. The toilet seat 200 and the toilet lid 300 each are pivotally supported openably and closeably with respect to the casing 400. The state of FIG. 1 is a state in which the toilet seat 200 is closed (the lowered state) and is a state in which the toilet lid 300 is open (the raised state). In the closed state, the toilet lid 300 covers the seat surface of the toilet seat 200 from above.

A body wash function part that realizes washing of a human private part (a "bottom" or the like) of the user sitting on the toilet seat 200, etc., are built into the interior of the casing 400. Also, for example, a seat contact detection sensor 404 that detects the user sitting on the toilet seat 200 is provided in the casing 400. In the case where the seat contact detection sensor 404 detects the user sitting on the toilet seat 200, a washing nozzle (called simply the "nozzle" for convenience of description hereinbelow) 473 can be caused to advance into the bowl 801 of the flush toilet 800 when the user operates a manual operation part 500 such as, for example, a remote control, etc. A state in which the nozzle 473 is advanced into the bowl 801 is illustrated in the toilet seat device 100 illustrated in FIG. 1.

One or multiple water discharge ports 474 are provided in the tip part of the nozzle 473. The nozzle 473 can wash the "bottom" or the like of the user sitting on the toilet seat 200 by squirting water from the water discharge ports 474 provided in the tip part of the nozzle 473.

In this specification, "up," "down," "front," "rear," "left," and "right" each are directions when viewed by the user sitting on the toilet seat 200 with the user's back facing the open toilet lid 300.

As shown in FIG. 2, the flush toilet 800 includes a rim 805 provided on the bowl 801. The rim 805 is a ring-like part of which the upper edge part of the flush toilet 800 is formed. Accumulated water 801*w* accumulates inside the bowl 801. A toilet flush (an operation of discharging the excrement inside the bowl 801 and washing the surface of the bowl 801) is executed when, for example, the user performs the operation of the toilet flush by using a switch provided in the remote control, etc., or when the user stands up from the toilet seat 200. In the toilet flush, the flushing water is supplied to the interior of the bowl 801. For example, in the example of FIG. 2, the flushing water is dispensed along the upper edge of the flush toilet 800 from a bowl water supply port 811.

The rim 805 has an upper surface 806 and an inner wall surface 807. The upper surface 806 is a surface that opposes a back surface 204 of the closed toilet seat 200. The inner wall surface 807 is the part of the interior wall of the flush toilet 800 (the wall surface facing the center of the bowl 801) higher than the part where the flushing water of the toilet flush flows. In other words, in this specification, the inner wall surface 807 of the rim 805 refers to a part that is not washed by the toilet flush. In the example of FIG. 2, the inner wall surface 807 has a vertical surface positioned higher than a bend 805B which is bent in a shelf configuration.

The bowl 801 and/or the inner wall surface 807 of the rim 805 are parts where the dirt load is large because excrement directly adheres easily. Also, because it is not very problematic for the bowl 801 and/or the inner wall surface 807 of the rim 805 to become wet, these parts have a high tolerance for being wet.

Compared to the bowl 801 and/or the inner wall surface 807 of the rim 805, excrement does not directly adhere easily to the toilet seat 200 and/or the upper surface 806 of the rim 805. For example, the urine and/or the liquid waste that strikes and splatters from the bowl 801 and/or the accumulated water 801*w* adheres to the toilet seat 200 and the upper surface 806 of the rim 805. Accordingly, the toilet seat 200 and the upper surface 806 of the rim 805 are parts where the dirt load is relatively small. Also, in the case where the toilet seat 200 and/or the upper surface 806 of the rim 805 become excessively wet, there is a possibility that the sterilizing water may contact the skin of the user or drip outside the flush toilet; therefore, the toilet seat 200 and/or the upper surface 806 of the rim 805 are parts having a low tolerance for being wet.

Figure 3:
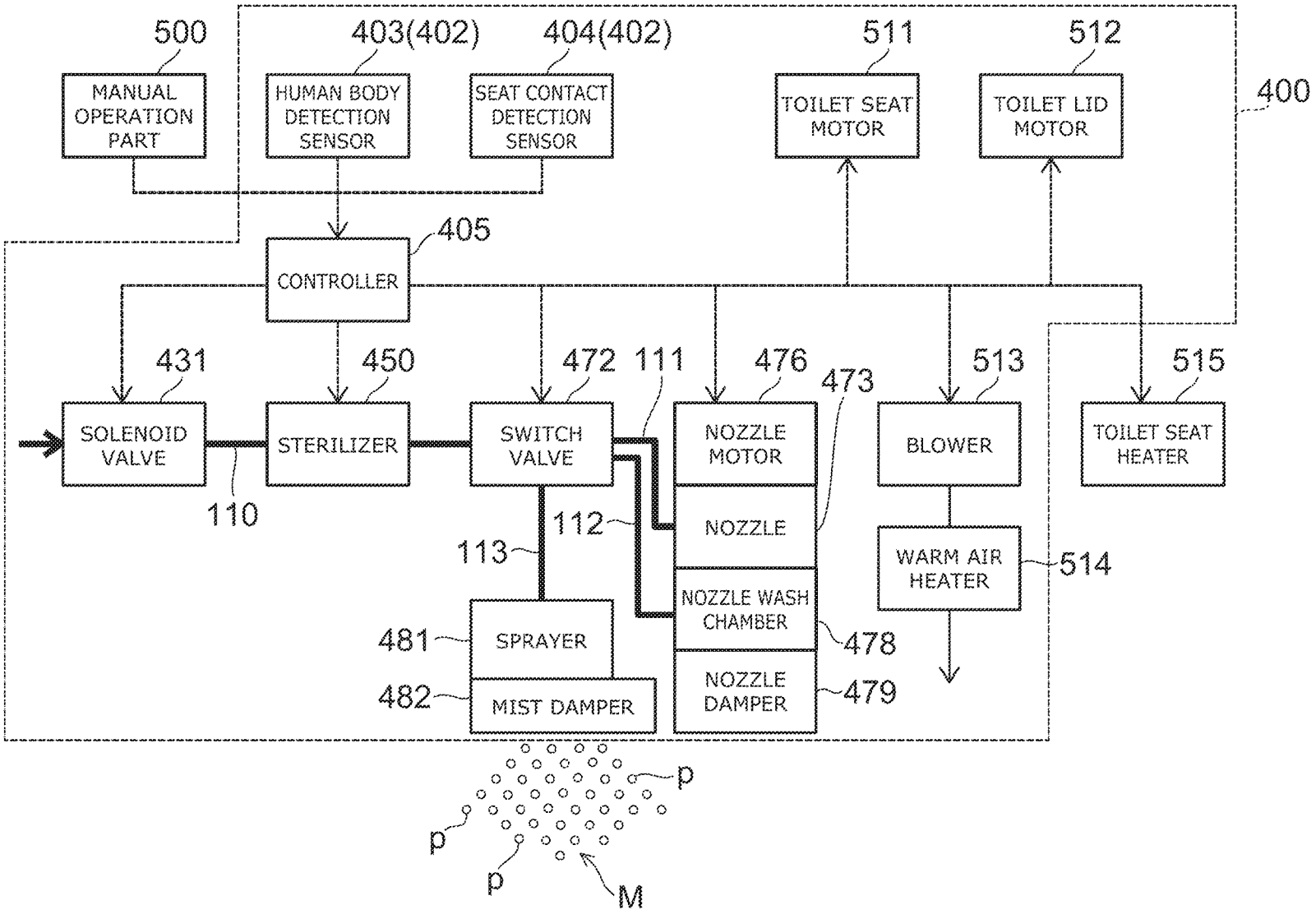
FIG. 3 is a block diagram illustrating relevant components of the toilet seat device according to the embodiment.

FIG. 3 is a block diagram illustrating relevant components of the toilet seat device according to the embodiment.

FIG. 3 illustrates the relevant components of both the water channel system and the electrical system.

Figure 24:
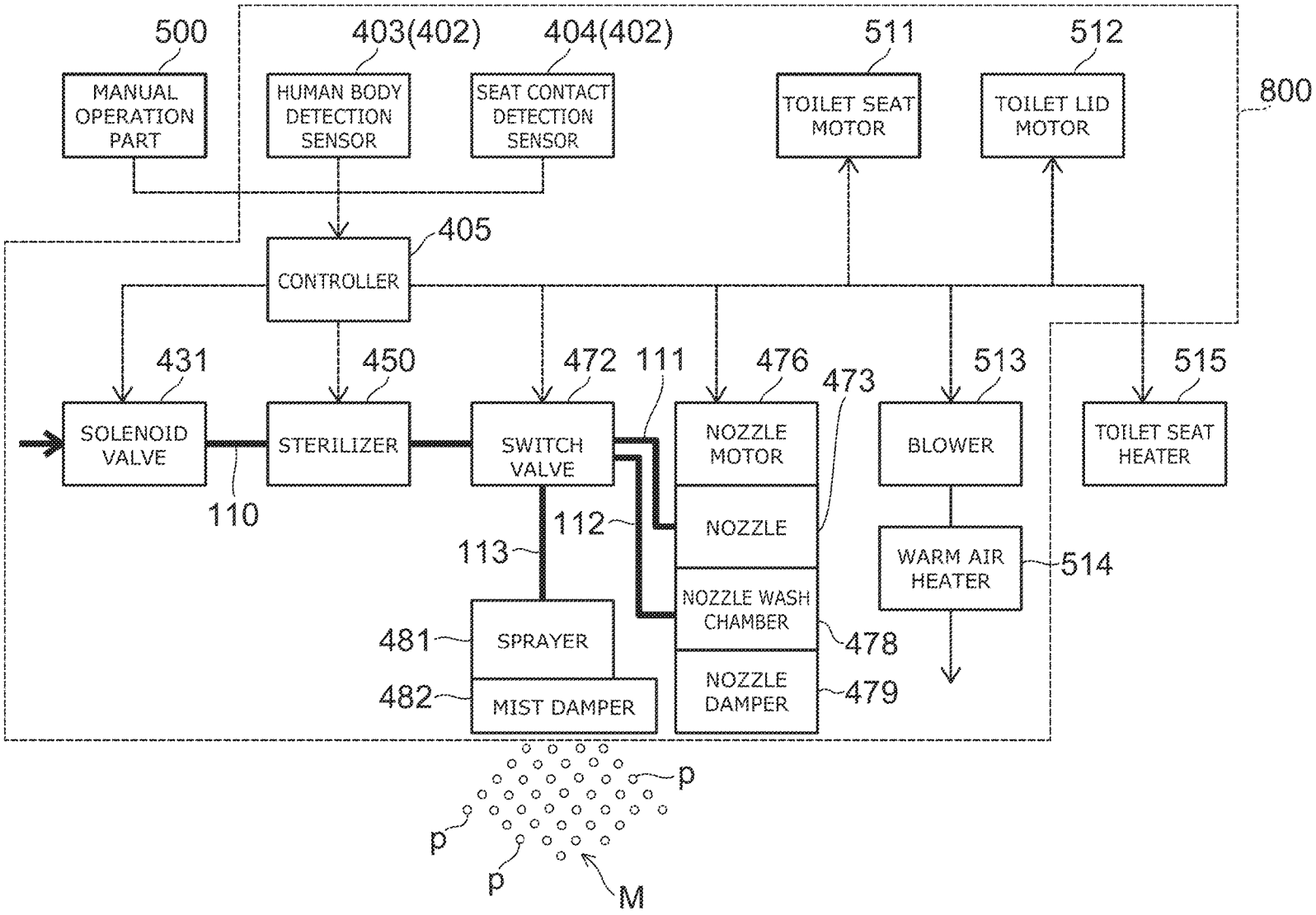
FIG. 24 is a block diagram illustrating relevant components of the toilet device according to the modification of the embodiment.

The toilet seat device 100 includes a solenoid valve 431, a sterilizer 450, a switch valve 472, a sprayer 481, a nozzle motor 476, the nozzle 473, a nozzle wash chamber 478, flow channels 110 to 113, etc. These components are disposed inside the casing 400. As shown in FIG. 24, these components may be included in the interior of the flush toilet 800.

The flow channel 110 is a flow channel for guiding water supplied from a not-illustrated water supply source such as a service water line, a water storage tank, etc., to the sprayer 481, the nozzle 473, etc. The solenoid valve 431 is provided on the upstream side of the flow channel 110. The solenoid valve 431 is an openable and closable solenoid valve and controls the supply of the water based on a command from a controller 405 provided in the interior of the casing 400.

The sterilizer 450 that generates sterilizing water is provided downstream of the solenoid valve 431 on the flow channel 110. For example, the sterilizer 450 generates sterilizing water including hypochlorous acid, etc. For example, an electrolytic cell unit is an example of the sterilizer 450. The electrolytic cell unit electrolyzes service water flowing through a space (a flow channel) between an anode plate (not illustrated) and a cathode plate (not illustrated) by controlling the flow of current from the controller 405. The sterilizing water is not limited to sterilizing water including hypochlorous acid. For example, the sterilizing water may be a solution including metal ions such as silver ions, copper ions, etc., a solution including electrolytic chlorine, ozone, etc., acidic water, alkaline water, etc. The sterilizer 450 is not limited to an electrolytic cell and may have any configuration that can generate sterilizing water.

The switch valve 472 is provided downstream of the sterilizer 450 on the flow channel 110. The nozzle 473, the nozzle wash chamber 478, and the sprayer 481 are provided downstream of the switch valve 472. Due to the switch valve 472, the flow channel 110 branches into the flow channel 111 guiding the water to the nozzle 473, the flow channel 112 guiding the water to the nozzle wash chamber 478, and the flow channel 113 guiding the water to the sprayer 481. The switch valve 472 controls the opening and closing of each of the flow channel 111, the flow channel 112, and the flow channel 113 based on a command from the controller 405. That is, the switch valve 472 controls the supply of the water to the nozzle 473, the nozzle wash chamber 478, and the sprayer 481. Also, the switch valve 472 switches the flow rate of the water supplied downstream of the switch valve 472.

The nozzle 473 receives a drive force from the nozzle motor 476 and advances into and retracts from the bowl 801 of the flush toilet 800. That is, the nozzle motor 476 causes the nozzle 473 to advance and retract based on a command from the controller 405. The nozzle 473 is stored inside the casing 400 when not in use. The nozzle 473 dispenses water from the water discharge ports 474 and washes the human private part in a state of being advanced frontward from the casing 400.

The nozzle wash chamber 478 washes the outer perimeter surface (the central body) of the nozzle 473 by squirting sterilizing water or service water from water discharge ports provided in the interior of the nozzle wash chamber 478.

The sprayer 481 changes the service water or the sterilizing water generated by the sterilizer 450 into a mist-like form. The sprayer 481 sprays a mist M (a mist of the sterilizing water or a mist of the service water) onto the bowl 801, the rim 805, and the toilet seat 200. In other words, the sprayer 481 causes the mist of the sterilizing water or the mist of the service water to wet the bowl 801, the rim 805, and the toilet seat 200. In this specification, "wetting" refers to the water (the sterilizing water or the service water) adhering to the surface of an object. In particular, the case of "directly wetting" means that the water (fine particles p of the sterilizing water or the service water) floating in air reaches the surface of the object.

A toilet seat motor 511 (a rotating device), a toilet lid motor 512 (a rotating device), a blower 513, and a warm air heater 514 also are provided in the interior of the casing 400.

The toilet seat motor 511 opens and closes the toilet seat 200 by causing the toilet seat 200 to rotate by electric power based on a command from the controller 405. The toilet lid motor 512 opens and closes the toilet lid 300 by causing the toilet lid 300 to rotate by electric power based on a command from the controller 405.

The blower 513 is, for example, a fan provided in the interior of the casing 400. The blower 513 operates based on a command from the controller 405. For example, vanes rotate due to the rotation of a motor of the blower 513. Thereby, the blower 513 can blow air toward the interior of the flush toilet 800 (e.g., the interior of the bowl 801). Also, the blower 513 may blow air toward a private part of the user sitting on the toilet seat 200. The warm air heater 514 warms the air blown outside the casing 400 by the blower 513. Thereby, the warm air can be blown toward the private part of the user; and the private part can be dried.

For example, a toilet seat heater 515 (a dryer) is provided in the interior of the toilet seat 200. The toilet seat heater 515 includes, for example, a metal member having a ring configuration provided along the periphery of an opening 200*a* formed at the center of the toilet seat 200. The toilet seat heater 515 warms the toilet seat 200 by providing a current to the toilet seat heater 515 based on a command from the controller 405. For example, a tubing heater, a sheathed heater, a halogen heater, a carbon heater, etc., may be used as the toilet seat heater 515. The metal member includes, for example, aluminum, copper, etc. Various configurations such as a sheet configuration, a wire configuration, a mesh configuration, etc., can be employed as the configuration of the metal member.

The controller 405 includes a circuit that supplies electrical power from a not-illustrated power supply circuit. For example, the controller 405 includes an integrated circuit such as a microcomputer, etc. The controller 405 controls the solenoid valve 431, the sterilizer 450, the switch valve 472, the nozzle motor 476, the blower 513, the warm air heater 514, the toilet seat heater 515, the toilet seat motor 511, and the toilet lid motor 512 based on detection information of a detecting sensor 402 (e.g., a human body detection sensor 403 or the seat contact detection sensor 404) detecting the user or based on operation information of the manual operation part 500.

The manual operation part 500 is, for example, an operation part for the user to spray the sterilizing water at any timing. For example, the manual operation part 500 is a remote control including a switch, a button, etc.; and when the user operates the manual operation part 500, operation information (a signal) that instructs the spraying of the sterilizing water is transmitted to the controller 405. Based on the operation information, the controller 405 controls the sterilizer 450 and/or the sprayer 481. Thereby, the user can perform the spraying of the sterilizing water by operating the manual operation part 500.

The manual operation part 500 also may include a switch, a button, etc., not only for spraying the sterilizing water but also for the user to operate the functions of the toilet seat device 100. When operations that correspond to the functions are performed, the operation information is transmitted to the controller 405; and the controller 405 controls the operation of each part of the toilet seat device 100 based on the operation information.

The seat contact detection sensor 404 can detect whether or not the user is seated on the toilet seat 200. The seat contact detection sensor 404 detects the user being seated and rising from the seat. The seat contact detection sensor 404 may include a microwave sensor, a distance sensor (an infrared-transmitting sensor), an ultrasonic sensor, a tactile switch, a capacitance switch (a touch sensor), or a strain sensor. In the example, a distance sensor that is provided in the casing 400 is included in the seat contact detection sensor 404.

In the case where a contact sensor such as a tactile switch, an electrostatic sensor, a strain sensor, or the like is used, such a contact sensor is provided in the toilet seat 200. When the user sits on the toilet seat 200, the tactile switch is pressed by the body weight of the user. Or, the user contacts the electrostatic sensor. Or, pressure is applied to the strain sensor by the body weight of the user. The user being seated can be detected by an electrical signal from such a sensor.

The human body detection sensor 403 can detect the user in front of the flush toilet 800, that is, the user existing at a position separated frontward from the toilet seat 200. That is, the human body detection sensor 403 can detect the user entering the toilet room and approaching the toilet seat 200. For example, a pyroelectric sensor, a microwave sensor, an ultrasonic sensor, or a distance sensor (an infrared-transmitting sensor) can be used as such a human body detection sensor. In the example, the human body detection sensor 403 includes a pyroelectric sensor provided in the casing. Also, the human body detection sensor 403 may detect the user directly after opening the door of the toilet room and entering the toilet room, or the user directly before entering the toilet room, that is, the user existing in front of the door about to enter the toilet room. For example, in the case where a microwave sensor is used, it is possible to detect the existence of the user through the door of the toilet room.

The controller 405 receives the detection information of the human body detection sensor 403 (the signal indicating the existence or absence of the user) and/or the detection information of the seat contact detection sensor 404 (the signal indicating the existence or absence of the seated user) and controls the operation of each part of the toilet seat device 100 based on the received detection information.

The controller 405 can execute the three types of mist modes of an after-mist mode, a pre-mist mode, and a manual mist mode.

For example, the after-mist mode is an operation mode of automatically spraying the mist of the sterilizing water based on the detection information of the detecting sensor 402 after the user uses the toilet device 10. The pre-mist mode is, for example, an operation mode of automatically spraying the mist of the sterilizing water or the service water based on the detection information of the detecting sensor 402 before the user uses the toilet device 10. The manual mist mode is an operation mode of spraying the mist of the sterilizing water based on the operation information of the manual operation part 500.

FIG. 4A to FIG. 4E are plan views and perspective views illustrating the toilet device according to the embodiment.

FIG. 4A shows a state in which a part of the toilet device 10 is viewed from the front.

As shown in FIG. 4A, the sprayer 481, a nozzle damper 479, and a blower damper 516 are positioned at the rear upper part of the bowl 801 in a state in which the toilet seat device 100 is mounted on the flush toilet 800.

FIG. 4B illustrates a part of FIG. 4A as being enlarged. In FIG. 4B, a part of the casing 400 positioned frontward of the sprayer 481 is not illustrated for easier viewing.

The nozzle damper 479 is pivotally supported to be rotatable with respect to the casing 400. The nozzle 473 is positioned rearward of the nozzle damper 479 in a state of being retracted into the interior of the casing 400. When washing the human private part, etc., the nozzle 473 contacts the nozzle damper 479, opens the nozzle damper 479 by causing the nozzle damper 479 to rotate, and advances from the interior of the casing 400.

FIG. 4C to FIG. 4E are perspective views illustrating the periphery of the sprayer 481, the nozzle damper 479, and the blower damper 516 as being enlarged.

The blower damper 516 is pivotally supported to be rotatable with respect to the casing 400. The blower 513 is disposed rearward of the blower damper 516. The blower damper 516 covers an opening 516*a* of the casing 400. The air that is blown from the blower 513 passes through the opening 516*a* and is blown into the flush toilet 800.

FIG. 4C is a state in which the operation of the blower 513 is stopped; and FIG. 4D and FIG. 4E show states in which the blower 513 operates and blows air into the bowl 801.

As shown in FIG. 4C, the blower damper 516 is closed in the state in which the air blow is stopped.

When the blower 513 is operated as shown in FIG. 4D, the blower damper 516 is rotated and opened by the pressure (the wind pressure) of the air blown from the blower 513. Thereby, for example, the blower 513 blows air from the rear upper part inside the bowl 801 toward the front lower part inside the bowl 801 as in arrow A1.

Compared to the state of FIG. 4D, the airflow rate that is blown by the blower 513 is high (or the air velocity is high) in the state of FIG. 4E. In such a case, compared to the state of FIG. 4D, the blower damper 516 is further rotated and opened. Thereby, for example, the blower 513 blows air from the rear upper part inside the bowl 801 toward the front upper part inside the bowl 801 as in arrow A2.

Thus, the direction of the air blown from the blower 513 is changed by the blower damper 516. In other words, the blower 513 can control the blowing direction by using the airflow rate (the air velocity). By the mist being sprayed from the sprayer 481 and floating on the air stream generated by the air from the blower 513, the area that is wetted by the mist and the wetting amount of the mist in each area (the amount of the sterilizing water or the service water wetting in each area) may be controlled.

Figure 5A:
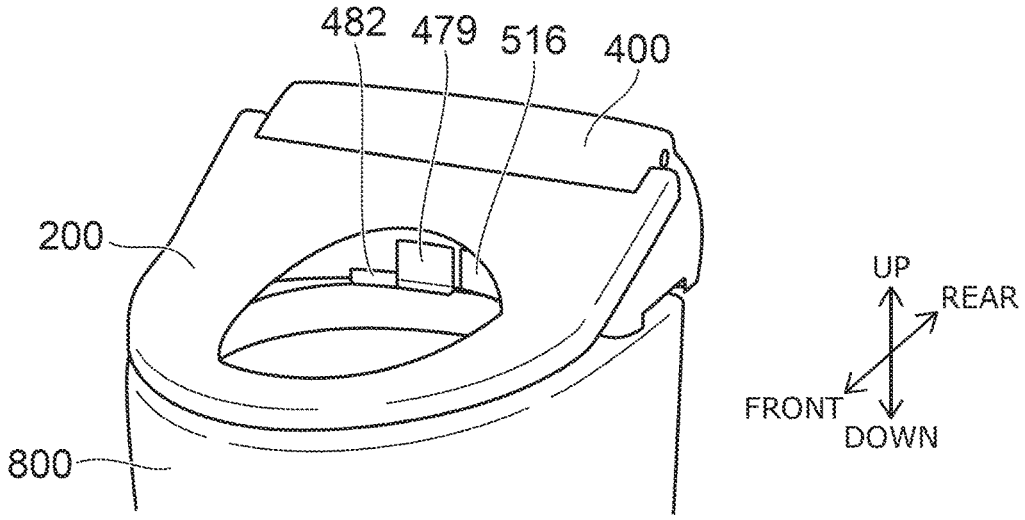
FIG. 5A to FIG. 5C are perspective views illustrating another toilet device according to the embodiment.
Figure 5B:
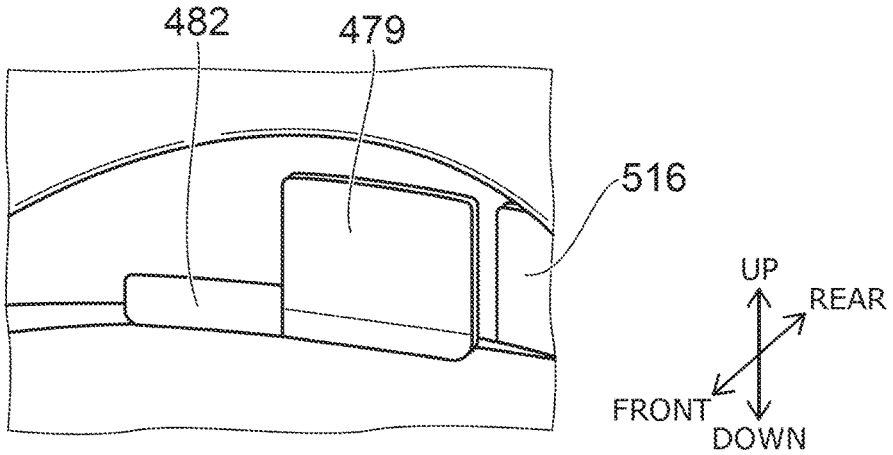
Figure 5C:
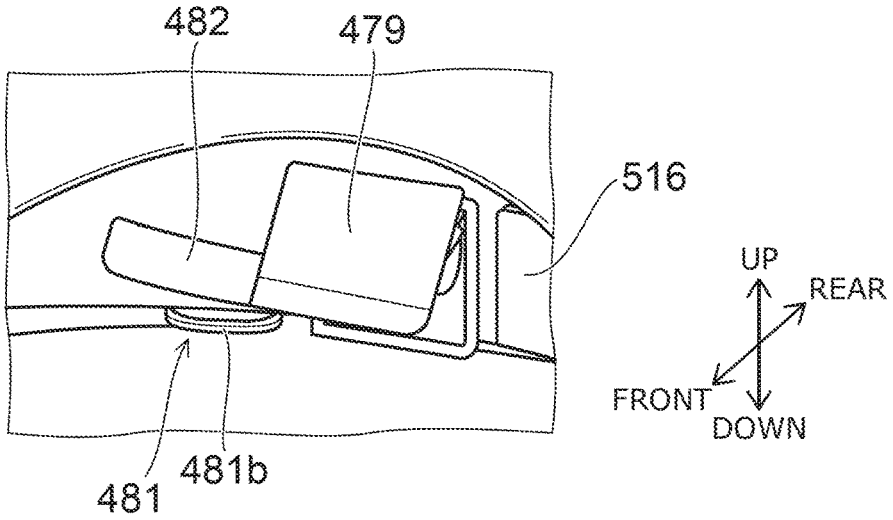

FIG. 5A to FIG. 5C are perspective views illustrating another toilet device according to the embodiment. In the example, a mist damper 482 is provided frontward of the sprayer 481. The mist damper 482 covers at least a part of the front of the sprayer 481 in the closed state. For example, in the closed state, the mist damper 482 covers the front of a disk 481*b* described below with reference to FIGS. 6A to 6C.

For example, the mist damper 482 is fixed to the nozzle damper 479 and operates with the nozzle damper 479. When the nozzle damper 479 is opened, the mist damper 482 also is opened; and when the nozzle damper 479 is closed, the mist damper 482 also is closed.

FIG. 5B and FIG. 5C illustrate the periphery of the nozzle damper 479 and the mist damper 482 as being enlarged. FIG. 5B is a state in which the nozzle 473 is retracted into the interior of the casing 400. At this time, the nozzle damper 479 is in the closed state and covers the front of the nozzle 473. Also, the mist damper 482 is in the closed state and covers the front of at least a part of the sprayer 481.

When the sprayer 481 is unused, the sprayer 481 is concealed from the bowl 801 side by the mist damper 482 as in FIG. 5B. Thereby, the adhesion of urine and/or dirt on the sprayer 481 can be prevented.

FIG. 5C is a state in which the nozzle 473 advances frontward and causes the nozzle damper 479 to rotate. The frontward advancement distance of the nozzle 473 at this time may be shorter than the frontward advancement distance when washing the human private part. For example, the tip of the nozzle 473 contacts the nozzle damper 479. Also, in FIG. 5C, the mist damper 482 is rotated and opened with the nozzle damper 479. A part (the disk 481*b*) of the sprayer 481 is exposed on the bowl 801 side. Thereby, the sprayer 481 can spray the mist toward the bowl 801. For example, as described below with reference to FIGS. 23A and 23B, the sprayer 481 may be disposed inside the casing 400 without providing the mist damper 482.

Figure 6A:
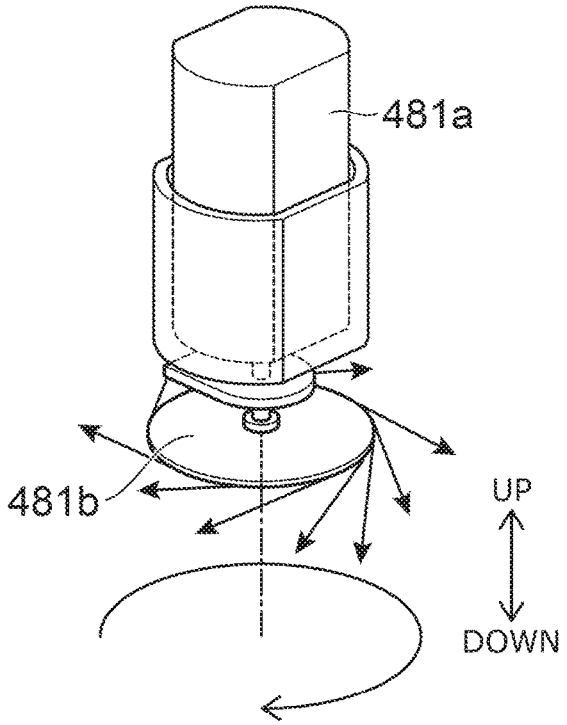
FIG. 6A to FIG. 6C are schematic views illustrating the sprayer according to the embodiment.
Figure 6B:
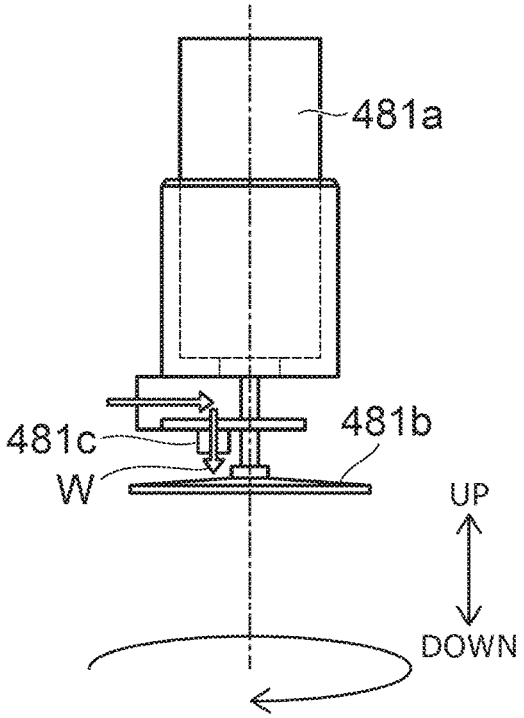
Figure 6C:
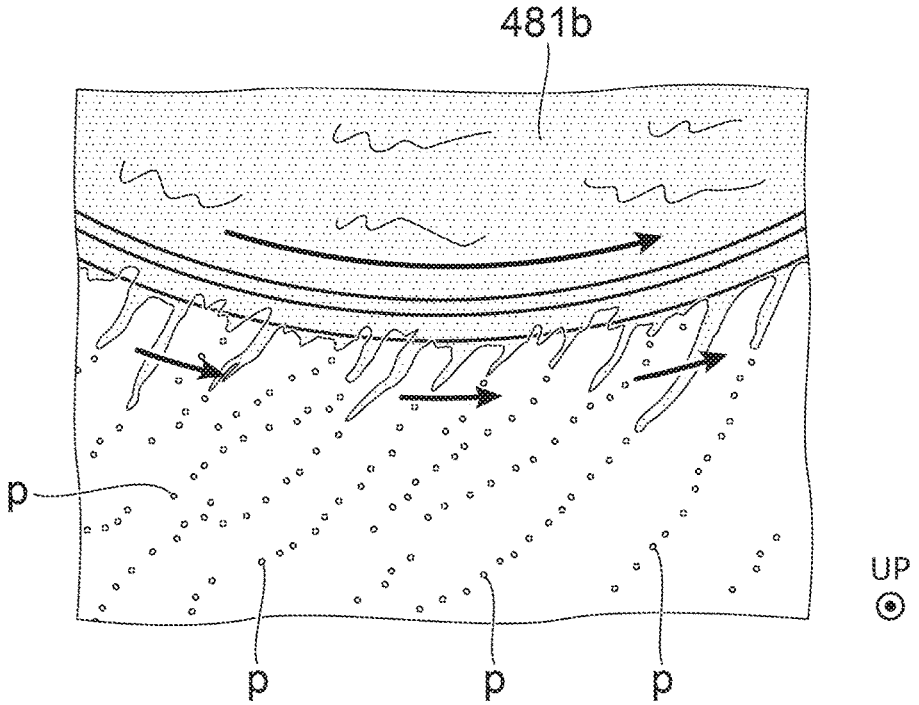

FIG. 6A to FIG. 6C are schematic views illustrating the sprayer according to the embodiment.

FIG. 6A is a perspective view of the sprayer 481; and FIG. 6B is a side view of the sprayer 481.

The sprayer 481 includes a motor 481*a*, and the disk 481*b* connected below the motor 481*a*. The rotation of the motor 481*a* is controlled by the controller 405. When the motor 481*a* rotates, the drive force of the rotation is transferred to the disk 481*b*; and the disk 481*b* rotates.

As shown in FIG. 6B, water W (the service water or the sterilizing water generated by the sterilizer 450) is supplied to the upper surface of the disk 481*b*. By supplying the water W while the disk 481*b* rotates, the sprayer 481 sprays the water W in a mist-like form. Although the disk 481*b* has a flat disk configuration in the example, an unevenness may be provided as appropriate; or a circular conic configuration or a sphere may be used.

FIG. 6C is an enlarged view of a part of the disk 481*b* when viewed from above. The water W that is dropped on the upper surface of the rotating disk 481*b* is spread in a film configuration on the disk 481*b* by a centrifugal force and is radiated from the disk 481*b*. At this time, the water W breaks up from the edge vicinity of the disk 481*b* while still being in a film configuration, breaks up after becoming string-like, and subsequently becomes the fine particles p (the mist). The particle size (the diameter of the fine particle p) of the mist can be controlled by the rotational speed of the disk 481*b*, i.e., the rotational speed of the motor 481*a*. The particle size of the mist decreases as the rotational speed increases. For example, the desired particle size is obtained by appropriately using a low-speed rotation having a rotational speed of about 1000 (rotations per minute (rpm)), a medium-speed rotation having a rotational speed of about 10000 rpm, or a high-speed rotation having a rotational speed of about 20000 rpm. Also, the particle size of the mist can be controlled by adjusting the flow rate of the water W supplied from a water supply port 481*c* to the sprayer 481.

In this specification, the particle size is the particle size of the fine particle p existing in air before wetting the toilet device 10; and the Sauter mean diameter (total volume/total surface area) is used. The method for measuring the "particle size" of this specification is described below with reference to FIGS. 22A and 22B. The mist refers to a range of particle sizes that is not less than 10 micrometers (μm) and not more than 300 μm. In the case where the particle size of the mist is less than 10 μm, an undesirably long length of time is necessary for the wetted sections of the bowl 801, the rim 805, the toilet seat 200, etc., to become wet. Also, in the case where sterilizing water including hypochlorous acid is used, if the particle size of the mist is less than 10 μm, the concentration of the hypochlorous acid inside the mist attenuates easily; and the sterilizing performance degrades easily. On the other hand, in the case where the particle size of the mist is greater than 300 μm, the mist does not diffuse easily; and it is difficult to spray the mist in a wide area. In the following description, the mist that has the large particle size is a mist having a range of particle sizes that is not less than 100 μm and not more than 300 μm, and favorably not less than 150 μm and not more than 300 μm; the mist that has the medium particle size is a mist having a range of particle sizes that is not less than 50 μm and not more than 200 μm, and favorably not less than 60 μm and not more than 150 μm; and the mist that has the small particle size is a mist having a range of particle sizes that is not less than 10 μm and not more than 100 μm, and favorably not less than 10 μm and not more than 60 μm.

Figure 7A:
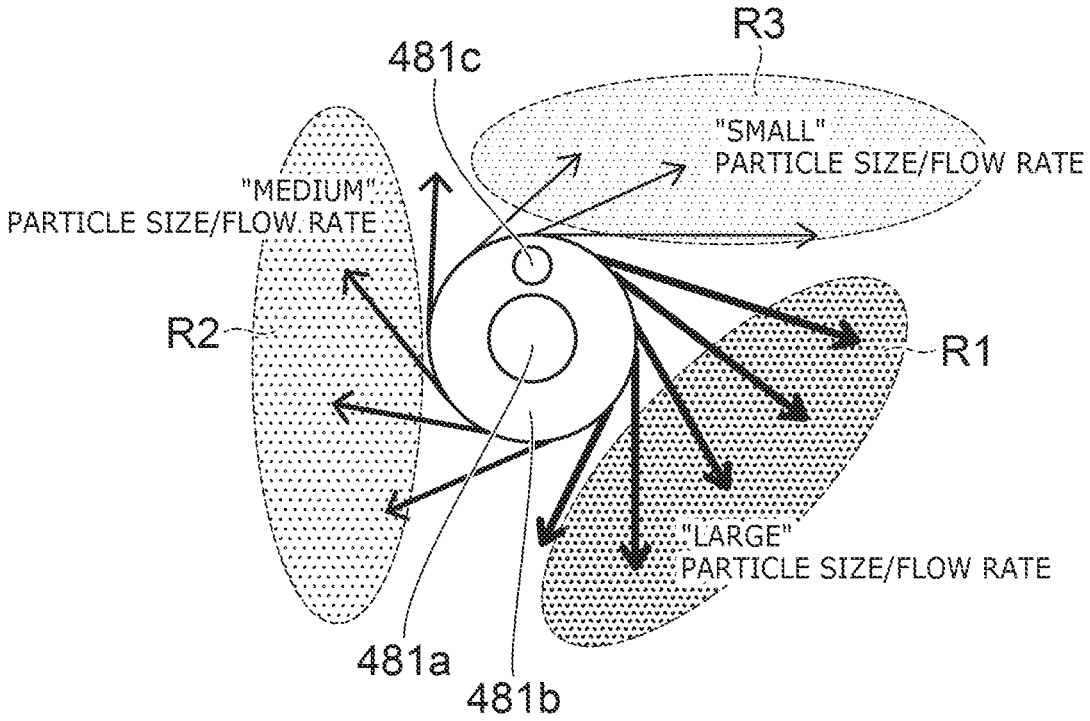
FIG. 7A and FIG. 7B are plan views illustrating the disk of the sprayer according to the embodiment.
Figure 7B:
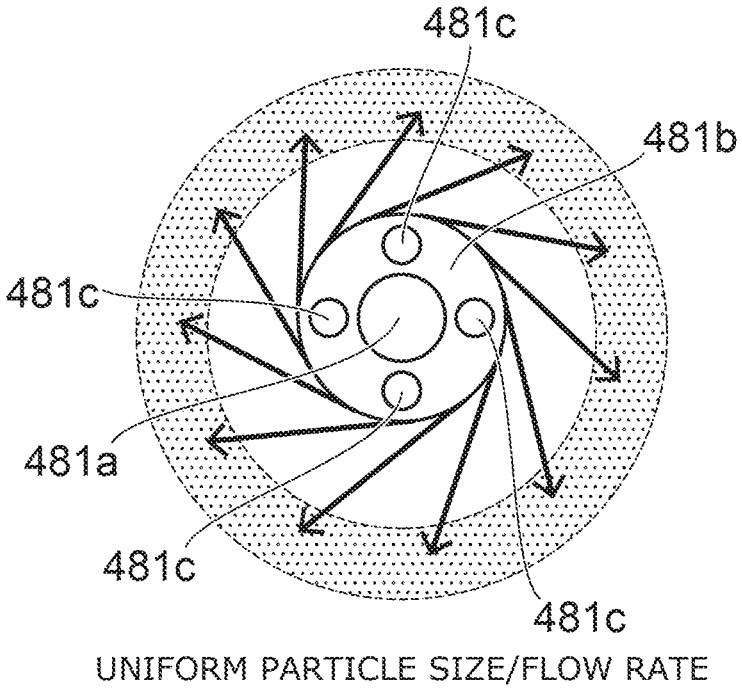

FIG. 7A and FIG. 7B are plan views illustrating the disk of the sprayer according to the embodiment.

FIG. 7A and FIG. 7B show a state in which the rotating disk 481*b* is viewed from above. In the example of FIG. 7A, the number of the water supply ports 481*c* supplying the water W onto the disk 481*b* is one. In such a case, in the region proximal to the water supply port 481*c*, a water film of the supplied water W on the disk 481*b* is radiated from the disk 481*b* before the water W becomes thin on the disk 481*b*. Therefore, as shown in FIG. 7A, a bias of the particle size of the mist occurs at the periphery of the sprayer 481. In other words, a region R1 where the particle size of the mist is relatively large, a region R2 where the particle size of the mist is about medium, and a region R3 where the particle size of the mist is relatively small occur. Also, a bias of the flow rate (the amount of the mist sprayed per unit time) occurs according to the particle size of the mist. In other words, the flow rate is large in the region R1; the flow rate is about medium in the region R2; and the flow rate is small in the region R3.

Therefore, for example, it is possible to adjust the particle size, the flow rate, the direction, etc., of the mist sprayed from the sprayer 481 into the flush toilet 800 by using the position of the water supply port 481*c* and/or the rotation direction (clockwise or counterclockwise) of the disk 481*b*. Thereby, for the mist that is sprayed from the sprayer 481, the area that is wetted by the mist and the wetting amount of the mist in each area may be controlled. Also, a cover or the like that controls the direction in which the mist is sprayed may be appropriately provided at the periphery of the disk 481*b*.

The number of the water supply ports 481*c* is not limited to one; and multiple water supply ports 481*c* may be provided. For example, four water supply ports 481*c* are provided in FIG. 7B. The water supply ports 481*c* are disposed every 90° when viewed from the center of the disk 481*b*. Thus, by disposing the multiple water supply ports 481*c* at substantially uniform spacing along the disk outer perimeter, the bias of the particle size of the mist and/or the flow rate at the periphery of the sprayer 481 can be suppressed; and uniform spraying can be performed.

In the state in which the toilet seat device 100 is mounted on the flush toilet 800, the sprayer 481 is disposed lower than the toilet seat 200 (referring to FIG. 2) and sprays the mist into the flush toilet 800. Here, the state in which the sprayer 481 is disposed lower than the toilet seat 200 refers to at least a part (in the example, the disk 481*b*) of the sprayer 481 being lower than the toilet seat 200. Thereby, the mist of the service water or the sterilizing water is sprayed into the flush toilet 800 from a position lower than the toilet seat 200.

In the embodiment, the sprayer is not limited to the devices described in reference to FIG. 6A to FIG. 7B. For example, an ultrasonic atomizing device may be used as the sprayer. The ultrasonic atomizing device changes a liquid into a mist-like form by irradiating an ultrasonic wave on the liquid. For example, a two-fluid nozzle also may be used as the sprayer. The two-fluid nozzle changes a liquid into a mist-like form by squirting both a gas and the liquid. However, in the case where the devices described in reference to FIG. 6A to FIG. 7B are used, an advantage is provided in that the spraying area is controlled easily by the blower 513. Also, the risk of clogging is low; and a supplemental device such as a compressor or the like is unnecessary.

An example of operations of the toilet seat device 100 in the after-mist mode and the manual mist mode will now be described with reference to FIG. 8A to FIG. 11C.

Figure 8A:
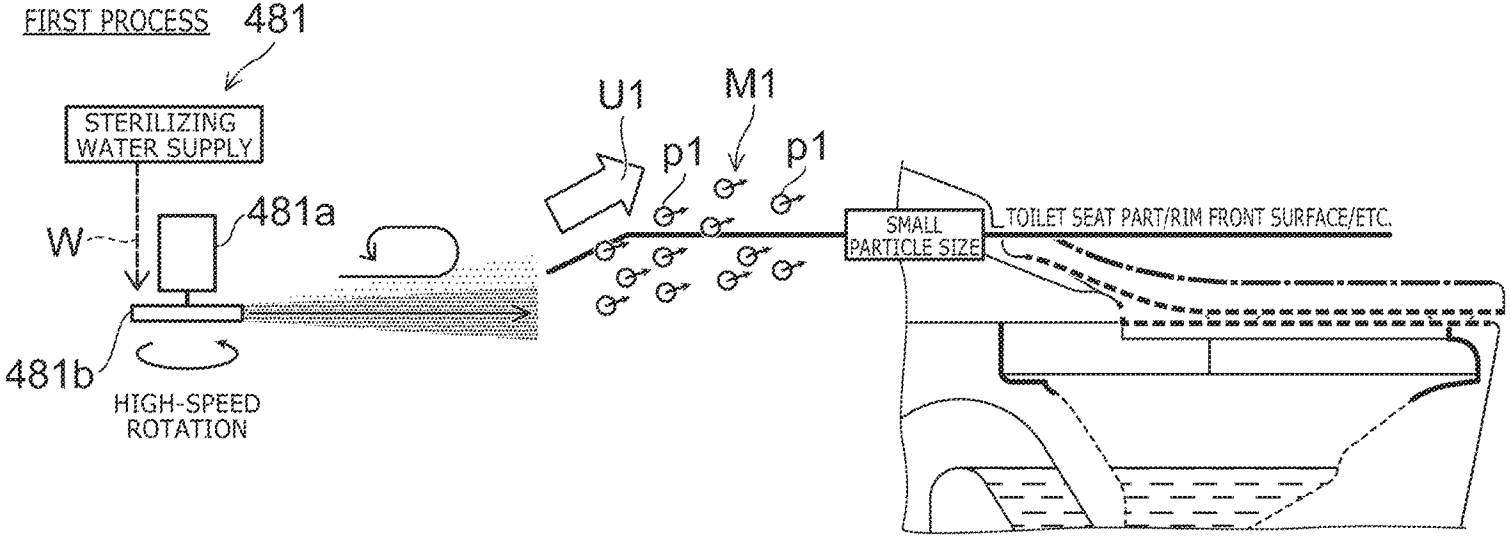
FIG. 8A and FIG. 8B are schematic views illustrating the operations in the after-mist mode and the manual mist mode of the toilet seat device according to the embodiment.
Figure 8B:
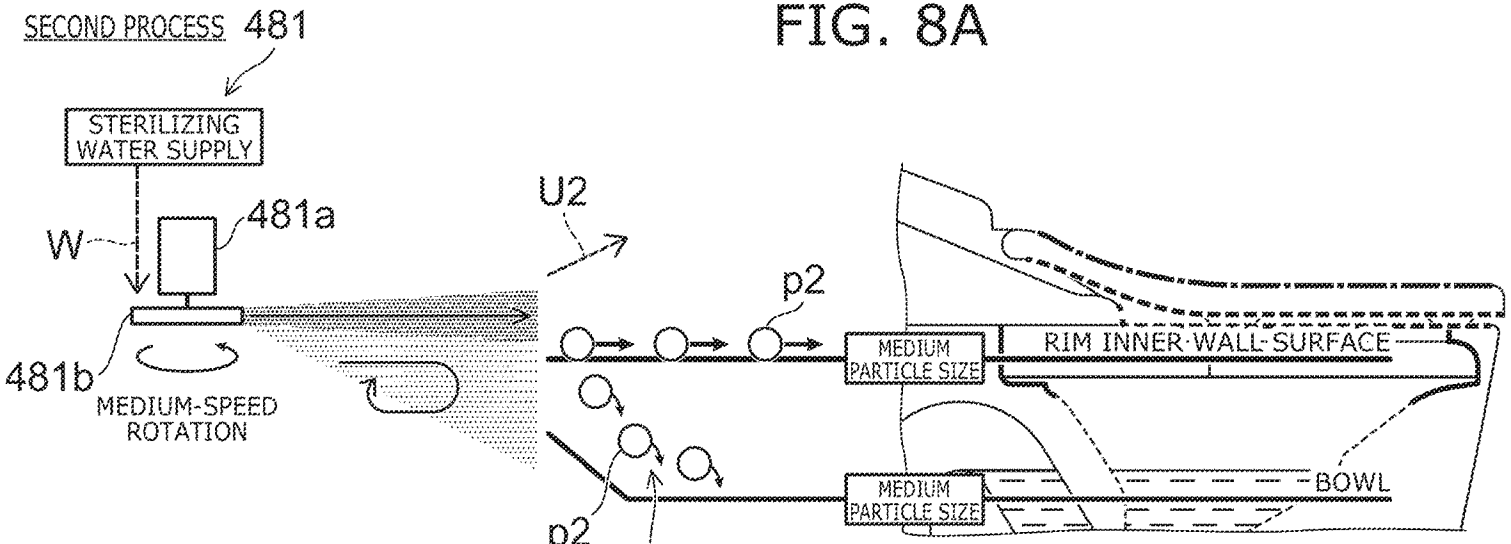

FIG. 8A and FIG. 8B are schematic views illustrating the operations in the after-mist mode and the manual mist mode of the toilet seat device according to the embodiment.

The controller 405 executes a first process and a second process for one time of performing the mist mode (one time of performing the after-mist mode or one time of performing the manual mist mode). FIG. 8A illustrates the first process; and FIG. 8B illustrates the second process.

As shown in FIG. 8A, the first process controls the blower 513 to generate a first rising air stream U1 in a state in which the sprayer 481 is controlled to spray the mist of the sterilizing water into the flush toilet 800. The first rising air stream U1 is an air stream capable of lifting the mist of the sterilizing water toward the toilet seat 200.

As shown in FIG. 8B, the second process does not cause the blower 513 to generate the first rising air stream U1 and does not lift the mist of the sterilizing water toward the toilet seat 200 in the state in which the sprayer 481 is controlled to spray the mist of the sterilizing water into the flush toilet 800.

By such a configuration, the mist of the sterilizing water sprayed lower than the toilet seat 200 is lifted toward the toilet seat 200 by the first rising air stream U1 in the first process and wets the toilet seat 200 and/or the upper surface 806 of the rim 805. On the other hand, the mist of the sterilizing water sprayed lower than the toilet seat 200 is not lifted toward the toilet seat by the first rising air stream U1 in the second process and wets the bowl 801 and/or the inner wall surface 807 of the rim 805. Thereby, the single sprayer 481 can cause the mist of the sterilizing water to wet not only the bowl 801 of the flush toilet 800 but also the upper surface 806 of the rim 805 and/or the toilet seat 200. Accordingly, the bacteria and/or the dirt can be suppressed in a wide area including not only the bowl 801 of the flush toilet 800 but also the rim 805 of the flush toilet 800, the toilet seat 200, etc. Also, the toilet seat device 100 can be downsized by using the single sprayer 481.

The scope of the "mist of the sterilizing water not being lifted toward the toilet seat" in the second process includes not only the case where none of the mist is lifted but also the case where a slight amount of the mist is lifted. For example, the amount of the mist lifted toward the toilet seat in the second process is less than the amount of the mist lifted toward the toilet seat in the first process. However, in the second process, it is favorable for the amount of the sterilizing water wetting the toilet seat 200, the upper surface 806 of the rim, and the toilet lid 300 to be as small as possible; for example, it is favorable to be zero.

The timing of the controller 405 executing the first process is different from the timing of the controller 405 executing the second process. The wetting amount of the sterilizing water at the bowl 801, the wetting amount of the sterilizing water at the upper surface of the rim 805, and the wetting amount of the sterilizing water at the toilet seat 200 can be arbitrarily controlled by executing, at different timing, the first process including generating the first rising air stream U1 capable of lifting the mist of the sterilizing water toward the toilet seat 200, and the second process including not generating the first rising air stream U1 and not lifting the mist of the sterilizing water toward the toilet seat 200.

The controller 405 controls the sprayer 481 to cause the total amount (g) of the mist of the sterilizing water sprayed in the first process to be less than the total amount (g) of the mist of the sterilizing water sprayed in the second process. Thereby, the amount of the sterilizing water wetting the toilet seat 200 and the upper surface 806 of the rim 805 is relatively small; and the amount of the sterilizing water wetting the bowl 801 and the inner wall surface 807 of the rim 805 is relatively large. The occurrence of bacteria and/or dirt can be suppressed by causing much of the mist of the sterilizing water to wet the bowl 801 and the inner wall surface 807 where the dirt load is large and the tolerance for being wet is high. The toilet seat 200 and the upper surface 806 of the rim 805 can be dried in a short length of time while suppressing the bacteria and/or the dirt by reducing the wetting amount of the sterilizing water at the toilet seat 200 and the upper surface 806 of the rim 805 where the dirt load is small and the tolerance for being wet is low. Thereby, the sterilizing water can be prevented from contacting the skin of the user and dripping outside the flush toilet.

The total amount of the mist is the total amount of the mist sprayed by the sprayer 481 for one time of performing the mist mode (one time of performing the after-mist mode or one time of performing the manual mist mode). For one time of performing the mist mode, the sprayer 481 may spray the mist continuously or may spray the mist discontinuously. Also, for example, the total amount of the mist in the first process and the total amount of the mist in the second process can be controlled by adjusting the rotational speed of the disk 481*b*, the flow rate of the sterilizing water supplied to the sprayer 481, etc.

For example, the controller 405 controls the sprayer 481 to cause the particle size of the mist of the sterilizing water sprayed in the execution of the second process to be larger than the particle size of the mist of the sterilizing water sprayed in the execution of the first process. For example, when executing the first process as shown in FIG. 8A, the sprayer 481 generates a first mist M1 having a small particle size. The particle size (the diameter of a fine particle p1 of the sterilizing water) of the first mist M1 is a particle size liftable toward the toilet seat 200 by the first rising air stream U1. For example, when executing the second process as shown in FIG. 8B, the sprayer 481 generates a second mist M2 having a medium particle size. The particle size (the diameter of a fine particle p2 of the sterilizing water) of the second mist M2 is larger than the particle size of the first mist M1.

The total amount of the sterilizing water sprayed in the first process can be reduced by reducing the particle size of the mist of the sterilizing water sprayed in the execution of the first process. Thereby, the amount of the sterilizing water wetting the toilet seat 200 and/or the upper surface 806 of the rim 805 can be reduced more reliably. On the other hand, the total amount of the sterilizing water sprayed in the second process can be increased by increasing the particle size of the mist of the sterilizing water sprayed in the execution of the second process. Thereby, the amount of the sterilizing water wetting the bowl 801 and the inner wall surface 807 of the rim 805 can be increased.

For example, in the second process, the controller 405 stops the blower 513 and does not perform the air blow. Thereby, the mist of the sterilizing water can be prevented more reliably from being lifted toward the toilet seat 200 in the second process.

Also, in the second process, the controller 405 may control the blower 513 to generate a second rising air stream U2. The flow velocity of the second rising air stream U2 is lower than the flow velocity of the first rising air stream U1; and in the second process, the mist is not lifted toward the toilet seat 200 by the second rising air stream U2. The mist can be diffused downward or in the horizontal direction without being lifted toward the toilet seat 200 by the second rising air stream U2. Thereby, the sterilizing water can be caused to wet a wider area inside the flush toilet 800.

The sprayer 481 sprays the mist of the sterilizing water in a radial configuration when viewed in the top view. The radial configuration is a state in which the area where the mist exists widens away from the sprayer 481. For example, when viewed in the top view, the mist is sprayed toward all directions away from the center of the disk 481*b*.

Because the mist (the first mist M1) has the radial configuration in the first process, the mist floats on the entire first rising air stream U1 and can be caused to wet a wide area including the toilet seat 200, the upper surface 806 of the rim 805, etc. Also, because the mist (the second mist M2) has the radial configuration in the second process, even though the mist does not float on the air stream, the mist can be caused to wet a wide area inside the flush toilet 800 including the bowl 801, the inner wall surface 807 of the rim 805, etc.

The spreading of the mist (the first mist M1 and the second mist M2), etc., can be adjusted by the rotational speed, the arrangement, and the configuration of the disk 481*b*, the positions of the water supply ports 481*c* supplying the water to the disk 481*b*, etc.

Figure 9A:
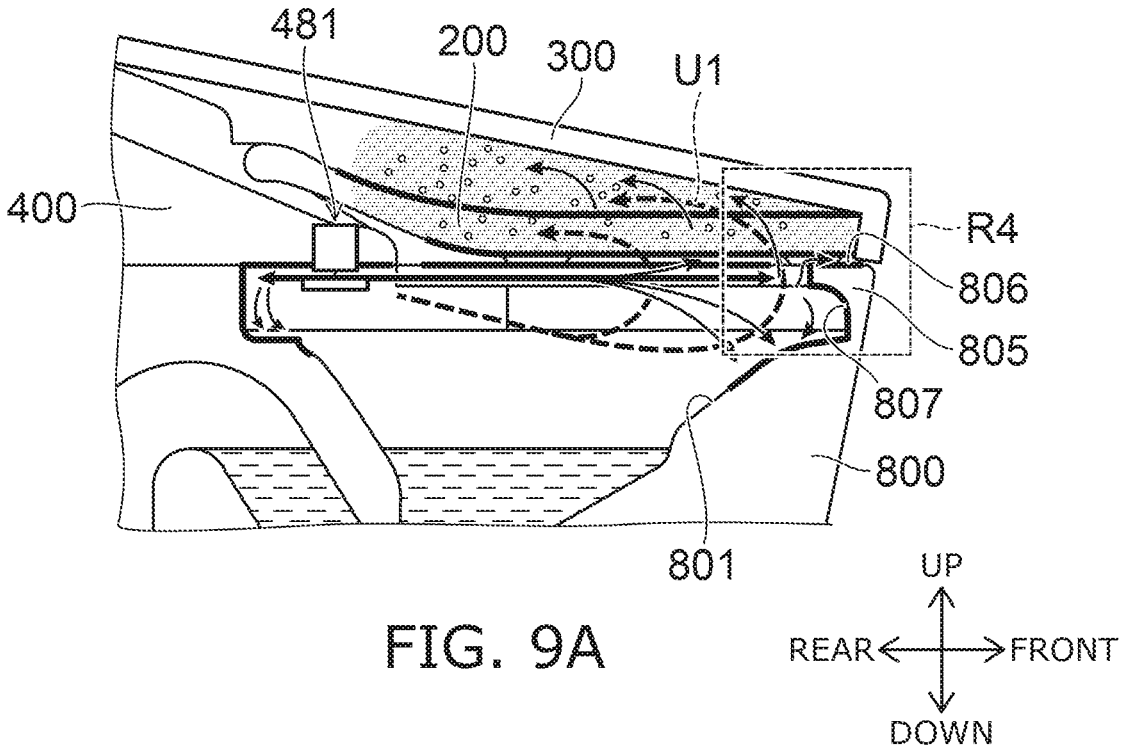
FIG. 9A and FIG. 9B are cross-sectional views illustrating operations in the first process of the toilet seat device according to the embodiment.
Figure 9B:
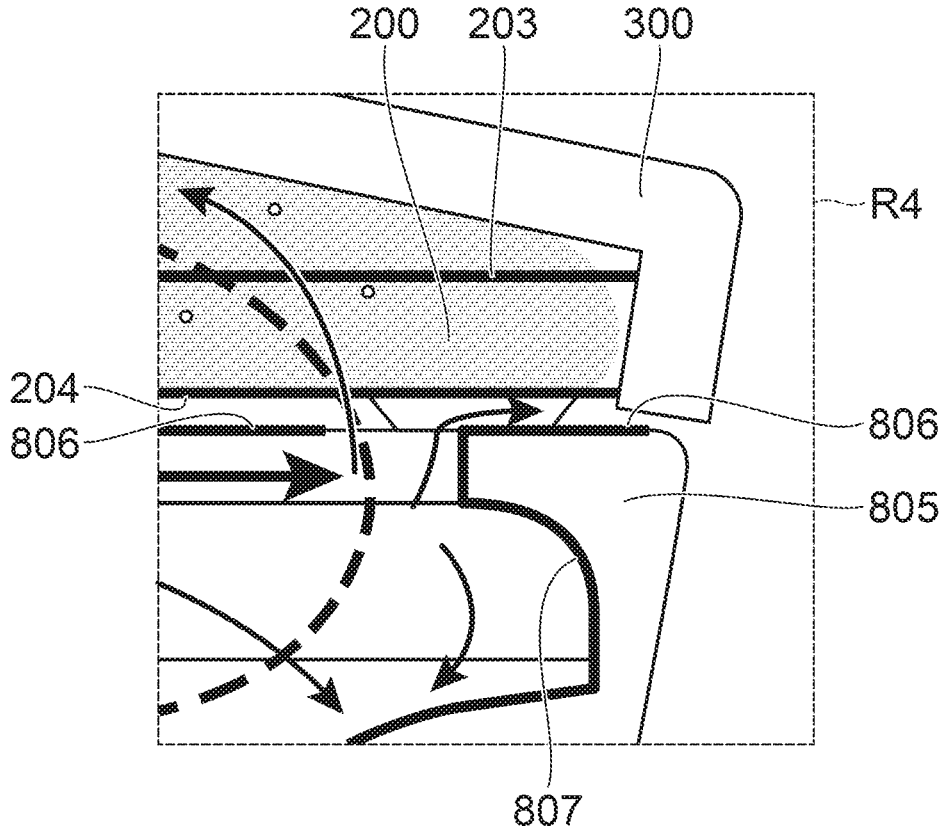

FIG. 9A and FIG. 9B are cross-sectional views illustrating operations in the first process of the toilet seat device according to the embodiment.

FIG. 9B is an enlarged view of region R4 shown in FIG. 9A.

The broken-line arrows illustrate the air stream formed by the blower 513. In the first process as shown in FIG. 9A, the blower 513 blows air frontward and downward. At least a part of the air blown from the blower 513 strikes the interior of the flush toilet 800 (the bowl 801 interior or the inner wall surface 807 of the rim 805) and moves upward. Thereby, the rising air stream U1 that curls upward above the toilet seat 200 from the interior of the flush toilet 800 lower than the toilet seat 200 is formed.

The solid-line arrows illustrate the flow of the mist sprayed from the sprayer 481. The thickness of the solid-line arrow corresponds to the amount of the sterilizing water. A thick arrow illustrates a large amount of the sterilizing water. In the first process, a part of the mist is radiated from the sprayer 481 toward the inner wall surface 807 of the rim. The mist that has a relatively small particle size wets the upper surface 806 of the rim, the toilet seat 200, the toilet lid 300, etc., due to the rising air stream. The mist that has a relatively large particle size may wet the bowl 801 and/or the inner wall surface 807 of the rim 805.

In the embodiment, the nozzle 473 is disposed between the sprayer 481 and the blower 513 in the width direction (the transverse direction) of the nozzle 473 (referring to FIGS. 4A to 4E). In other words, the sprayer 481 is disposed at a position separated from the blower 513 in the left/right direction. Thereby, the first mist M1 that has the small particle size and wets the interior of the flush toilet 800 before floating on the first rising air stream U1 by floating on an air stream blown from the blower 513 into the flush toilet 800 (an air stream before the first rising air stream U1 is generated) can be suppressed.

FIG. 10A to FIG. 10D are plan views illustrating operations in the first process of the toilet seat device according to the embodiment.

Figure 10A:
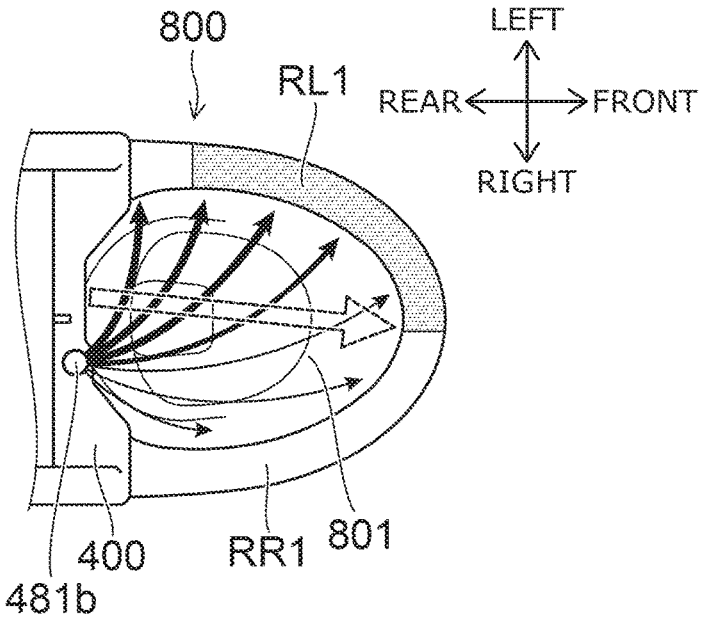
FIG. 10A to FIG. 10D are plan views illustrating operations in the first process of the toilet seat device according to the embodiment.
Figure 10B:
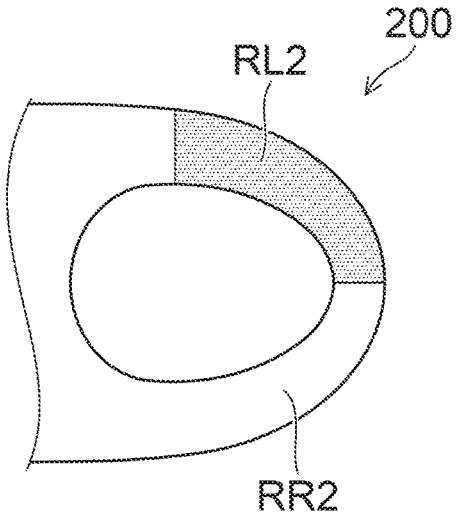
Figure 10C:
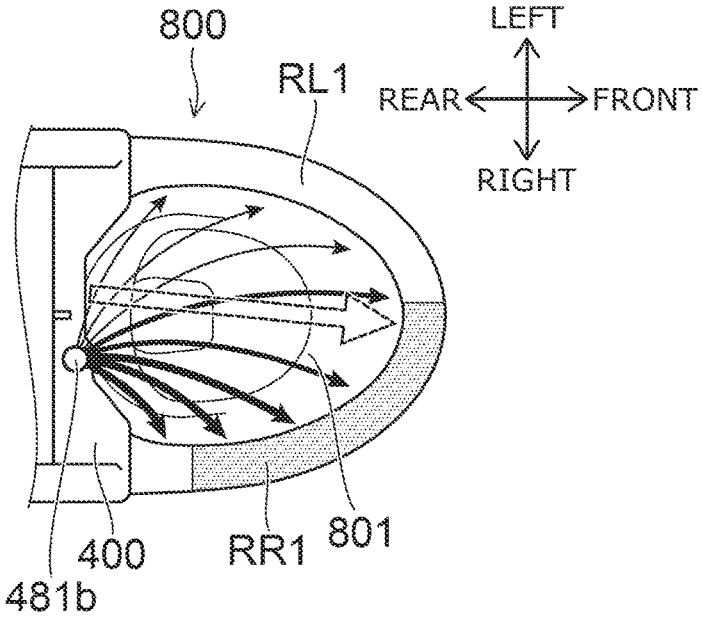
Figure 10D:
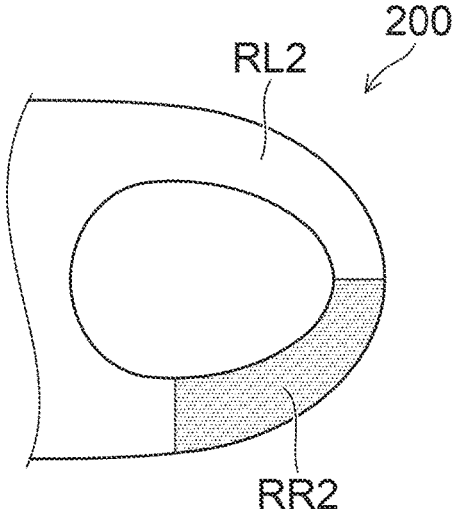

In FIG. 10A and FIG. 10C, the toilet seat 200 and the toilet lid 300 are not illustrated for convenience of description. The broken-line arrows illustrate the blowing direction of the blower 513. The solid-line arrows illustrate the flow of the mist sprayed from the sprayer 481. The thickness of the solid-line arrow corresponds to the amount of the sterilizing water. A thick arrow illustrates a large amount of the sterilizing water. FIG. 10B and FIG. 10D illustrate the toilet seat 200.

FIG. 10A and FIG. 10B show a state when the disk 481*b* of the sprayer 481 rotates counterclockwise when viewed in the top view. In such a case, more of the sterilizing water wets the left side compared to the right side of the toilet device 10. For example, as shown in FIG. 10A, more of the sterilizing water wets a left-side region RL1 than a right-side region RR1 at the rim upper surface. For example, as shown in FIG. 10B, more of the sterilizing water wets a left-side region RL2 than a right-side region RR2 at the toilet seat 200.

FIG. 10C and FIG. 10D show a state when the disk 481*b* of the sprayer 481 rotates clockwise when viewed in the top view. In such a case, more of the sterilizing water wets the right side compared to the left side of the toilet device 10. For example, as shown in FIG. 10C, more of the sterilizing water wets the right-side region RR1 than the left-side region RL1 at the rim upper surface. For example, as shown in FIG. 10D, more of the sterilizing water wets the right-side region RR2 than the left-side region RL2 at the toilet seat 200.

It is favorable for the controller 405 to control the motor 481*a* of the sprayer 481 to appropriately switch between clockwise and counterclockwise in the first process. Thereby, the distribution of the mist in the left/right direction can be uniform easily.

Figure 11A:
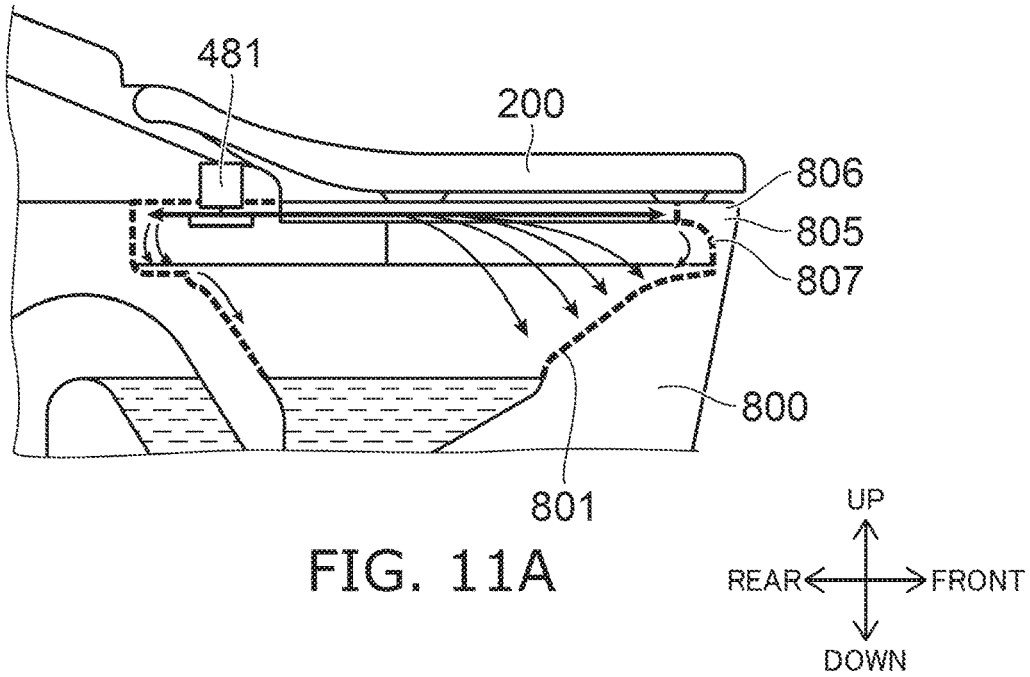
FIG. 11A to FIG. 11C are plan views and a cross-sectional view illustrating operations in the second process of the toilet seat device according to the embodiment.
Figure 11B:
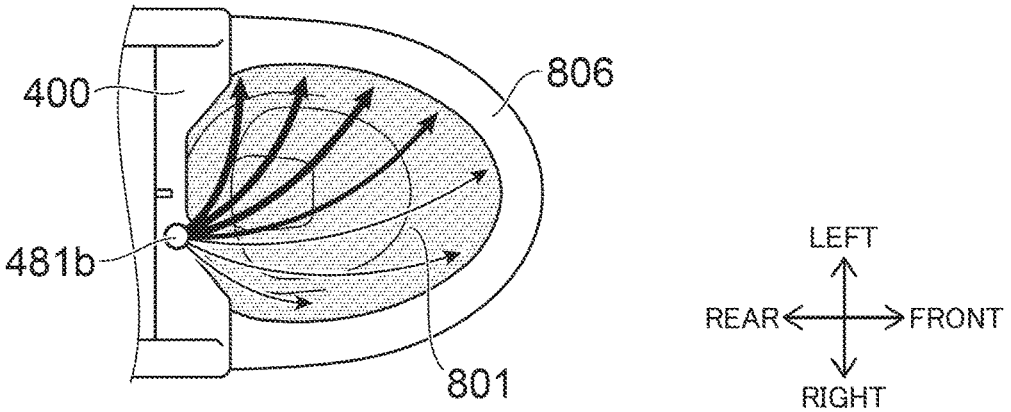
Figure 11C:
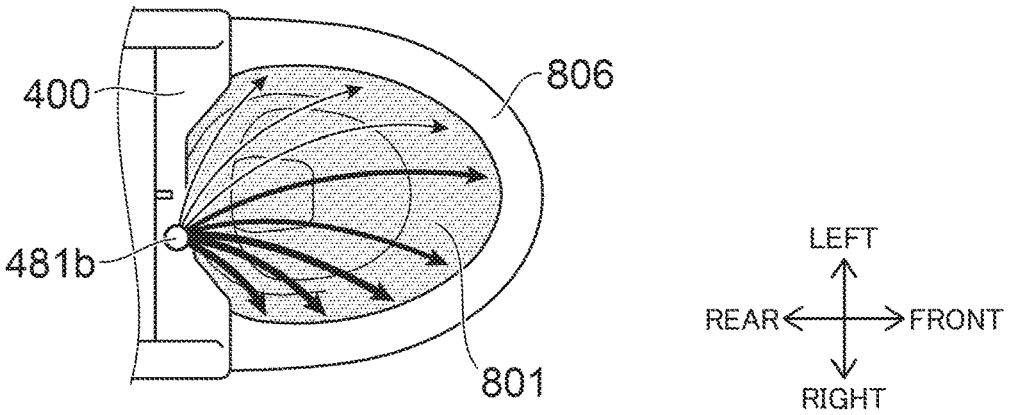

FIG. 11A to FIG. 11C are plan views and a cross-sectional view illustrating operations in the second process of the toilet seat device according to the embodiment.

The solid-line arrows illustrate the flow of the mist sprayed from the sprayer 481. The thickness of the solid-line arrow corresponds to the amount of the sterilizing water. A thick arrow illustrates a large amount of the sterilizing water. For convenience of description, the toilet lid 300 is not illustrated in FIG. 11A; and the toilet seat 200 and the toilet lid 300 are not illustrated in FIG. 11B and FIG. 11C. In the second process in the example, the controller 405 does not operate the blower 513. That is, the air blow into the flush toilet 800 is not performed in the second process.

As shown in the cross-sectional view of FIG. 11A, the sprayer 481 sprays the mist toward the upper end of the rim 805. The mist of the sterilizing water wets the bowl 801 and the inner wall surface 807 of the rim 805 in the second process. Because the first rising air stream U1 is not generated in the second process, for example, the mist of the sterilizing water does not wet the toilet seat 200 or the upper surface 806 of the rim 805.

The plan view of FIG. 11B shows a state when the disk 481*b* of the sprayer 481 rotates counterclockwise when viewed in the top view. In such a case, more of the sterilizing water wets the left side compared to the right side inside the flush toilet 800.

The plan view of FIG. 11C shows a state when the disk 481*b* of the sprayer 481 rotates clockwise when viewed in the top view. In such a case, more of the sterilizing water wets the right side compared to the left side inside the flush toilet 800.

It is favorable for the controller 405 to control the motor 481*a* of the sprayer 481 to appropriately switch between clockwise and counterclockwise in the second process. Thereby, the distribution of the mist in the left/right direction can be uniform easily.

As described above, the sterilizing water can be caused to wet the upper surface 806 of the rim 805, the toilet seat 200, the toilet lid 300, etc., by the first process. Also, the sterilizing water can be caused to wet the bowl 801 and the inner wall surface 807 of the rim 805 by the second process. Thus, every nook and corner of the toilet device 10 including the rim 805, the toilet seat 200, the toilet lid 300, etc., can be sterilized.

Figure 12:
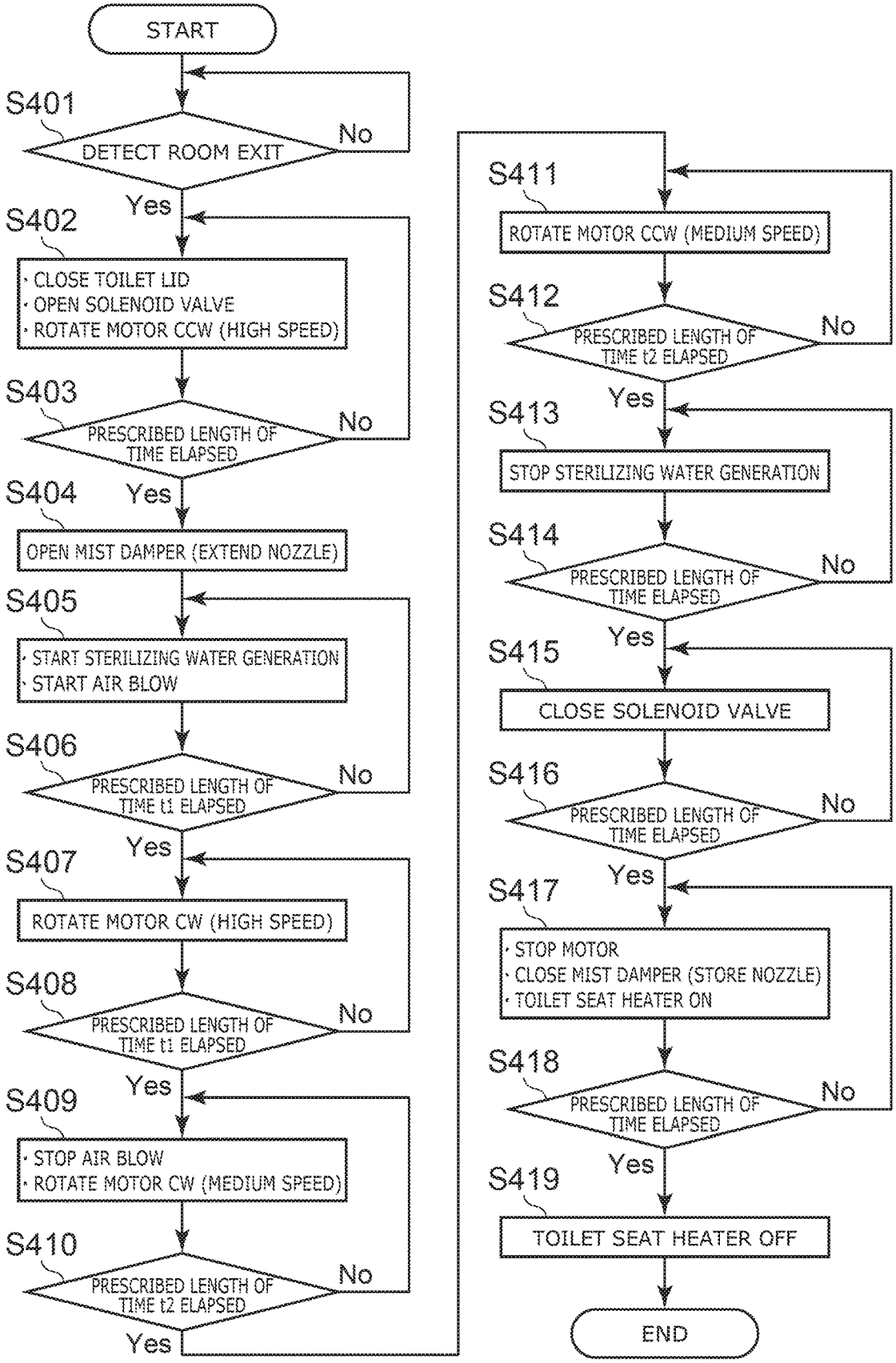
FIG. 12 is a flowchart illustrating operations in the after-mist mode of the toilet seat device according to the embodiment.

FIG. 12 is a flowchart illustrating operations in the after-mist mode of the toilet seat device according to the embodiment.

When the human body detection sensor 403 detects the exit of the user (step S401: Yes), the controller 405 controls the toilet lid motor 512 to close the toilet lid 300, opens the solenoid valve 431, and causes the motor 481*a* and the disk 481*b* of the sprayer 481 to perform a counterclockwise (CCW) high-speed rotation (step S402). The water supply to the disk 481*b* is started by the solenoid valve 431 being opened.

The controller 405 maintains the state in which the disk 481*b* has the high-speed rotation for a prescribed length of time (step S403: No). Thereby, the remaining water that is on the disk 481*b* can be discharged from the disk 481*b*. At this time, for example, the mist is not sprayed into the flush toilet 800 because the mist damper 482 is closed.

When the prescribed length of time has elapsed (step S403: Yes), the controller 405 causes the nozzle 473 to advance into the bowl 801 by the nozzle motor 476. Accordingly, the mist damper 482 is opened (step S404).

Subsequently, the controller 405 controls the sterilizer 450 to start the generation of the sterilizing water and controls the blower 513 to start the air blow into the flush toilet 800 (step S405). Thereby, the spraying of the mist of the sterilizing water toward the interior of the flush toilet 800, the toilet seat 200, the toilet lid 300, etc., is started. The controller 405 maintains the state in which the mist of the sterilizing water is sprayed from the disk 481*b* having the counterclockwise high-speed rotation for a prescribed length of time (t1) (step S406: No).

When the prescribed length of time (t1) has elapsed (step S406: Yes), the controller 405 causes the motor 481*a* and the disk 481*b* of the sprayer 481 to perform a clockwise (CW) high-speed rotation (step S407). The controller 405 maintains the state in which the mist of the sterilizing water is sprayed from the disk 481*b* having the clockwise high-speed rotation for a prescribed length of time (t1) (step S408: No). For example, step S405 to step S408 correspond to the first process.

When the prescribed length of time (t1) has elapsed (step S408: Yes), the controller 405 controls the blower 513 to stop the air blow and causes the motor 481*a* and the disk 481*b* to perform a clockwise (CW) medium-speed rotation (step S409). Thereby, the mist is sprayed toward the bowl 801 and the inner wall surface 807 of the rim while suppressing the mist wetting the toilet seat 200 and/or the upper surface 806 of the rim. The controller 405 maintains the state in which the mist of the sterilizing water is sprayed from the disk 481*b* having the clockwise medium-speed rotation for a prescribed length of time (t2) (step S410: No).

When the prescribed length of time (t2) has elapsed (step S410: Yes), the controller 405 causes the motor 481*a* and the disk 481*b* of the sprayer 481 to perform a counterclockwise (CCW) medium-speed rotation (step S411). The controller 405 maintains the state in which the mist of the sterilizing water is sprayed from the disk 481*b* having the counterclockwise medium-speed rotation for a prescribed length of time (t2) (step S412: No). For example, step S409 to step S412 correspond to the second process.

When the prescribed length of time (t2) has elapsed (step S412: Yes), the controller 405 controls the sterilizer 450 to stop the generation of the sterilizing water (step S413).

The controller 405 maintains the state in which the service water is supplied to the disk 481*b* and the disk 481*b* has the medium-speed rotation for a prescribed length of time (step S414: No). Thereby, self-cleaning of the disk 481*b* is performed. The self-cleaning is an operation of physically washing the disk at a rotation speed deliberately set not to generate a mist. The sterilizing water may be used in the self-cleaning.

When the prescribed length of time has elapsed (step S414: Yes), the controller 405 closes the solenoid valve 431 (step S415). The controller 405 stops the water supply to the disk 481*b* and maintains the state in which the disk 481*b* is rotated at the medium speed for a prescribed length of time (step S416: No). Thereby, the remaining water that is on the disk 481*b* can be removed.

When the prescribed length of time has elapsed (step S416: Yes), the controller 405 stops the rotation of the motor 481*a* and the disk 481*b* and causes the nozzle 473 to retract into the casing 400 by the nozzle motor 476. Accordingly, the mist damper 482 is closed. Also, the controller 405 turns the toilet seat heater 515 ON (a conduction state) (step S417).

The controller 405 maintains the ON state of the toilet seat heater 515 for a prescribed length of time (step S418: No). Thereby, the temperature of the toilet seat 200 is increased; the sterilizing water that wets the toilet seat 200 is evaporated; and the toilet seat 200 can be dried. Instead of the toilet seat heater 515, the toilet seat 200 may be dried by warm air by driving the blower 513 and the warm air heater 514.

When the prescribed length of time has elapsed (step S418: Yes), the controller 405 turns the toilet seat heater 515 OFF (a non-conduction state) (step S419). Thus, the after-mist mode ends.

Thus, the controller 405 executes the second process after executing the first process which causes the mist of the sterilizing water to wet the toilet seat 200 and/or the upper surface 806 of the rim 805 for one time of performing the mist mode. Thereby, because the toilet seat 200 and/or the upper surface 806 of the rim 805 can be dried when executing the second process, the time from the end of one time of performing the mist mode to the toilet seat 200 and/or the upper surface 806 of the rim 805 being dried can be shortened.

Figure 13:
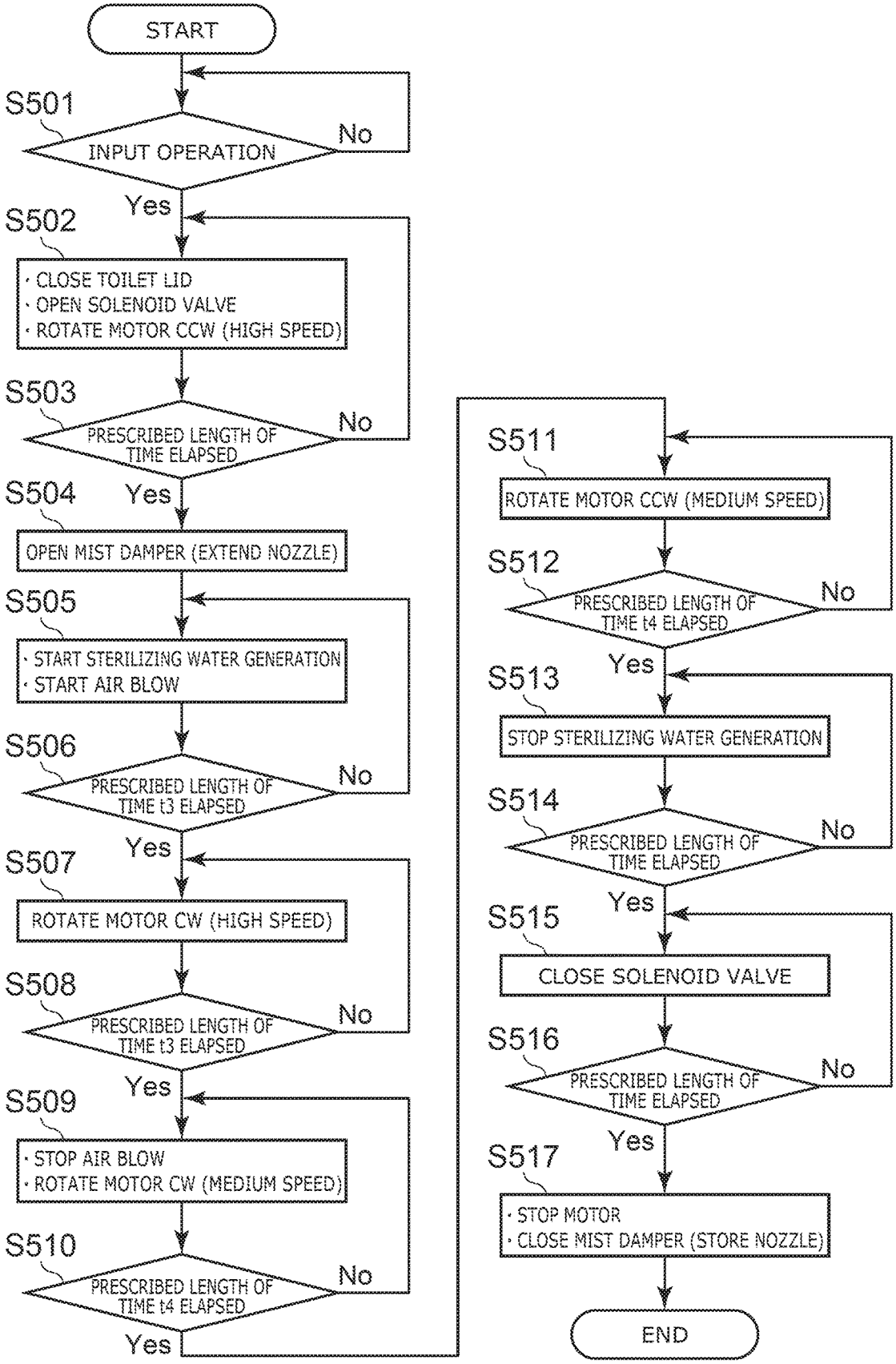
FIG. 13 is a flowchart illustrating operations in the manual mist mode of the toilet seat device according to the embodiment.

FIG. 13 is a flowchart illustrating operations in the manual mist mode of the toilet seat device according to the embodiment.

When the user operates the manual operation part 500 (step S501: Yes), the controller 405 controls the toilet lid motor 512 to close the toilet lid 300, opens the solenoid valve 431, and causes the motor 481*a* and the disk 481*b* of the sprayer 481 to perform a counterclockwise (CCW) high-speed rotation (step S502). The water supply to the disk 481*b* is started by the solenoid valve 431 being opened.

The controller 405 maintains the state in which the disk 481*b* has the high-speed rotation for a prescribed length of time (step S503: No). Thereby, the remaining water that is on the disk 481*b* can be discharged from the disk 481*b*. At this time, for example, the mist is not sprayed into the flush toilet 800 because the mist damper 482 is closed.

When the prescribed length of time has elapsed (step S503: Yes), the controller 405 causes the nozzle 473 to advance into the bowl 801 by the nozzle motor 476. Accordingly, the mist damper 482 is opened (step S504).

Subsequently, the controller 405 controls the sterilizer 450 to start the generation of the sterilizing water and controls the blower 513 to start the air blow into the flush toilet 800 (step S505). Thereby, the spraying of the mist of the sterilizing water toward the interior of the flush toilet 800, the toilet seat 200, the toilet lid 300, etc., is started. The controller 405 maintains the state in which the mist of the sterilizing water is sprayed from the disk 481*b* having the counterclockwise high-speed rotation for a prescribed length of time (t3) (step S506: No).

When the prescribed length of time (t2) has elapsed (step S506: Yes), the controller 405 causes the motor 481*a* and the disk 481*b* of the sprayer 481 to perform a clockwise (CW) high-speed rotation (step S507). The controller 405 maintains the state in which the mist of the sterilizing water is sprayed from the disk 481*b* having the clockwise high-speed rotation for a prescribed length of time (t3) (step S508: No). For example, step S505 to step S508 correspond to the first process.

When the prescribed length of time (t3) has elapsed (step S508: Yes), the controller 405 controls the blower 513 to stop the air blow and causes the motor 481*a* and the disk 481*b* to perform a clockwise (CW) medium-speed rotation (step S509). Thereby, the mist is sprayed toward the bowl 801 and the inner wall surface 807 of the rim while suppressing the mist wetting the toilet seat 200 and/or the upper surface 806 of the rim. The controller 405 maintains the state in which the mist of the sterilizing water is sprayed from the disk 481*b* having the clockwise medium-speed rotation for a prescribed length of time (t4) (step S510: No).

When the prescribed length of time (t4) has elapsed (step S510: Yes), the controller 405 causes the motor 481*a* and the disk 481*b* of the sprayer 481 to perform a counterclockwise (CCW) medium-speed rotation (step S511). The controller 405 maintains the state in which the mist of the sterilizing water is sprayed from the disk 481*b* having the counterclockwise medium-speed rotation for a prescribed length of time (t4) (step S512: No). For example, step S509 to step S512 correspond to the second process.

When the prescribed length of time (t4) has elapsed (step S512: Yes), the controller 405 controls the sterilizer 450 to stop the generation of the sterilizing water (step S513).

The controller 405 maintains the state in which the service water is supplied to the disk 481*b* and the disk 481*b* has the medium-speed rotation for a prescribed length of time (step S514: No). Thereby, the self-cleaning of the disk 481*b* is performed.

When the prescribed length of time has elapsed (step S514: Yes), the controller 405 closes the solenoid valve 431 (step S515). The controller 405 stops the water supply to the disk 481*b* and maintains the state in which the disk 481*b* is rotated at the medium speed for a prescribed length of time (step S516: No). Thereby, the remaining water that is on the disk 481*b* can be removed.

When the prescribed length of time has elapsed (step S516: Yes), the controller 405 stops the rotation of the motor 481*a* and the disk 481*b* and causes the nozzle 473 to retract into the casing 400 by the nozzle motor 476. Accordingly, the mist damper 482 is closed (step S517). Thus, the manual mist mode ends. After the manual mist mode, the user can sterilize the toilet seat 200 by appropriately wiping the sterilizing water wetting the toilet seat 200 using toilet paper, etc.

In the manual mist mode and the after-mist mode, the controller 405 sets the time of the execution of the first process to be shorter than the time of the execution of the second process. For example, in the after-mist mode described in reference to FIG. 12, the prescribed length of time (t1) is shorter than the prescribed length of time (t2). In the manual mist mode described in reference to FIG. 13, the prescribed length of time (t3) is shorter than the prescribed length of time (t4). By shortening the time of the first process, the amount of the sterilizing water wetting the toilet seat 200 and the upper surface 806 of the rim 805 can be reduced more reliably. On the other hand, by lengthening the time of the second process, the amount of the sterilizing water wetting the bowl 801 and the inner wall surface 807 of the rim 805 can be increased.

The controller 405 controls the sprayer to set the time of spraying the sterilizing water in the manual mist mode to be longer than the time of spraying the sterilizing water in the after-mist mode. For example, the prescribed length of time (t3) described in reference to FIG. 13 is longer than the prescribed length of time (t1) described in reference to FIG. 12. Thereby, the amount of the sterilizing water wetting the toilet seat 200 in the manual mist mode can be more than the amount of the sterilizing water wetting the toilet seat 200 in the after-mist mode. Thereby, the sterilizing water can sufficiently permeate the toilet paper, etc., in the manual mist mode; and the sterilizing performance can be improved. Also, scratches on the resin toilet seat 200 when wiping can be suppressed.

For example, a method may be considered in which the wetting amount of the sterilizing water is changed by changing the particle size of the mist of the sterilizing water without changing the time of spraying the sterilizing water. For example, by causing the particle size to be large, the wetting amount of the sterilizing water can be increased. However, in the case where the particle size is large, there is an undesirable risk that the sterilizing water may not float easily on the rising air stream. Conversely, by changing the time of spraying the sterilizing water, the amount of the sterilizing water wetting the toilet seat 200, etc., can be increased without changing the particle size. Therefore, the mist of the sterilizing water can float on the rising air stream easily; and the sterilizing water can be diffused in a wide area including the toilet seat 200, etc.

Also, the controller 405 operates the dryer at a first drying power to dry the toilet seat 200 when executing or after executing the after-mist mode. For example, in FIG. 12, the controller 405 operates the toilet seat heater 515 at a first heating amount (a first electrical power (watts)) in steps S417 and S418.

On the other hand, the controller 405 does not operate the dryer when executing or after executing the manual mist mode, or operates at a second drying power that is smaller than the first drying power. For example, in FIG. 13, the controller 405 does not operate the toilet seat heater 515. Or, the controller 405 may operate the toilet seat heater 515 at a second heating amount (a second electrical power (watts)) that is smaller than the first heating amount. For example, due to the toilet seat heater 515, the temperature of the seat surface when executing or after executing the after-mist mode is higher than the temperature of the seat surface when executing or after executing the manual mist mode.

Thus, the drying time of the sterilizing water wetting the toilet seat 200 can be shortened by the dryer drying the toilet seat 200 at the relatively large first drying power (e.g., the first electrical power) when executing or after executing the after-mist mode. On the other hand, the drying time of the sterilizing water wetting the toilet seat 200 can be lengthened by drying the toilet seat 200 by the dryer not being operated or by using the relatively small second drying power (e.g., the second electrical power) when executing or after executing the manual mist mode. Thereby, the toilet seat 200 can be prevented from drying before the sterilizing water wetting the toilet seat 200 is wiped using toilet paper.

An example of the operations of the toilet seat device 100 in the pre-mist mode will now be described with reference to FIG. 14 to FIG. 16C.

Figure 14:
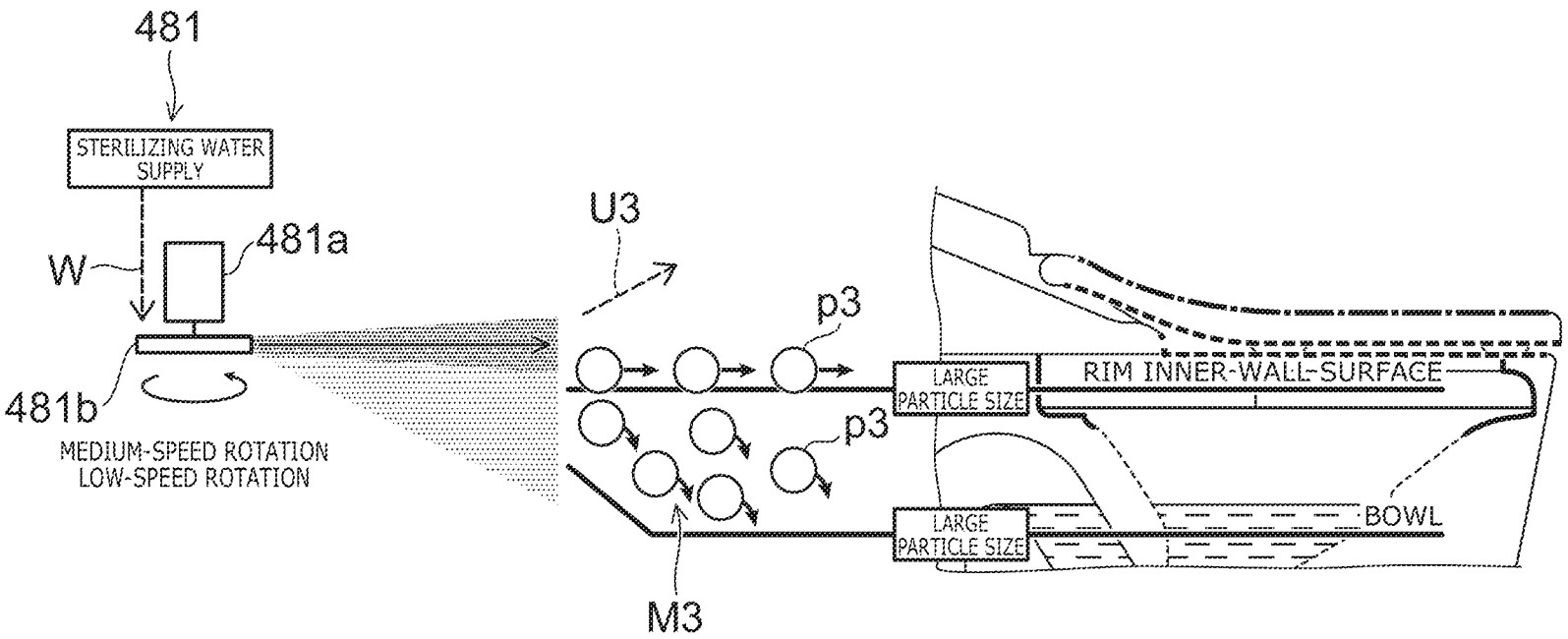
FIG. 14 is a schematic view illustrating the operations in the pre-mist mode of the toilet seat device according to the embodiment.

FIG. 14 is a schematic view illustrating the operations in the pre-mist mode of the toilet seat device according to the embodiment.

In the pre-mist mode, the controller 405 controls the sprayer 481 to generate a mist M3 (a mist of the sterilizing water or a mist of the service water). The controller 405 controls the blower 513 not to generate the first rising air stream U1 and not to lift the mist M3 toward the toilet seat 200 in the state in which the sprayer 481 sprays the mist M3.

As described above, the first rising air stream U1 is an air stream made by the blower 513 and is an air stream that can lift the mist of the sterilizing water toward the toilet seat 200 in the after-mist mode and the manual mist mode.

In the pre-mist mode, the mist that is sprayed lower than the toilet seat 200 wets the bowl 801 of the flush toilet 800 and/or the inner wall surface 807 of the rim 805 without being lifted toward the toilet seat 200. A water film is formed on the bowl 801 and/or the inner wall surface 807; and dirt does not adhere easily. Because the mist is not lifted toward the toilet seat 200, the toilet seat 200 and the upper surface 806 of the rim 805 becoming wet in the pre-mist mode can be suppressed. Thereby, in the case where the user is seated or rotates the toilet seat 200 by hand directly after the pre-mist mode, the hand and/or the buttocks of the user can be prevented from becoming wet.

On the other hand, in the after-mist mode and the manual mist mode, the controller 405 controls the blower 513 to cause the mist of the sterilizing water to be lifted toward the toilet seat 200 by the first rising air stream U1.

In other words, the controller 405 can switch between the case where the mist that is sprayed lower than the toilet seat 200 floats on the rising air stream and wets the toilet seat 200, and the case where the mist does not float on the rising air stream. Thereby, the single sprayer 481 can cause the mist of the sterilizing water to wet the toilet seat 200 and the interior of the flush toilet 800 in the after-mist mode and the manual mist mode; and the mist can be caused to wet the interior of the flush toilet 800 without the toilet seat 200 becoming wet in the pre-mist mode.

The scope of the "mist of the sterilizing water or the mist of the service water not being lifted toward the toilet seat" in the pre-mist mode includes not only the case where none of the mist is lifted but also the case where a slight amount of the mist is lifted. For example, the amount of the mist lifted toward the toilet seat in the pre-mist mode is less than the amount of the mist lifted toward the toilet seat in the after-mist mode or the manual mist mode.

For example, in the pre-mist mode, the controller 405 stops the operation of the blower 513 so that the air blow is not performed. Thereby, the mist can be prevented more reliably from being lifted toward the toilet seat 200.

In the pre-mist mode, the controller 405 may control the blower 513 to generate a rising air stream U3. The flow velocity of the rising air stream U3 is lower than the flow velocity of the first rising air stream U1; and the mist M3 is not lifted toward the toilet seat 200 by the rising air stream U3. Due to the rising air stream U3, the mist can be diffused downward or in the horizontal direction without being lifted toward the toilet seat 200. Thereby, the sterilizing water can be caused to wet a wider area inside the flush toilet 800.

In the pre-mist mode as well, the sprayer 481 sprays the mist of the sterilizing water or the mist of the service water in a radial configuration when viewed in the top view. Thereby, even in the case where the mist does not float on the rising air stream in the pre-mist mode, the mist can be caused to wet a wide area including the bowl 801, the inner wall surface 807 of the rim 805, etc.

The mist M3 is, for example, a mist having a medium particle size or a large particle size. For example, the particle size (the diameter of a fine particle p3 of the sterilizing water or the service water) of the mist M3 may be larger than the particle size of the first mist M1 and the particle size of the second mist M2 in the manual mist mode and the after-mist mode. Thereby, the mist M3 may not be lifted toward the toilet seat 200.

Figure 15A:
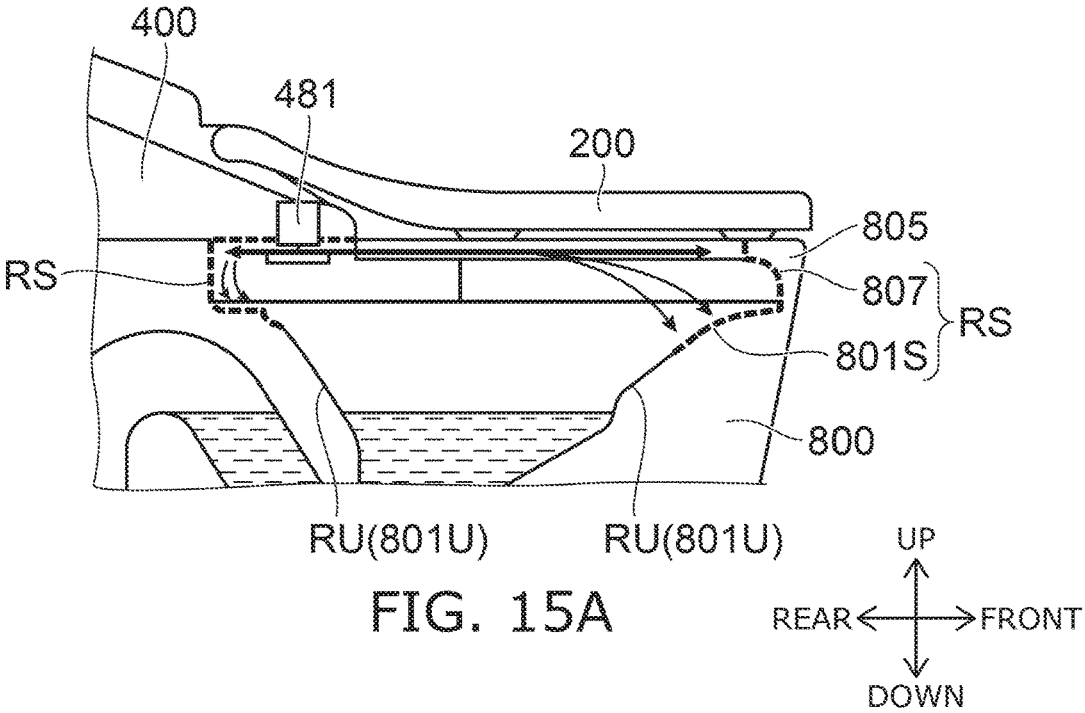
FIG. 15A to FIG. 15C are plan views and a cross-sectional view illustrating operations in the pre-mist mode of the toilet seat device according to the embodiment.
Figure 15B:
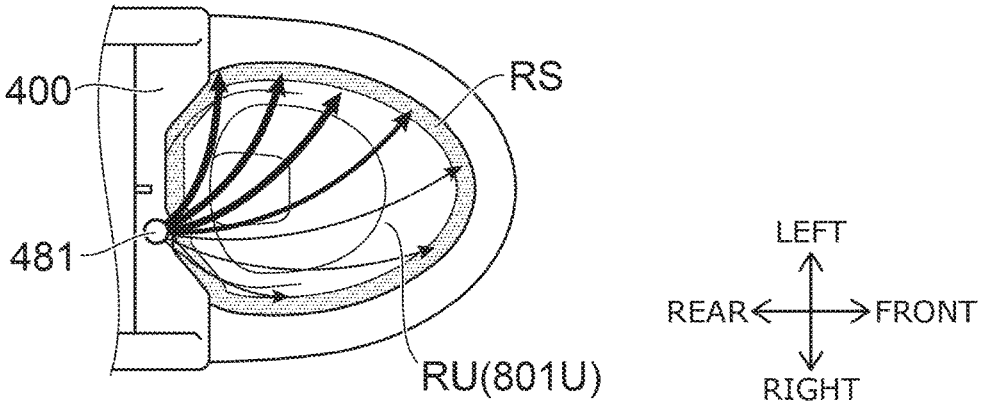
Figure 15C:
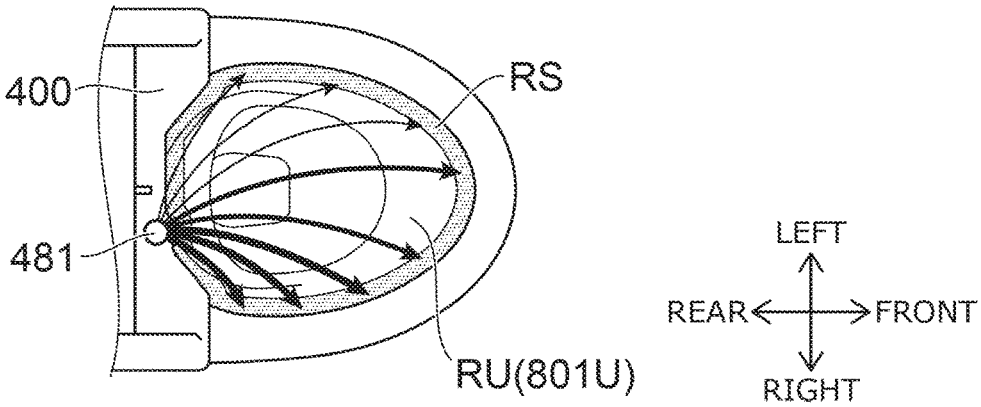

FIG. 15A to FIG. 15C are plan views and a cross-sectional view illustrating operations in the pre-mist mode of the toilet seat device according to the embodiment.

FIG. 15A to FIG. 15C illustrate a state in which the motor 481*a* of the sprayer 481 has a medium-speed rotation. At this time, the mist that is sprayed by the sprayer 481 is a mist having a medium particle size. In FIG. 15A to FIG. 15C, the solid-line arrows illustrate the flow of the mist sprayed from the sprayer 481. The thickness of the solid-line arrow corresponds to the amount of the sterilizing water. A thick arrow illustrates a large amount of the sterilizing water.

In FIG. 15B and FIG. 15C, the toilet seat 200 is not illustrated for convenience of description.

As shown in the cross-sectional view of FIG. 15A, the sprayer 481 sprays the mist toward the upper end of the rim 805. In the case where the motor 481*a* has the medium-speed rotation, more of the sterilizing water or the service water wets an outer region RS (an outer portion 801S inside the bowl 801 and the inner wall surface 807 of the rim 805) of the flush toilet 800 compared to an inner region RU (an inner portion 801U of the bowl 801) of the flush toilet 800.

The plan view of FIG. 15B shows a state when the disk 481*b* of the sprayer 481 rotates counterclockwise when viewed in the top view. In such a case, more of the sterilizing water or the service water wets the left side compared to the right side inside the flush toilet 800.

The plan view of FIG. 15C shows a state when the disk 481*b* of the sprayer 481 rotates clockwise when viewed in the top view. In such a case, more of the sterilizing water or the service water wets the right side compared to the left side inside the flush toilet 800.

Figure 16A:
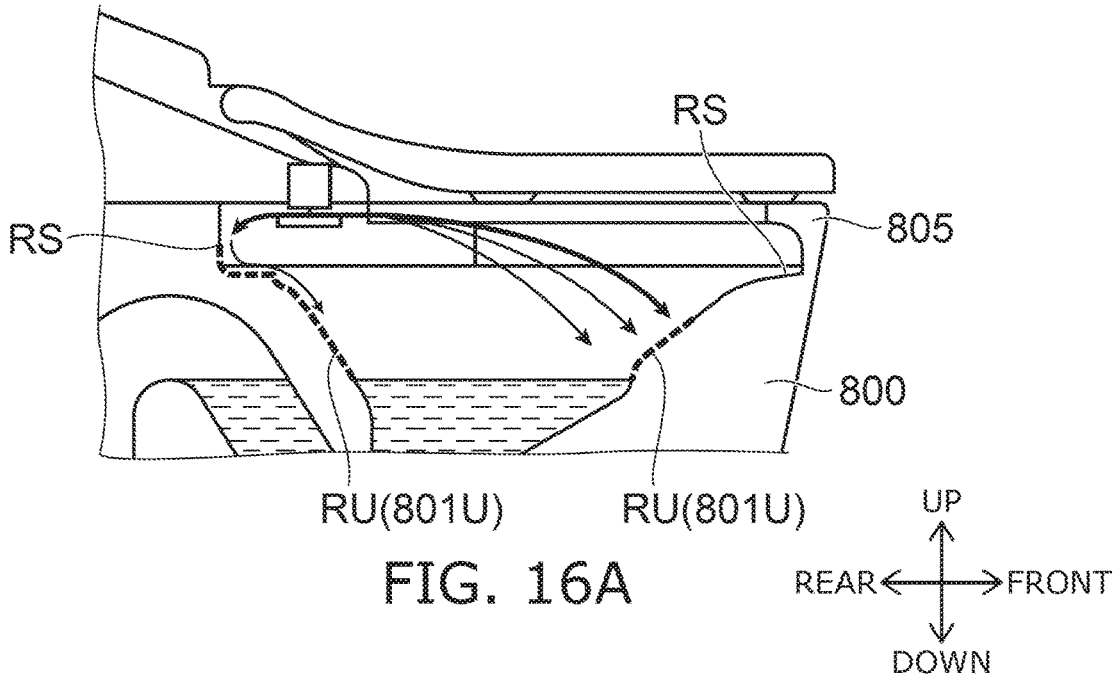
FIG. 16A to FIG. 16C are plan views and a cross-sectional view illustrating operations in the pre-mist mode of the toilet seat device according to the embodiment.
Figure 16B:
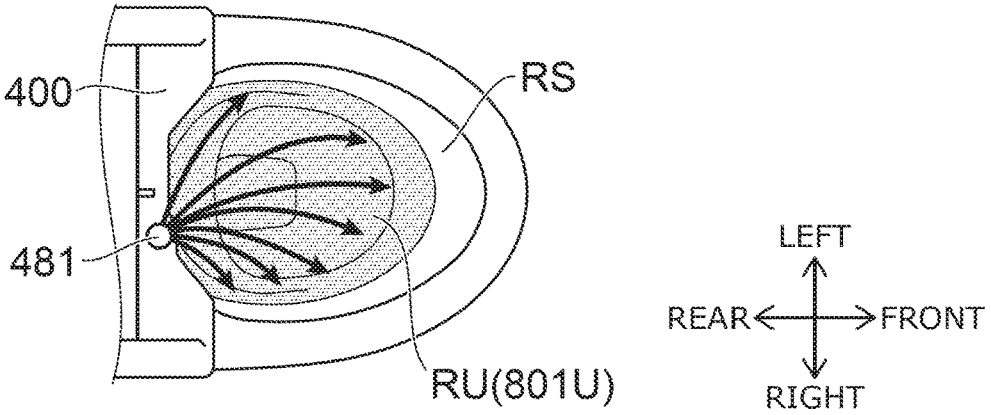
Figure 16C:
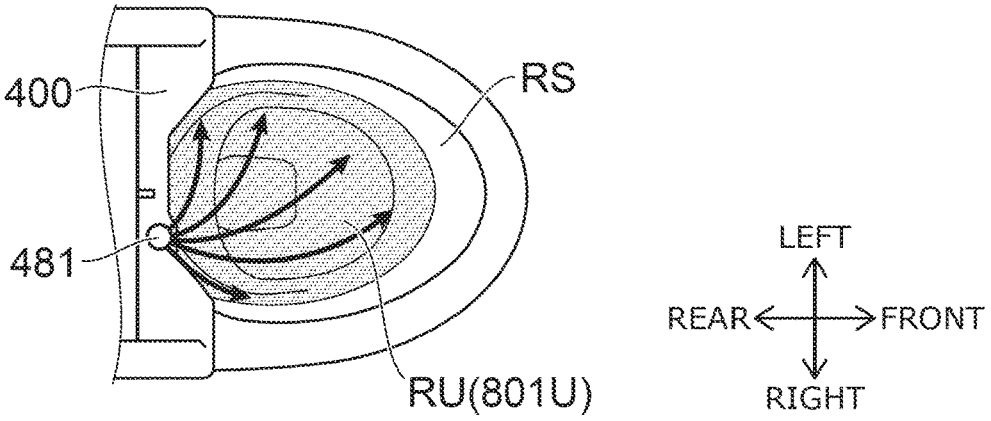

FIG. 16A to FIG. 16C are plan views and a cross-sectional view illustrating operations in the pre-mist mode of the toilet seat device according to the embodiment.

FIG. 16A to FIG. 16C illustrate a state in which the motor 481*a* of the sprayer 481 has a low-speed rotation. At this time, the mist that is sprayed by the sprayer 481 is a mist having a large particle size. In FIG. 16A to FIG. 16C, the solid-line arrows illustrate the flow of the mist sprayed from the sprayer 481. The thickness of the solid-line arrow corresponds to the amount of the sterilizing water. A thick arrow illustrates a large amount of the sterilizing water. In FIG. 16B and FIG. 16C, the toilet seat 200 is not illustrated for convenience of description.

In the case where the motor 481*a* has the low-speed rotation, compared to the case where the motor has the medium-speed rotation, the particle size of the mist is large; the centrifugal force is small; therefore, the carry distance of the mist is short. As shown in the cross-sectional view of FIG. 16A, in the case where the motor 481*a* has the low-speed rotation, more of the sterilizing water or the service water wets the inner region RU of the flush toilet 800 compared to the outer region RS of the flush toilet 800.

The plan view of FIG. 16B shows a state when the disk 481*b* of the sprayer 481 rotates clockwise when viewed in the top view. In such a case, more of the sterilizing water or the service water wets the right side compared to the left side inside the flush toilet 800.

The plan view of FIG. 16C shows a state when the disk 481*b* of the sprayer 481 rotates counterclockwise when viewed in the top view. In such a case, more of the sterilizing water or the service water wets the left side compared to the right side inside the flush toilet 800.

The controller 405 controls the motor 481*a* of the sprayer 481 to appropriately switch between low-speed rotation and medium-speed rotation in the pre-mist mode. Thereby, the mist of the sterilizing water or the service water can be caused to wet every nook and corner of the flush toilet 800.

Also, it is favorable for the controller 405 to control the motor 481*a* of the sprayer 481 to appropriately switch between clockwise and counterclockwise in the pre-mist mode (the low-speed rotation and the medium-speed rotation). Thereby, the distribution of the mist in the left/right direction can be uniform easily.

Figure 17:
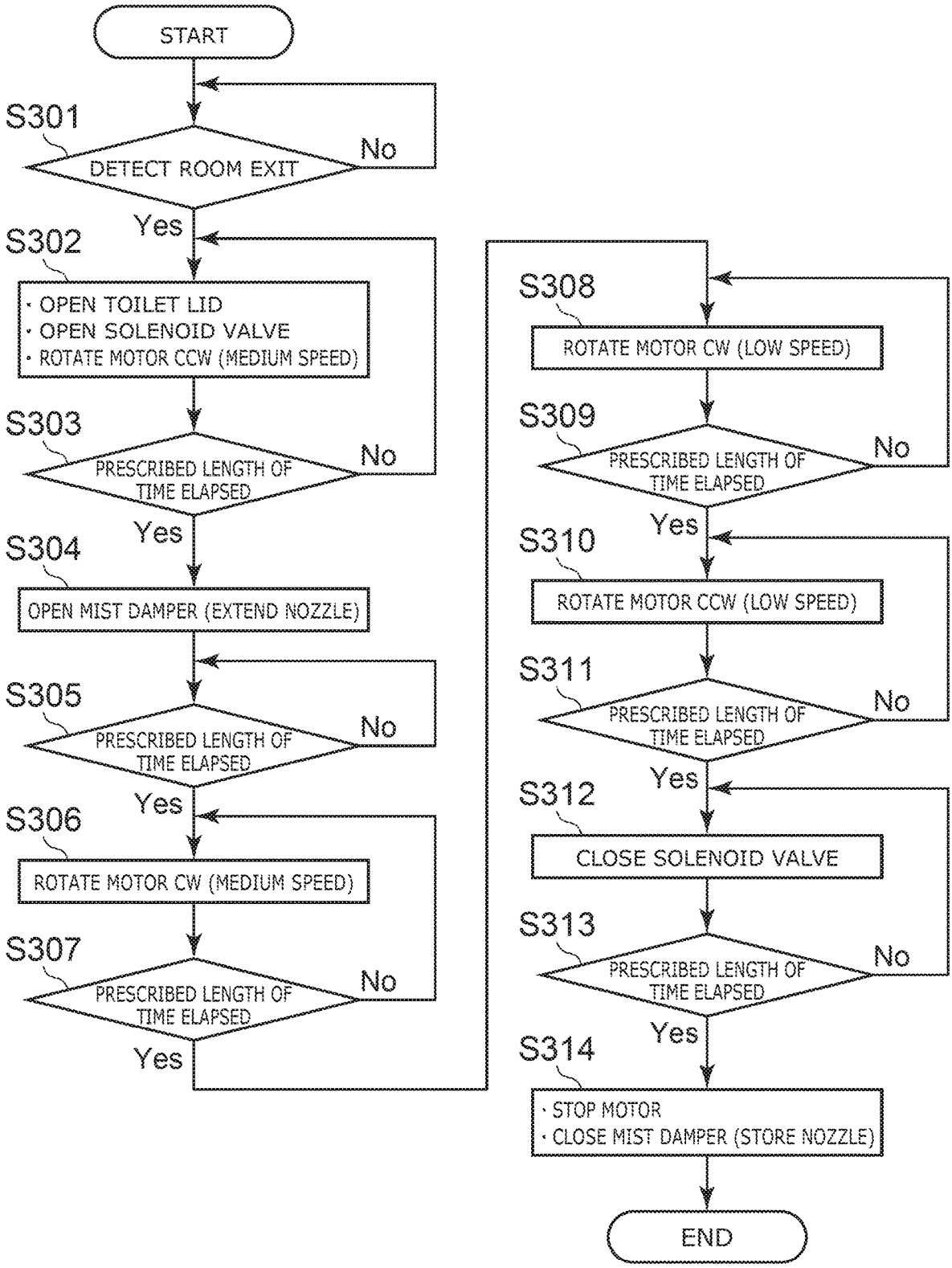
FIG. 17 is a flowchart illustrating operations in the after-mist mode of the toilet seat device according to the embodiment.

FIG. 17 is a flowchart illustrating operations in the after-mist mode of the toilet seat device according to the embodiment.

When the human body detection sensor 403 detects the entrance of the user (step S301: Yes), the controller 405 controls the toilet lid motor 512 to open the toilet lid 300, opens the solenoid valve 431, and causes the motor 481*a* and the disk 481*b* of the sprayer 481 to perform a counterclockwise (CCW) medium-speed rotation (step S302). The water supply to the disk 481*b* is started by the solenoid valve 431 being opened.

The controller 405 maintains the state in which the disk 481*b* has the medium-speed rotation for a prescribed length of time (step S303: No). Thereby, the remaining water that is on the disk 481*b* can be discharged from the disk 481*b*. At this time, for example, the mist is not sprayed into the flush toilet 800 because the mist damper 482 is closed.

When the prescribed length of time has elapsed (step S303: Yes), the controller 405 causes the nozzle 473 to advance into the bowl 801 by the nozzle motor 476. Accordingly, the mist damper 482 is opened (step S304). Thereby, the spraying of the mist of the service water into the flush toilet 800 is started. The controller 405 maintains the state in which the mist of the service water is sprayed from the disk 481*b* having the counterclockwise medium-speed rotation for a prescribed length of time (step S305: No).

When the prescribed length of time has elapsed (step S305: Yes), the controller 405 causes the motor 481*a* and the disk 481*b* of the sprayer 481 to perform a clockwise (CW) medium-speed rotation (step S306). The controller 405 maintains the state in which the mist of the service water is sprayed from the disk 481*b* having the clockwise medium-speed rotation for a prescribed length of time (step S307: No).

When the prescribed length of time has elapsed (step S307: Yes), the controller 405 causes the motor 481*a* and the disk 481*b* of the sprayer 481 to perform a clockwise (CW) low-speed rotation (step S308). The controller 405 maintains the state in which the mist of the service water is sprayed from the disk 481*b* having the clockwise low-speed rotation for a prescribed length of time (step S309: No).

When the prescribed length of time has elapsed (step S309: Yes), the controller 405 causes the motor 481*a* and the disk 481*b* of the sprayer 481 to perform a counterclockwise (CCW) low-speed rotation (step S310). The controller 405 maintains the state in which the mist of the service water is sprayed from the disk 481*b* having the counterclockwise low-speed rotation for a prescribed length of time (step S311: No).

When the prescribed length of time has elapsed (step S311: Yes), the controller 405 closes the solenoid valve 431 (step S312). The controller 405 stops the water supply to the disk 481*b* and maintains the state in which the disk 481*b* is rotated at the low speed for a prescribed length of time (step S313: No). Thereby, the remaining water that is on the disk 481*b* can be removed.

When the prescribed length of time has elapsed (step S313: Yes), the controller 405 stops the rotation of the motor 481*a* and the disk 481*b* and causes the nozzle 473 to retract into the casing 400 by the nozzle motor 476. Accordingly, the mist damper 482 is closed (step S314). Thus, the pre-mist mode ends.

The controller 405 executes the pre-mist mode in the state in which the toilet lid 300 is open. In other words, in the pre-mist mode, the mist is sprayed the state in which the toilet lid 300 is open. Thereby, the user can be seated on the toilet seat 200 soon without waiting for the execution completion of the pre-mist mode. In the pre-mist mode, the sprayer 481 sprays the mist not to wet the toilet seat 200; therefore, the likelihood of the mist splashing onto the user is low even in the case where the user is seated on the toilet seat 200 when executing the pre-mist mode.

On the other hand, the controller 405 executes the after-mist mode and the manual mist mode in the state in which the toilet lid 300 is closed. In other words, in the after-mist mode and the manual mist mode, the mist is sprayed in the state in which the toilet lid 300 is closed. Thereby, the bacteria and/or the dirt can be suppressed in a wide area including the flush toilet 800, the toilet seat 200, the toilet lid 300, etc., by diffusing the mist of the sterilizing water while preventing the mist of the sterilizing water from scattering outside the flush toilet.

Figure 18:
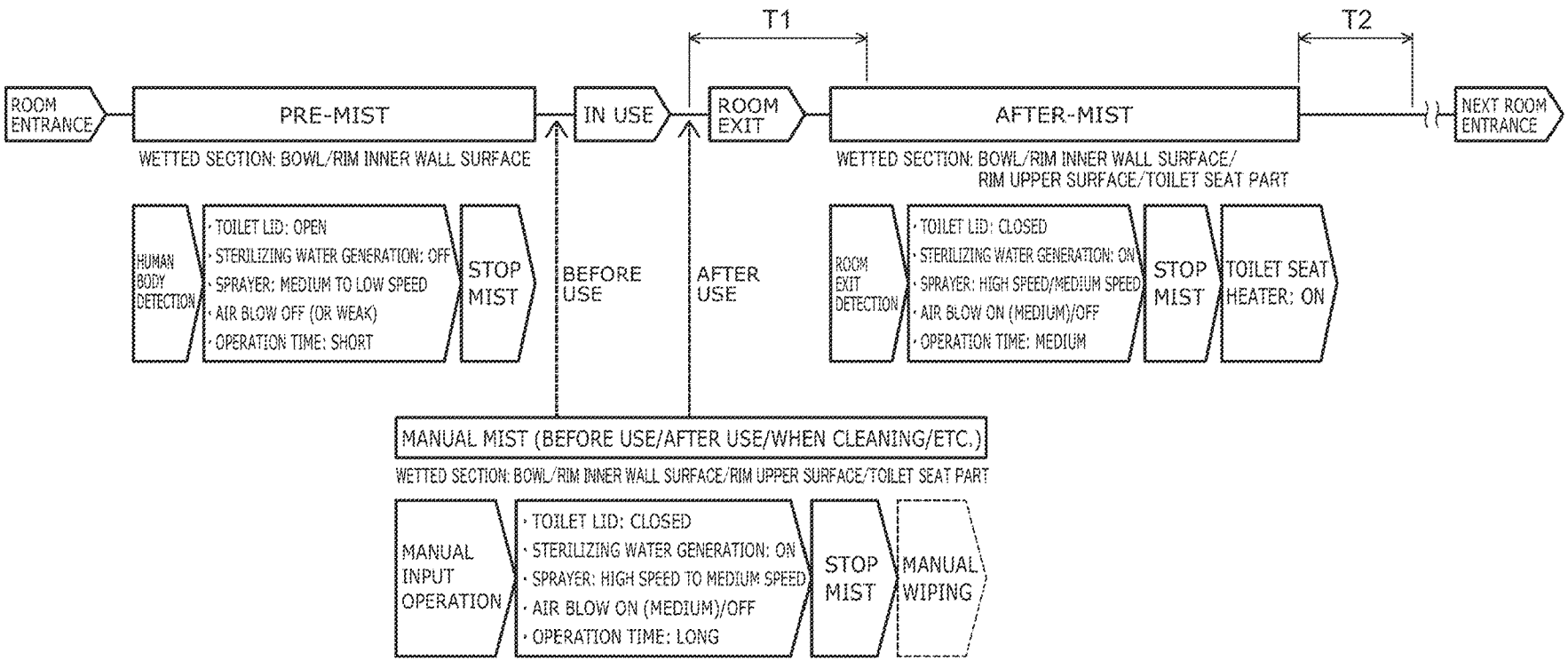
FIG. 18 is a flowchart illustrating operations of the toilet seat device according to the embodiment.

FIG. 18 is a flowchart illustrating operations of the toilet seat device according to the embodiment.

Figures 19A, 19B:
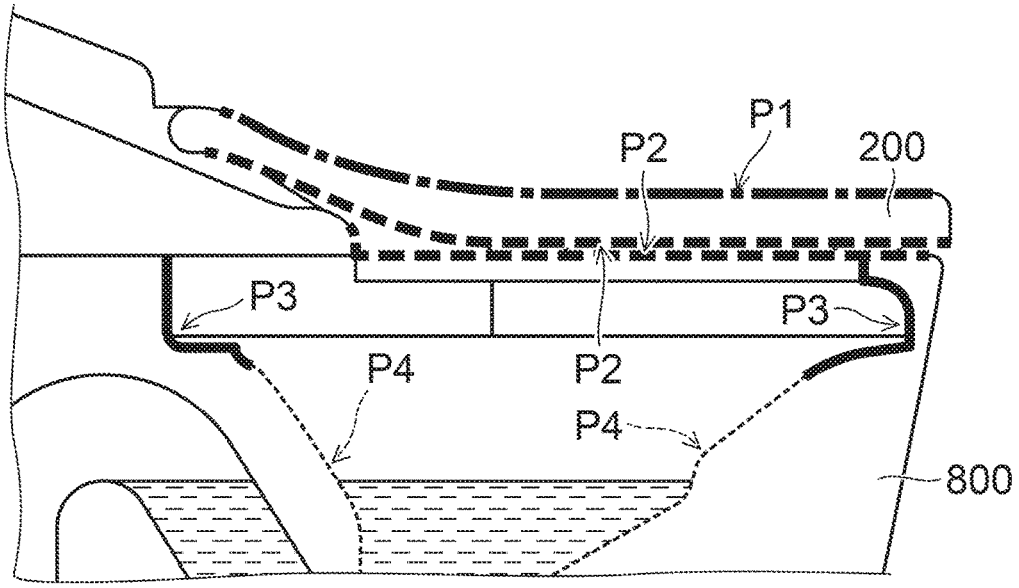
FIG. 19A and FIG. 19B are schematic views illustrating the operations of the toilet seat device according to the embodiment.

FIG. 19A and FIG. 19B are schematic views illustrating the operations of the toilet seat device according to the embodiment.

FIG. 19B shows wetted sections (P1 to P4) wetted by the mist of the sterilizing water or the service water. FIG. 19A shows the wetting amount (the wetting amount per unit area) of each wetted section of each mist mode using the four levels of "large," "medium," "small," and "extremely small."

After the state changes from a state in which the detecting sensor 402 does not detect the user to a state in which the user is detected, the pre-mist mode automatically sprays the mist of the sterilizing water or the mist of the service water into the flush toilet 800 so that the sterilizing water or the service water does not wet the toilet seat 200.

For example, as shown in FIG. 18, when the user enters the toilet room and the human body detection sensor 403 detects the entrance of the user, a signal (detection information) that indicates the entrance of the user is transmitted to the controller 405. Based on the signal, the controller 405 automatically executes the pre-mist mode. In the pre-mist mode, the controller 405 causes the sprayer 481 to spray the mist of the service water and cause the mist to wet the wetted sections. The wetted sections of the pre-mist mode are the wetted section P3 (the inner wall surface 807 of the rim 805) and the wetted section P4 (the bowl 801) as shown in FIG. 19A and FIG. 19B. In the pre-mist mode, the toilet seat 200 and the upper surface 806 of the rim 805 are not wetted sections of the spraying.

Thus, before the toilet seat device 100 is used, the sterilizing water or the service water is caused to wet the interior of the flush toilet 800 by the pre-mist mode. Thereby, a water film is formed inside the flush toilet 800 where the dirt load is large and the tolerance for being wet is high; and the adhesion of the excrement can be suppressed. On the other hand, for the toilet seat 200 and/or the upper surface 806 of the rim 805 where the dirt load is small, even without forming the water film by the pre-mist mode, the adhesion of the excrement can be suppressed by causing the sterilizing water to wet the toilet seat 200 and/or the upper surface 806 of the rim 805 by the after-mist mode after the toilet seat device 100 is used. Therefore, in the pre-mist mode of the toilet seat device 100, the mist of the sterilizing water or the service water is sprayed into the flush toilet 800 so that the mist does not wet the toilet seat 200. Thereby, by the pre-mist mode and the after-mist mode, the user becoming wet due to the sterilizing water or the service water sprayed by the pre-mist mode can be prevented while suppressing the occurrence of bacteria and/or dirt in a wide area including the flush toilet 800, the toilet seat 200, etc. For example, the contact of the buttocks and/or the hand of the user with the sterilizing water or the service water wetting the toilet seat can be prevented even in the case where the user rotates the toilet seat 200 by hand or is seated on the toilet seat 200 directly after executing the pre-mist mode. In other words, the user can use the toilet seat device 100 soon without becoming wet due to the mist.

Further, by not causing the mist to wet the toilet seat 200 in the pre-mist mode, the water film can be formed inside the flush toilet 800 in a short length of time; and the execution time of the pre-mist mode can be shortened. The user that enters the toilet room can use the toilet seat device 100 without waiting for the end of the pre-mist mode.

The scope of the "sterilizing water or the service water not wetting the toilet seat" in the pre-mist mode includes not only the case where none of the mist wets the toilet seat 200 but also the case where a slight amount of the mist wets the toilet seat 200. For example, the amount of the service water or the sterilizing water wetting the toilet seat 200 in the pre-mist mode is less than the amount of the sterilizing water wetting the toilet seat 200 in the after-mist mode or the manual mist mode. However, in the pre-mist mode, it is favorable for the amount of the sterilizing water or the service water wetting the toilet seat 200 to be as small as possible; for example, it is favorable to be zero.

After the state changes from the state in which the detecting sensor 402 detects the user to the state in which the user is not detected, the after-mist mode automatically sprays the mist of the sterilizing water into the flush toilet 800 and onto the toilet seat 200.

For example, as shown in FIG. 18, when the user exits the toilet room and the human body detection sensor 403 detects the exit of the user, a signal (detection information) that indicates the exit of the user is transmitted to the controller 405. Based on the signal, the controller 405 automatically executes the after-mist mode. In the after-mist mode, the controller 405 causes the sterilizer 450 to generate the sterilizing water, causes the sprayer 481 to spray the mist of the sterilizing water, and causes the mist to wet the wetted sections. The wetted sections of the after-mist mode are the wetted section P1 (a front surface 203 of the toilet seat 200), the wetted section P2 (the back surface 204 of the toilet seat 200 and the upper surface 806 of the rim 805), the wetted section P3, and the wetted section P4 as shown in FIG. 19A and FIG. 19B.

Thus, by executing the after-mist mode, the sterilizing water can be automatically caused to wet the toilet seat 200 and the interior of the flush toilet 800 after the user uses the toilet seat device 100. Thereby, the occurrence of bacteria and/or dirt can be suppressed automatically in a wide area including not only the flush toilet 800 but also the toilet seat 200, etc.

Because the after-mist mode is executed after the user uses the toilet seat device 100, a long unused time is ensured easily compared to before use. Therefore, even in the case where the toilet seat 200 and/or the upper surface 806 of the rim 805 become wet due to the after-mist mode, the toilet seat 200 and/or the upper surface 806 of the rim 805 are dried easily before the next use.

The manual mist mode sprays the mist of the sterilizing water into the flush toilet 800 and onto the toilet seat 200 after the user operates the manual operation part 500.

For example, as shown in FIG. 18, when the user operates the manual operation part 500 when entering the toilet room (e.g., after executing the pre-mist mode), a signal (operation information) that corresponds to the operation is transmitted to the controller 405. The controller 405 executes the manual mist mode based on the signal. The manual mist mode is executed for the toilet seat device 100 at the timing of before use, after use, when cleaning, etc. In the manual mist mode, the controller 405 causes the sterilizer 450 to generate the sterilizing water, causes the sprayer 481 to spray the mist of the sterilizing water, and causes the mist to wet the wetted sections. The wetted sections of the manual mist mode are the wetted section P1, the wetted section P2, the wetted section P3, and the wetted section P4 as shown in FIG. 19A and FIG. 19B.

Thus, by the manual mist mode, the occurrence of bacteria and/or dirt can be suppressed further by causing the sterilizing water to wet the toilet seat 200 and the interior of the flush toilet 800. For example, for adhered dirt that is difficult to suppress by the after-mist mode, sterilization can be performed by wiping the wetting sterilizing water using toilet paper, etc. The user can perform the wiping sterilization easily without using dedicated sterilizing paper.

For example, a user that is anxious about the dirt of the toilet seat 200 before use of the toilet seat device 100 can sterilize the toilet seat 200 by using the manual mist mode. The sense of security and/or the satisfaction of the user can be increased because the sterilization is executed based on an operation performed personally by the user.

As shown in FIG. 18, the controller 405 executes the after-mist mode when the state changes from the state in which the detecting sensor detects the user to the state in which the user is not detected even in the case where the manual mist mode has been executed in the state in which the detecting sensor detected the user. Thereby, even in the case where the manual mist mode is executed before the use of the toilet seat device 100 (defecation and/or urination) by the user, the occurrence of bacteria and/or dirt can be suppressed more reliably by executing the after-mist mode.

However, in the case where the user exits the toilet room directly after the end of the manual mist mode, etc., there is a possibility that the sterilizing water wetting the toilet seat 200 and/or the upper surface 806 of the rim 805 has not been wiped. For example, as shown in FIG. 18, in the case where the manual mist mode is executed after the toilet seat device 100 is used and the state changes to the state in which the detecting sensor does not detect the user within a first prescribed length of time T1 from the end of the manual mist mode, there is a possibility that the sterilizing water may remain on the toilet seat 200 and/or the upper surface 806 of the rim 805.

Therefore, the controller 405 may not execute the after-mist mode in the case where the state changes from the state in which the detecting sensor detects the user to the state in which the user is not detected within the first prescribed length of time T1 from the end of the manual mist mode. Or, the controller 405 may set the amount of the sterilizing water sprayed by the sprayer 481 in the after-mist mode to be small compared to the case where the state changes from the state in which the detecting sensor detects the user to the state in which the user is not detected after the first prescribed length of time T1 has elapsed from the end of the manual mist mode. Thereby, the toilet seat 200 and/or the upper surface 806 of the rim 805 can be prevented from becoming too wet due to the after-mist mode; and the sterilizing water can be prevented from dripping outside the flush toilet. The first prescribed length of time T1 is, for example, about 10 seconds to about 30 seconds. However, the first prescribed length of time T1 is not limited thereto and can be set appropriately.

Also, in the case where the next user enters the toilet room directly after the end of the after-mist mode, etc., there is a possibility that the toilet seat 200 and/or the upper surface 806 of the rim 805 may be wet due to the sterilizing water. For example, in the case where the next user enters the toilet room and operates the manual operation part 500 within a second prescribed length of time T2 from the end of the after-mist mode, there is a possibility that the sterilizing water may still remain on the toilet seat 200 and/or the upper surface 806 of the rim 805.

Therefore, the controller 405 may not execute the manual mist mode in the case where the manual operation part 500 is operated within the second prescribed length of time T2 from the end of the after-mist mode. Or, the controller 405 may set the amount of the sterilizing water sprayed by the sprayer 481 in the manual mist mode to be small compared to the case where the manual operation part 500 is operated after the second prescribed length of time T2 has elapsed from the end of the after-mist mode. Thereby, the toilet seat 200 and/or the upper surface 806 of the rim 805 can be prevented from becoming too wet due to the manual mist mode; and the sterilizing water can be prevented from dripping outside the flush toilet. The second prescribed length of time T2 is, for example, about 10 seconds to about 30 seconds. However, the second prescribed length of time T2 is not limited thereto and can be set appropriately.

The controller 405 controls the sprayer to cause the wetting amount (the average wetting amount) per unit area of the sterilizing water wetting the toilet seat 200 in the manual mist mode to be more than the wetting amount (the average wetting amount) of the sterilizing water per unit area of the sterilizing water wetting the toilet seat 200 in the after-mist mode. For example, as shown in FIG. 19A, the amount of the sterilizing water per unit area wetting the wetted section P1 and the wetted section P2 is "small" in the manual mist mode. In the after-mist mode, the amount of the sterilizing water per unit area wetting the wetted section P1 is "extremely small;" and the amount of the sterilizing water per unit area wetting the wetted section P2 is "small."

Thus, by causing the amount of the sterilizing water wetting the toilet seat 200 in the after-mist mode to be relatively small, the toilet seat 200 can be dried in a short length of time after the after-mist. Thereby, even in the case where the user uses the toilet seat device 100 after the after-mist, the sterilizing water can be prevented from contacting the hand and/or the buttocks of the user. Also, by causing the amount of the sterilizing water wetting the toilet seat 200 in the manual mist mode to be relatively large, the sterilizing water can sufficiently permeate the toilet paper, etc. Thereby, the sterilizing performance by wiping can be improved; and scratches on the resin toilet seat 200 when wiping can be suppressed. Accordingly, the drying performance in the after-mist mode and the wiping performance in the manual mist mode both can be realized.

As shown in FIG. 19A, the amount of the sterilizing water per unit area wetting the wetted section P3 and the wetted section P4 in the manual mist mode and the after-mist mode is "large." On the other hand, the amount of the sterilizing water per unit area wetting the wetted section P3 and the wetted section P4 in the pre-mist mode is "medium." The occurrence of bacteria and/or dirt can be suppressed further by causing much of the sterilizing water to wet the interior of the flush toilet 800 after the toilet seat device 100 is used.

For example, the controller 405 controls the sprayer to cause the particle size of the mist of the sterilizing water sprayed in the after-mist mode to be smaller than the particle size of the mist of the service water (or the sterilizing water) sprayed in the pre-mist mode. Also, the controller 405 controls the sprayer to cause the particle size of the mist of the sterilizing water sprayed in the manual mist mode to be smaller than the particle size of the mist of the service water (or the sterilizing water) sprayed in the pre-mist mode.

Thus, by causing the particle size of the mist in the after-mist mode and the manual mist mode to be small, the mist of the sterilizing water is diffused easily in a wide area. Thereby, the bacteria and/or the dirt can be suppressed in a wide area including not only the bowl 801 but also the rim 805, the toilet seat 200, etc. By causing the particle size of the mist in the pre-mist mode to be large, a water film can be formed on the bowl 801 and/or the inner wall surface 807 of the rim 805 in a short length of time. Thereby, the pre-mist mode can be ended before the user is seated on the toilet seat.

In the embodiment, the controller 405 controls the sprayer 481 to cause the wetting amount per unit area of the sterilizing water at the toilet seat 200 and the wetting amount per unit area of the sterilizing water at the upper surface 806 of the rim 805 each to be smaller than the wetting amount per unit area of the sterilizing water at the bowl 801 and smaller than the wetting amount per unit area of the sterilizing water at the inner wall surface 807 of the rim 805 for one time of performing the mist mode (e.g., one time of performing the after-mist mode).

In other words, according to the embodiment, the controller 405 causes the amount of the sterilizing water wetting the bowl 801 and the inner wall surface 807 of the rim 805 for one time of performing the mist mode to be relatively large. The occurrence of bacteria and/or dirt can be suppressed by causing much of the mist of the sterilizing water to wet the bowl 801 and the inner wall surface 807 of the rim 805 where the dirt load is large and the tolerance for being wet is high.

According to the embodiment, the controller 405 causes the amount of the sterilizing water wetting the toilet seat 200 and/or the upper surface 806 of the rim 805 for one time of performing the mist mode to be relatively small. The bacteria and/or the dirt can be suppressed by causing a relatively small amount of the sterilizing water to wet the toilet seat 200 and/or the upper surface 806 of the rim 805 because the dirt load is relatively small.

Also, the toilet seat 200 and/or the upper surface 806 of the rim 805 can be dried in a short length of time by reducing the wetting amount of the sterilizing water at the toilet seat 200 and/or the upper surface 806 of the rim 805 where the tolerance for being wet is low. Thereby, the sterilizing water can be prevented from contacting the skin of the user and dripping outside the flush toilet.

Thus, according to the embodiment, the sterilizing water dripping outside the flush toilet and the occurrence of discomfort due to the sterilizing water contacting the skin of the user can be prevented while suppressing the bacteria and/or the dirt in a wide area including not only the bowl 801 of the flush toilet but also the rim 805, the toilet seat 200, etc.

For example, the controller 405 controls the sprayer 481 to cause the wetting amount at the toilet seat 200 (the wetting amount per unit area of the sterilizing water at the toilet seat) to be a wetting amount causing the sterilizing water wetting the toilet seat 200 to accumulate without droplets dripping for one time of performing the mist mode. Also, the controller 405 controls the sprayer to cause the wetting amount at the upper surface 806 of the rim 805 (the wetting amount per unit area of the sterilizing water at the upper surface of the rim) to be a wetting amount causing the sterilizing water wetting the upper surface 806 of the rim 805 to accumulate without droplets dripping for one time of performing the mist mode.

Thus, the sterilizing water accumulates without droplets dripping on the toilet seat 200 and/or the upper surface 806 of the rim 805 where the dirt load is small; therefore, a long time of the oxidative decomposition effect and/or the bleaching effect of the sterilizing water can be ensured; and the occurrence of bacteria and/or dirt can be suppressed. Also, the risk of the sterilizing water dripping and dropping outside the toilet can be reduced by causing the wetting amount at the toilet seat 200 and/or the upper surface 806 of the rim 805 to be a wetting amount causing the sterilizing water to accumulate.

The controller 405 controls the sprayer 481 to cause the wetting amount at the bowl 801 (the wetting amount per unit area of the sterilizing water at the bowl) to be a wetting amount causing dripping of droplets of the sterilizing water wetting the bowl 801 for one time of performing the mist mode. Also, the controller 405 controls the sprayer 481 to cause the wetting amount at the inner wall surface 807 of the rim 805 (the wetting amount per unit area of the sterilizing water at the inner wall surface of the rim) to be a wetting amount causing dripping of droplets of the sterilizing water wetting the inner wall surface 807 of the rim 805 for one time of performing the mist mode.

Thus, by causing dripping of droplets of the sterilizing water at the bowl 801 and/or the inner wall surface 807 of the rim 805 where the dirt load is large, not only the oxidative decomposition effect and/or the bleaching effect but also the effect of the dirt being rinsed away by the sterilizing water can be utilized. Thereby, the occurrence of bacteria and/or dirt can be suppressed more effectively than in the case where the sterilizing water is caused to accumulate.

"Droplets dripping" refers to water (e.g., the sterilizing water) adhered to the surface of an object flowing and dropping. A droplet of water and/or a water film flowing due to its own weight or flowing due to a vibration due to an operation of the toilet device, etc., also are within the scope of "droplets dripping."

For example, the controller 405 controls the sprayer to cause the wetting amount at the toilet seat 200 to be a wetting amount causing the sterilizing water wetting the toilet seat 200 to accumulate without droplets dripping when the toilet seat 200 is rotated by the toilet seat motor 511 (the rotating device).

Thereby, the dripping of droplets of the sterilizing water can be prevented even when the toilet seat 200 is rotated; therefore, a long effective time of the oxidative decomposition effect and the bleaching effect of the sterilizing water can be ensured; and the occurrence of bacteria and/or dirt can be suppressed further. Also, the risk of the sterilizing water dripping and dropping at an unintended section can be reduced by causing the wetting amount at the toilet seat 200 to be a wetting amount causing the sterilizing water to accumulate.

The control of the wetting amount such as the description described above is possible by controlling the particle size of the mist sprayed from the sprayer 481. For example, the controller 405 controls the sprayer 481 to cause the particle size of the mist of the sterilizing water sprayed onto the toilet seat 200 and the particle size of the mist of the sterilizing water sprayed onto the upper surface 806 of the rim 805 each to be smaller than the particle size of the mist of the sterilizing water sprayed onto the bowl 801 and smaller than the particle size of the mist of the sterilizing water sprayed onto the inner wall surface 807 of the rim 805. The particle size of the mist of the sterilizing water sprayed onto each section is, for example, the particle size of the mist wetting each section.

By causing the particle size of the mist of the sterilizing water wetting the toilet seat 200 and the upper surface 806 of the rim 805 to be small, the sterilizing water that wets the toilet seat and the upper surface of the rim does not drip easily. Also, by causing the particle size of the mist of the sterilizing water wetting the bowl 801 and the inner wall surface 807 of the rim 805 to be large, the sterilizing water that wets the bowl 801 and the inner wall surface 807 of the rim 805 drips easily; and the effect of rinsing away the dirt can be improved.

A method for measuring the wetting amount (the average wetting amount) will now be described with reference to FIG. 20A to FIG. 20E.

Figure 20A:
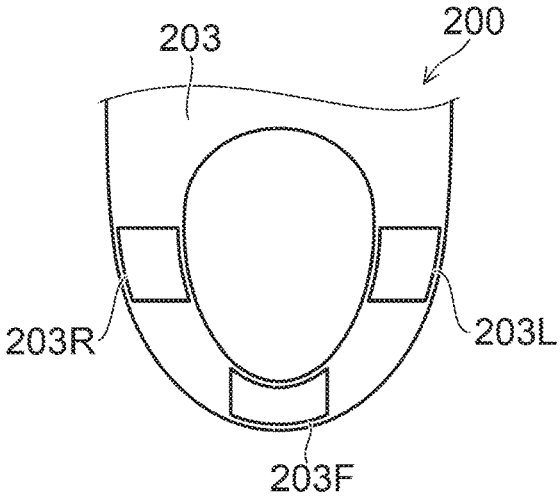
FIG. 20A to FIG. 20E are plan views illustrating the toilet device according to the embodiment.
Figure 20C:
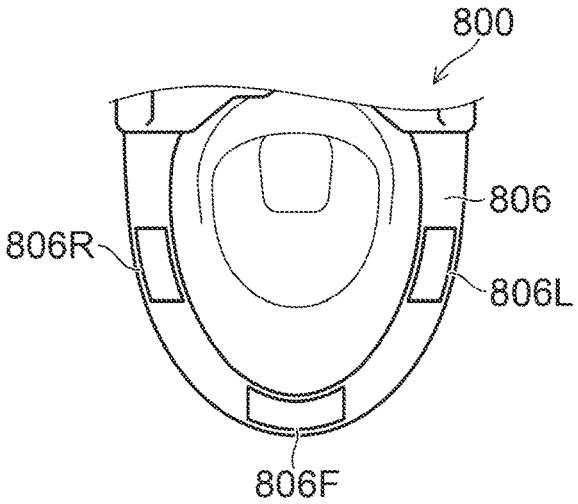
Figure 20B:
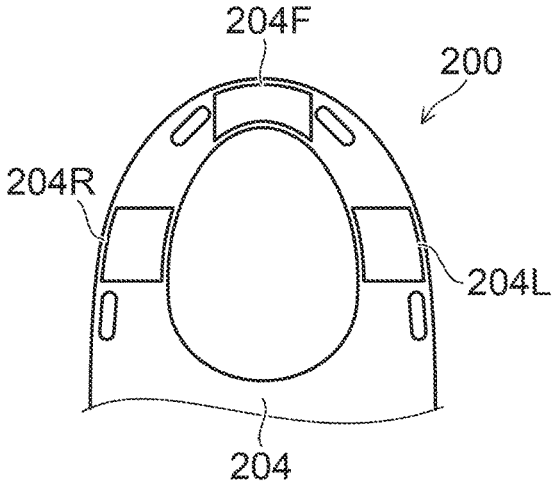

FIG. 20A to FIG. 20E are plan views illustrating the toilet device according to the embodiment. FIG. 20A and FIG. 20B respectively show the front surface 203 of the toilet seat 200 and the back surface 204 of the toilet seat 200. The front surface 203 is the seating surface where the user is seated and faces upward in the state in which the toilet seat 200 is closed. The back surface 204 is the surface on the side opposite to the front surface 203 and faces downward in the state in which the toilet seat 200 is closed.

As shown in FIG. 20A, the front surface 203 includes a tip region 203F positioned on the front side, a side region 203R positioned at the right, and a side region 203L positioned at the left in the state in which the toilet seat 200 is closed. The surface area of each region is set to 20 square centimeters ($cm^2$).

The average of the wetting amount ($g/cm^2$) per unit area at the tip region 203F, the wetting amount ($g/cm^2$) per unit area at the side region 203R, and the wetting amount ($g/cm^2$) per unit area at the side region 203L is taken to be the wetting amount (the average wetting amount ($g/cm^2$)) per unit area at the front surface 203.

As shown in FIG. 20B, the back surface 204 includes a tip region 204F positioned on the front side, a side region 204R positioned at the right, and a side region 204L positioned at the left in the state in which the toilet seat 200 is closed. The surface area of each region is set to 20 square centimeters ($cm^2$).

The average of the wetting amount ($g/cm^2$) per unit area at the tip region 204F, the wetting amount ($g/cm^2$) per unit area at the side region 204R, and the wetting amount ($g/cm^2$) per unit area at the side region 204L is taken to be the wetting amount (the average wetting amount ($g/cm^2$)) per unit area at the back surface 204.

The wetting amount (the average wetting amount ($g/cm^2$)) per unit area at the toilet seat 200 is the average of the wetting amount per unit area at the front surface 203 and the wetting amount per unit area at the back surface 204.

As shown in FIG. 20C, the upper surface 806 of the rim 805 includes a tip region 806F positioned on the front side, a side region 806R positioned at the right, and a side region 806L positioned at the left. The surface area of each region is set to 20 square centimeters ($cm^2$).

The wetting amount (the average wetting amount ($g/cm^2$)) per unit area at the upper surface 806 of the rim 805 is the average of the wetting amount ($g/cm^2$) per unit area at the tip region 806F, the wetting amount (g/cm$^2$) per unit area at the side region 806R, and the wetting amount (g/cm$^2$) per unit area at the side region 806L.

Figure 20D:
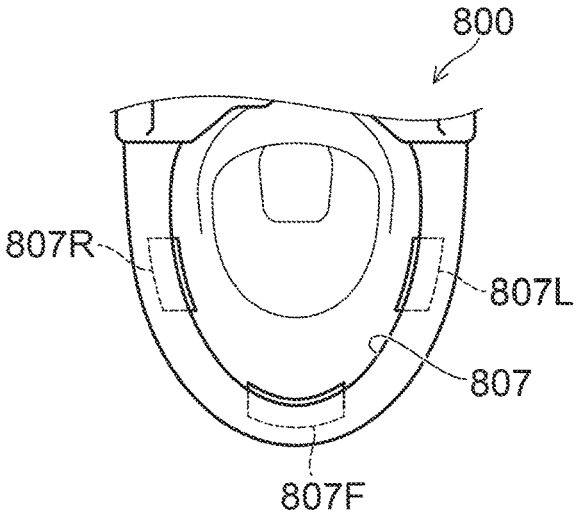

As shown in FIG. 20D, the inner wall surface 807 of the rim 805 includes a tip region 807F positioned on the front side, a side region 807R positioned at the right, and a side region 807L positioned at the left. The surface area of each region is set to 20 square centimeters (cm$^2$).

The wetting amount (the average wetting amount (g/cm$^2$)) per unit area at the inner wall surface 807 of the rim 805 is the average of the wetting amount (g/cm$^2$) per unit area at the tip region 807F, the wetting amount (g/cm$^2$) per unit area at the side region 807R, and the wetting amount (g/cm$^2$) per unit area at the side region 807L.

Figure 20E:
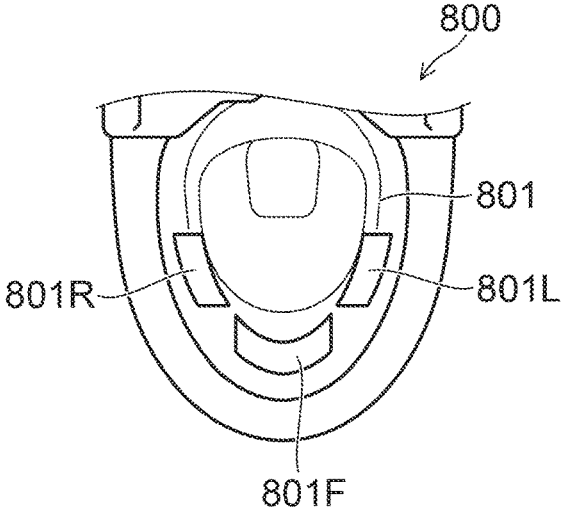

As shown in FIG. 20E, the bowl 801 (the part of the inner side surface of the bowl 801 where the accumulated water is not provided) includes a tip region 801F positioned on the front side, a side region 801R positioned at the right, and a side region 801L positioned at the left. The surface area of each region is set to 20 square centimeters (cm$^2$).

The wetting amount (the average wetting amount (g/cm$^2$)) per unit area at the bowl 801 is the average of the wetting amount (g/cm$^2$) per unit area at the tip region 801F, the wetting amount (g/cm$^2$) per unit area at the side region 801R, and the wetting amount (g/cm$^2$) per unit area at the side region 801L.

The measurement of the wetting amount per unit area of each region (203F, 203L, 203R, 204F, 204L, 204R, 806F, 806L, 806R, 807F, 807L, 807R, 801F, 801L, and 801R) shown in FIG. 20A to FIG. 20E is as follows.

First, after spraying the mist, a region that has a constant surface area is wiped with paper; and the mist that wets the region is absorbed by the paper. Then, the amount (the wetting amount) of the mist wetting the region is taken to be the difference between the weight of the paper before the absorption and the weight of the paper after the absorption. The wetting amount per unit area of the region is calculated by dividing the wetting amount by the surface area of the region (the wiped surface area).

FIG. 21 is a table illustrating the wetting amount of the mist in the after-mist mode.

FIG. 21 shows the size relationship of the wetting amount per unit area in each region shown in FIG. 20A to FIG. 20E using the four levels of "large," "medium," "small," and "extremely small."

For example, the wetting amount per unit area is "medium" in the tip region and the side region of the upper surface 806 of the rim 805. Conversely, the wetting amount per unit area is "extremely small" in the tip region and the side region of the front surface 203 of the toilet seat 200.

In other words, the controller 405 controls the sprayer 481 to cause the wetting amount per unit area of the sterilizing water at the upper surface 806 of the rim 805 to be more than the wetting amount per unit area of the sterilizing water at the front surface 203 of the toilet seat 200. Compared to the front surface 203 of the toilet seat 200 directly contacted by the user, by causing the wetting amount of the sterilizing water to be high at the upper surface 806 of the rim 805 where the likelihood of direct contact by the user is low, the occurrence of bacteria and/or dirt at the upper surface 806 of the rim 805 can be suppressed.

When the user urinates while seated on the toilet seat 200, the urine and/or the liquid waste that strikes and splatters from the bowl 801 and/or the accumulated water 801*w* adheres easily to the front side of the back surface 204 of the toilet seat 200. Therefore, compared to the lateral side of the back surface 204 of the toilet seat 200, the front side of the back surface 204 of the toilet seat 200 is a part where the dirt load is large. Conversely, as shown in FIG. 21, the wetting amount per unit area is "large" in the tip region of the back surface 204 of the toilet seat 200; and the wetting amount per unit area is "small" in the side region of the back surface 204 of the toilet seat 200.

In other words, in the case where the front side of the opening 200*a* of the toilet seat 200 is set to be a front section and in the case where the lateral side of the opening 200*a* is set to be a side section, the controller 405 controls the sprayer 481 to cause the wetting amount (the average wetting amount) per unit area of the sterilizing water at the front section of the back surface 204 of the toilet seat 200 to be more than the wetting amount (the average wetting amount) per unit area of the sterilizing water at the side section of the back surface 204 of the toilet seat 200. The occurrence of bacteria and/or dirt at the back surface 204 of the toilet seat 200 can be suppressed further by increasing the amount of the sterilizing water wetting the front side compared to the lateral side.

Compared to the front surface 203, the likelihood of the user directly contacting the back surface 204 of the toilet seat 200 is low; therefore, the back surface 204 of the toilet seat 200 is a part having a high tolerance for being wet. Also, the urine and/or the liquid waste that strikes and splatters from the bowl 801 and/or the accumulated water 801*w* adheres easily to the back surface 204 of the toilet seat 200. Therefore, compared to the front surface 203 of the toilet seat 200, the back surface 204 of the toilet seat 200 is a part where the dirt load is large. Conversely, as shown in FIG. 21, the controller 405 controls the sprayer 481 to cause the wetting amount per unit area of the sterilizing water at the back surface 204 of the toilet seat 200 to be more than the wetting amount per unit area of the sterilizing water at the front surface 203 of the toilet seat 200.

In other words, the amount of the sterilizing water wetting the back surface 204 of the toilet seat 200 is large compared to that of the front surface 203 of the toilet seat 200. The occurrence of bacteria and/or dirt can be suppressed by increasing the amount of the sterilizing water wetting the back surface 204 of the toilet seat 200.

As shown in FIG. 21, the wetting amount per unit area is "large" in the tip region and the side region of the inner wall surface 807 of the rim 805; and the wetting amount per unit area is "large" in the tip region and the side region of the bowl 801. However, the amount of the sterilizing water per unit area directly wetting the tip region and the side region of the bowl 801 is "medium."

In other words, the controller 405 controls the sprayer 481 to cause the wetting amount (the average wetting amount) per unit area of the sterilizing water directly wetting the inner wall surface 807 of the rim 805 to be more than the wetting amount (the average wetting amount) per unit area of the sterilizing water directly wetting the bowl 801. The wetting amount of the sterilizing water directly wetting does not include the amount of the sterilizing water flowing and dropping from above.

The flushing water of the toilet flush flows in the bowl 801; and the flushing water of the toilet flush does not flow on the inner wall surface 807 of the rim 805. Therefore, compared to the bowl 801, the dirt load is large at the inner wall surface 807 of the rim 805. Therefore, as recited above, the occurrence of bacteria and/or dirt at the inner wall surface 807 can be suppressed further by increasing the amount of the sterilizing water directly wetting the inner wall surface 807 of the rim 805 where the dirt load is relatively large.

Figure 22A:
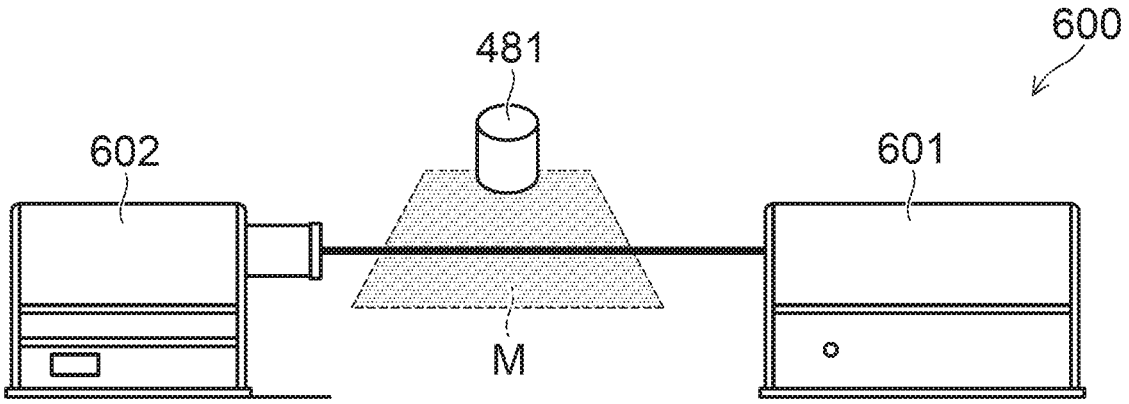
FIG. 22A and FIG. 22B are perspective views illustrating a method for measuring the particle size according to the embodiment.
Figure 22B:
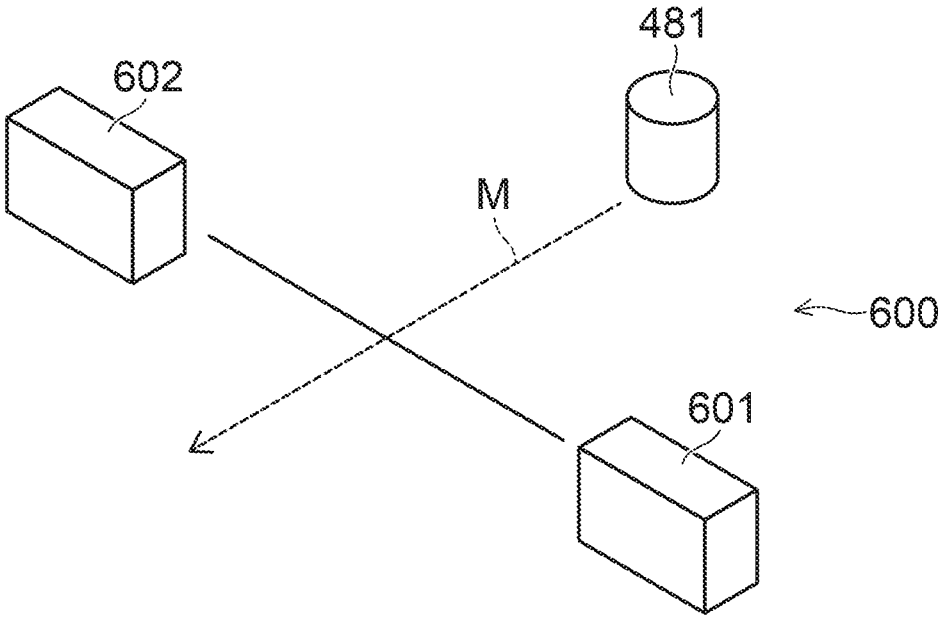

FIG. 22A and FIG. 22B are perspective views illustrating a method for measuring the particle size according to the embodiment.

Laser diffraction is used to measure the particle size. When a laser is irradiated on fine particles, diffraction-scattered light is generated in various directions from the fine particles. The intensity of the diffraction-scattered light has a spatial pattern in the direction in which the light is emitted. The spatial pattern is called a light intensity distribution pattern. The light intensity distribution pattern changes according to the particle size of the fine particle. The particle size can be calculated by detecting the light intensity distribution pattern by utilizing the correlation between the particle size of the fine particle and the light intensity distribution pattern.

As shown in FIG. 22A and FIG. 22B, a measurement device 600 of the particle size includes a light emitter 601 and a light receiver 602. The light receiver 602 is provided so that the light receiver 602 can receive the laser emitted by the light emitter 601. In the measurement of the particle size, the laser that is emitted by the light emitter 601 is irradiated on the mist M sprayed from the sprayer 481. The light receiver 602 receives the diffraction-scattered light generated by the irradiation of the laser. Thereby, the light intensity distribution pattern can be detected. The Aerotrac LDSA-3500A (made by the MicrotracBEL Corporation) can be used as the measurement device.

Figure 23A:
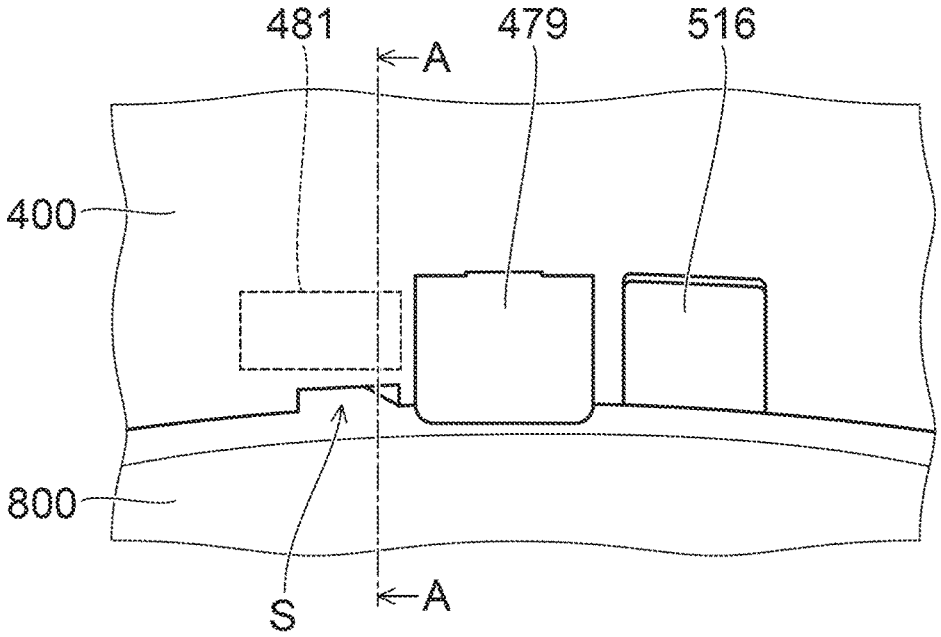
FIG. 23A and FIG. 23B are a plan view and a cross-sectional view illustrating a part of a toilet device according to a modification of the embodiment.
Figure 23B:
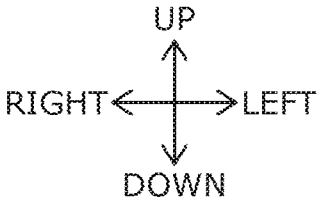
Figure 23B:
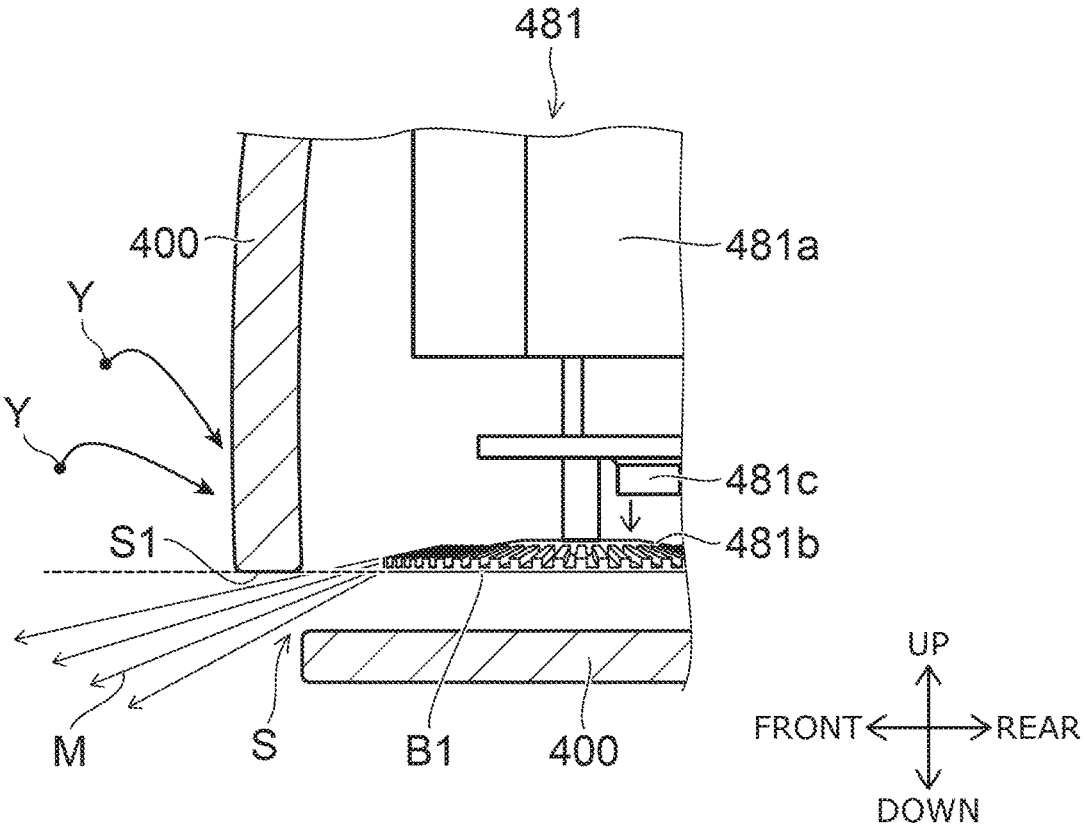

FIG. 23A and FIG. 23B are a plan view and a cross-sectional view illustrating a part of a toilet device according to a modification of the embodiment.

FIG. 23A is a plan view of a part of the toilet device when viewed from the front. FIG. 23B is a cross-sectional view along line A-A shown in FIG. 23A.

In the example as shown in FIG. 23A and FIG. 23B, the mist damper 482 is not provided; and a slit S is provided in the casing 400. The sprayer 481 is disposed inside the casing 400; and the slit S is positioned at the front lower part of the sprayer 481. For example, the height (the position in the vertical direction) of an upper end surface S1 of the slit S is the same as the height of a bottom surface B1 of the disk 481*b*; and the upper end surface S1 and the bottom surface B1 are in the same plane. Or, the upper end surface S1 may be lower than the bottom surface B1.

The upper surface of the disk 481*b* is tilted from horizontal; and the disk 481*b* sprays the mist M slightly downward from horizontal. The mist M that is sprayed from the disk 481*b* passes through the slit S and is sprayed into the bowl 801. Thereby, because the mist damper 482 such as that shown in FIGS. 5A to 5C is not provided, dirt Y such as urine, etc., can be prevented from adhering to the sprayer 481 without losing the designability and/or the cleanability of the toilet device.

FIG. 24 is a block diagram illustrating relevant components of the toilet device according to the modification of the embodiment.

FIG. 24 illustrates the relevant components of both the water channel system and the electrical system.

In the example as illustrated in FIG. 24, the solenoid valve 431, the sterilizer 450, the switch valve 472, the sprayer 481, the nozzle motor 476, the nozzle 473, the nozzle wash chamber 478, the flow channels 110 to 113, etc., are included in the interior of the flush toilet 800. In the example, the toilet seat motor 511 (the rotating device), the toilet lid motor 512 (the rotating device), the blower 513, the warm air heater 514, etc., also are included in the interior of the flush toilet 800. In the example, the detecting sensor 402 (e.g., the human body detection sensor 403, the seat contact detection sensor 404, etc.) and/or the controller 405 also are included in the interior of the flush toilet 800.

Thus, the members (hereinbelow, called the "functional parts") that are included in the casing 400 interior of the toilet seat device 100 in the example shown in FIG. 3 may be included in the interior of the flush toilet 800. Even in the case where the functional parts are included in the interior of the flush toilet 800, the operations of the sprayer 481, etc., can be performed similarly to the case where the functional parts are included in the interior of the casing 400.

The casing 400 of the toilet seat device 100 may be omitted in the case where the functional parts are thus included in the interior of the flush toilet 800. Or, the toilet seat 200 and the toilet lid 300 may be provided instead of the toilet seat device 100. In such a case, for example, the toilet seat 200 and the toilet lid 300 each are pivotally supported openably and closeably with respect to the flush toilet 800. In such a case, for example, the nozzle damper 479, the mist damper 482, and the blower damper 516 are pivotally supported to be rotatable with respect to the flush toilet 800.

Hereinabove, embodiments of the invention are described. However, the invention is not limited to these descriptions. Appropriate design modifications made by one skilled in the art for the embodiments described above also are within the scope of the invention to the extent that the features of the invention are included. For example, the configurations, the dimensions, the materials, the arrangements, the mounting methods, etc., of the components included in the flush toilet, the toilet seat device, etc., are not limited to those illustrated and can be modified appropriately.

Also, the components included in the embodiments described above can be combined within the limits of technical feasibility; and such combinations are within the scope of the invention to the extent that the features of the invention are included.

What is claimed is:

1. A toilet seat device mounted on a flush toilet, the toilet seat device comprising:

a toilet seat where a user is seated;

a sterilizer generating sterilizing water;

a sprayer disposed lower than the toilet seat in a state in which the toilet seat device is mounted on the flush toilet, the sprayer spraying a mist of the sterilizing water into the flush toilet;

a blower generating a rising air stream by blowing air into the flush toilet; and a controller controlling the sterilizer, the sprayer, and the blower, the controller controlling the sprayer to execute a first process and a second process and cause a total amount of the mist of the sterilizing water sprayed in the first process to be less than a total amount of the mist of the sterilizing water sprayed in the second process, the first process and the second process being executed at different timing in a state in which the controller controls the sprayer to spray the mist of the sterilizing water into the flush toilet, the first process including controlling the blower to generate a first rising air stream capable of lifting the mist of the sterilizing water toward the toilet seat, the second process including the blower not generating the first rising air stream and not lifting the mist of the sterilizing water toward the toilet seat.

2. The toilet seat device according to claim 1, wherein the controller stops the blower in the second process.

3. The toilet seat device according to claim 1, wherein the controller controls the blower to generate a second rising air stream, and a flow velocity of the second rising air stream is lower than a flow velocity of the first rising air stream in the second process.

4. The toilet seat device according to claim 1, wherein the sprayer sprays the mist of the sterilizing water in a radial configuration when viewed in the top view in the second process.

5. The toilet seat device according to claim 1, wherein the controller sets a time of the execution of the first process to be shorter than a time of the execution of the second process.

6. The toilet seat device according to claim 1, wherein the controller controls the sprayer to cause a particle size of the mist of the sterilizing water sprayed in the execution of the second process to be larger than a particle size of the mist of the sterilizing water sprayed in the execution of the first process.

7. The toilet seat device according to claim 1, wherein the controller performs the execution of the second process after the execution of the first process.

8. A toilet device, comprising:

a flush toilet including a bowl and a rim, the bowl receiving excrement, an upper edge part being formed of the rim;

a toilet seat mounted on the flush toilet, the toilet seat being where a user is seated;

a sterilizer generating sterilizing water;

a sprayer disposed lower than the toilet seat in a state in which the toilet seat is mounted on the flush toilet, the sprayer spraying a mist of the sterilizing water into the flush toilet;

a blower generating a rising air stream by blowing air into the flush toilet; and a controller controlling the sterilizer, the sprayer, and the blower, the controller controlling the sprayer to execute a first process and a second process and cause a total amount of the mist of the sterilizing water sprayed in the first process to be less than a total amount of the mist of the sterilizing water sprayed in the second process, the first process and the second process being executed at different timing in a state in which the controller controls the sprayer to spray the mist of the sterilizing water into the flush toilet, the first process including controlling the blower to generate a first rising air stream capable of lifting the mist of the sterilizing water toward the toilet seat, the second process including the blower not generating the first rising air stream and not lifting the mist of the sterilizing water toward the toilet seat.

9. The toilet device according to claim 8, wherein the controller stops the blower in the second process.

10. The toilet device according to claim 8, wherein the controller controls the blower to generate a second rising air stream, and a flow velocity of the second rising air stream is lower than a flow velocity of the first rising air stream in the second process.

11. The toilet device according to claim 8, wherein the sprayer sprays the mist of the sterilizing water in a radial configuration when viewed in the top view in the second process.

12. The toilet seat device according to claim 8, wherein the controller sets a time of the execution of the first process to be shorter than a time of the execution of the second process.

13. The toilet device according to claim 8, wherein the controller controls the sprayer to cause a particle size of the mist of the sterilizing water sprayed in the execution of the second process to be larger than a particle size of the mist of the sterilizing water sprayed in the execution of the first process.

14. The toilet device according to claim 8, wherein the controller performs the execution of the second process after the execution of the first process.

* * * * *